US006953241B2

(12) United States Patent
Sakaida et al.

(10) Patent No.: US 6,953,241 B2
(45) Date of Patent: Oct. 11, 2005

(54) INK-JET HEAD HAVING PASSAGE UNIT AND ACTUATOR UNITS ATTACHED TO THE PASSAGE UNIT, AND INK-JET PRINTER HAVING THE INK-JET HEAD

(75) Inventors: Atsuo Sakaida, Gifu (JP); Takeshi Asano, Nagoya (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/368,351

(22) Filed: Feb. 20, 2003

(65) Prior Publication Data

US 2003/0122902 A1 Jul. 3, 2003

Related U.S. Application Data

(63) Continuation-in-part of application No. 10/305,979, filed on Nov. 29, 2002.

(30) Foreign Application Priority Data

| | | |
|---|---|---|
| Nov. 30, 2001 | (JP) | 2001-365497 |
| Feb. 20, 2002 | (JP) | 2002-042651 |
| Feb. 20, 2002 | (JP) | 2002-043010 |
| Feb. 21, 2002 | (JP) | 2002-045290 |

(51) Int. Cl.[7] ..... B41J 2/045
(52) U.S. Cl. ..... 347/68
(58) Field of Search ..... 347/68, 69, 70–72

(56) References Cited

U.S. PATENT DOCUMENTS

| | | | | |
|---|---|---|---|---|
| 5,402,159 A | | 3/1995 | Takahashi et al. | |
| 5,453,777 A | | 9/1995 | Pensavecchia et al. | 347/234 |
| 5,455,615 A | | 10/1995 | Burr et al. | |
| 5,592,203 A | | 1/1997 | Thiel et al. | |
| 5,757,400 A | | 5/1998 | Hoisington | |
| 5,818,482 A | * | 10/1998 | Ohta et al. | 347/70 |
| 5,912,526 A | | 6/1999 | Okawa et al. | 310/328 |
| 6,174,051 B1 | * | 1/2001 | Sakaida | 347/72 |

FOREIGN PATENT DOCUMENTS

| | | |
|---|---|---|
| EP | 0 620 670 A1 | 10/1994 |
| EP | 0 721 839 A2 | 7/1996 |
| EP | 1 138 493 A | 10/2001 |
| JP | A 4-341852 | 11/1992 |

* cited by examiner

*Primary Examiner*—Stephen Meier
*Assistant Examiner*—An H. Do
(74) *Attorney, Agent, or Firm*—Oliff & Berridge, PLC

(57) ABSTRACT

An ink-jet head having a passage unit including pressure chambers each having one end coupled to a nozzle and the other end to be coupled to an ink supply source. The pressure chambers are arranged along a plane to neighbor each other. The ink-jet head further includes actuator units attached to a surface of the passage unit for changing the volume of each pressure chamber. Each actuator unit includes pressure generation portions respectively corresponding to pressure chambers, and is formed to extend over the pressure chambers. The actuator units are arranged along the longitudinal direction of the passage unit so that each neighboring actuator units partially overlap each other in the lateral direction of the passage unit. Each actuator unit has a basic region where many pressure generation portions are formed in a matrix, and an additional region neighboring the basic region in the lateral direction of the passage unit. In the additional region, pressure generation portions are formed to correspond to a gap portion between the pressure generation portions in the basic region of the actuator unit and the pressure generation portions in the basic region of another actuator unit neighboring that actuator unit.

12 Claims, 32 Drawing Sheets

INK-JET HEAD HAVING PASSAGE UNIT AND ACTUATOR UNITS ATTACHED TO THE PASSAGE UNIT, AND INK-JET PRINTER HAVING THE INK-JET HEAD

CROSS-REFERENCE TO RELATED APPLICATION

This application is a continuation-in-part of an earlier U.S. application having U.S. Ser. No. 10/305,979, filed on Nov. 29, 2002, which is incorporated herein by reference in its entirety.

BACKGROUND OF THE INVENTION

1. Field of Invention

The invention relates to an ink-jet head for printing by ejecting ink onto a print medium, and to an ink-jet printer having the ink-jet head.

2. Description of Related Art

In an ink-jet printer, an ink-jet head distributes ink supplied from an ink tank to pressure chambers. The ink-jet head selectively applies pressure to each pressure chamber to eject ink through a nozzle. As a means for selectively applying pressure to the pressure chambers, an actuator unit may be used in which ceramic piezoelectric sheets are laminated.

As an example, a generally known ink-jet head has one actuator unit in which continuous flat piezoelectric sheets extending over a plurality of pressure chambers are laminated. At least one of the piezoelectric sheets is sandwiched by a common electrode which is common to many pressure chambers and is being kept at the ground potential, and many individual electrodes, i.e., driving electrodes, disposed at positions corresponding to the respective pressure chambers. When a individual electrode on one face of the sheet is set at a potential different from that of the common electrode on the other face, the part of piezoelectric sheet being sandwiched by the individual and common electrodes and polarized in its thickness, is expanded or contracted in its thickness direction as an active layer by the so-called longitudinal piezoelectric effect. This causes the volume of the corresponding pressure chamber to change, so that the ink can be ejected toward a print medium through a nozzle communicating with the pressure chamber.

In the above-described ink-jet head, to ensure good ink ejection performance, the actuator unit must be accurately positioned to a passage unit so that the individual electrodes must be at predetermined positions corresponding to the respective pressure chambers in a plan view.

Generally, in an ink-jet head such as the one described above, the passage unit in which ink passages including pressure chambers have been formed is manufactured separately from the actuator unit. The passage unit is then bonded with an adhesive to the actuator unit so that the pressure chambers are close to the actuator unit. This bonding process is done by matching a mark formed on the passage unit against a mark formed on the actuator unit.

Generally, the piezoelectric sheets of the actuator unit are manufactured through a sintering process while the passage unit is laminated with metallic sheets. Therefore, as the size of the piezoelectric sheets increases, the positional accuracy of the electrodes decreases. Thus, the longer the head is, the more difficult the positioning process is between the pressure chambers in the passage unit and the individual electrodes in the actuator unit. As a result, the manufacturing yield for the printer heads is reduced.

Furthermore, because the actuator unit it is made of ceramic, it is an expensive and very brittle component. In particular, in the actuator unit having a polygonal shape, the corners can easily brake. The breakage loss causes the manufacture cost to increase. Further, the actuator unit requires very delicate handling to ensure that a corner does not collide against another component. This makes the ink-jet head assembling difficult.

SUMMARY OF THE INVENTION

An objective of the invention is to provide an ink-jet head in which an actuator unit has been accurately positioned relative to a passage unit.

Another objective of the invention is to provide an ink-jet head having an actuator unit that is difficult to brake.

According to one aspect of the invention, an ink-jet head comprises a passage unit having a plurality of pressure chambers, each having one end connected to a nozzle and the other end to be connected to an ink supply source. The plurality of pressure chambers are arranged along a plane adjacent to or neighboring each other. The ink-jet head further comprises actuator units attached to a surface of the passage unit for changing the volume of each pressure chamber. Each actuator unit includes pressure generation portions respectively corresponding to pressure chambers. Each actuator unit is formed to extend over the pressure chambers. The actuator units are arranged along the longitudinal direction of the passage unit so that each neighboring actuator units partially overlap each other in the lateral direction of the passage unit. Each actuator unit comprises a basic region where a large number of pressure generation portions are formed in a matrix, and an additional region neighboring the basic region in the lateral direction of the passage unit. In the additional region, pressure generation portions are formed to correspond to a gap portion between the pressure generation portions in the basic region of the actuator unit and the pressure generation portions in the basic region of another actuator unit neighboring that actuator unit. The above-described invention also provides an ink-jet printer having the ink-jet head.

In this construction, each of the actuator units can be positioned to the passage unit independently of each other. Therefore, even in case of a long printer head, the increase in the positional shift between electrode and pressure chamber of each actuator unit can be suppressed. Thus, both can accurately be positioned relative to each other. As a result, good ink ejection performance can be obtained and the manufacture yield of heads is improved. In addition, because the pressure generation portions in the additional region provided in an actuator unit correspond to the gap portion between them and the pressure generation portions in the basic region of a neighboring actuator unit, the number of pressure generation portions can not be made small in the vicinity of the seam portion between the actuator unit and the neighboring actuator unit. Therefore, a head can be obtained in which there is substantially no variation in the number of pressure generation portions along the longitudinal direction of the passage unit.

According to another aspect of the invention, an ink-jet head comprises a passage unit having a plurality of pressure chambers that communicate with a nozzle to eject ink. The plurality of pressure chambers are arranged along a plane neighboring each other. The ink-jet head further comprises an actuator unit attached to a surface of the passage unit for changing the volume of each pressure chamber. The actuator unit is formed to extend along the pressure chambers. The actuator unit includes pressure generation portions corresponding to the respective pressure chambers. The actuator unit has its profile with five or more straight portions. Each straight portion is connected with a neighboring straight portion at the right angle or an obtuse angle.

By making any corner of the actuator unit into the right angle or an obtuse angle, the actuator unit is difficult to brake during ink-jet head manufacture.

According to another aspect of the invention, an ink-jet head comprises a passage unit having a plurality of pressure chambers communicating with a nozzle for ejecting ink. The plurality of pressure chambers are arranged along a plane neighboring each other. The ink-jet head further comprises a plurality of actuator units arranged along the longitudinal direction of the passage unit and attached to a surface of the passage unit for changing the volume of each of the pressure chambers. Each of the actuator units includes a plurality of pressure generation portions respectively corresponding to pressure chambers. Each of the actuator units is formed to extend over the pressure chambers.

In this construction, each of the actuator units can be positioned to the passage unit independently of each other. Therefore, even in case of a long head, the increase in positional shift between electrode and pressure chamber of each actuator unit can be suppressed. Thus, both can accurately be positioned relative to each other. As a result, good ink ejection performance can be obtained and the manufacture yield of the heads is improved.

BRIEF DESCRIPTION OF THE DRAWINGS

Various exemplary embodiments of the invention will be described in detail with reference to the following figures, in which.

DETAILED DESCRIPTION OF PREFERRED EMBODIMENTS

Figure 1:
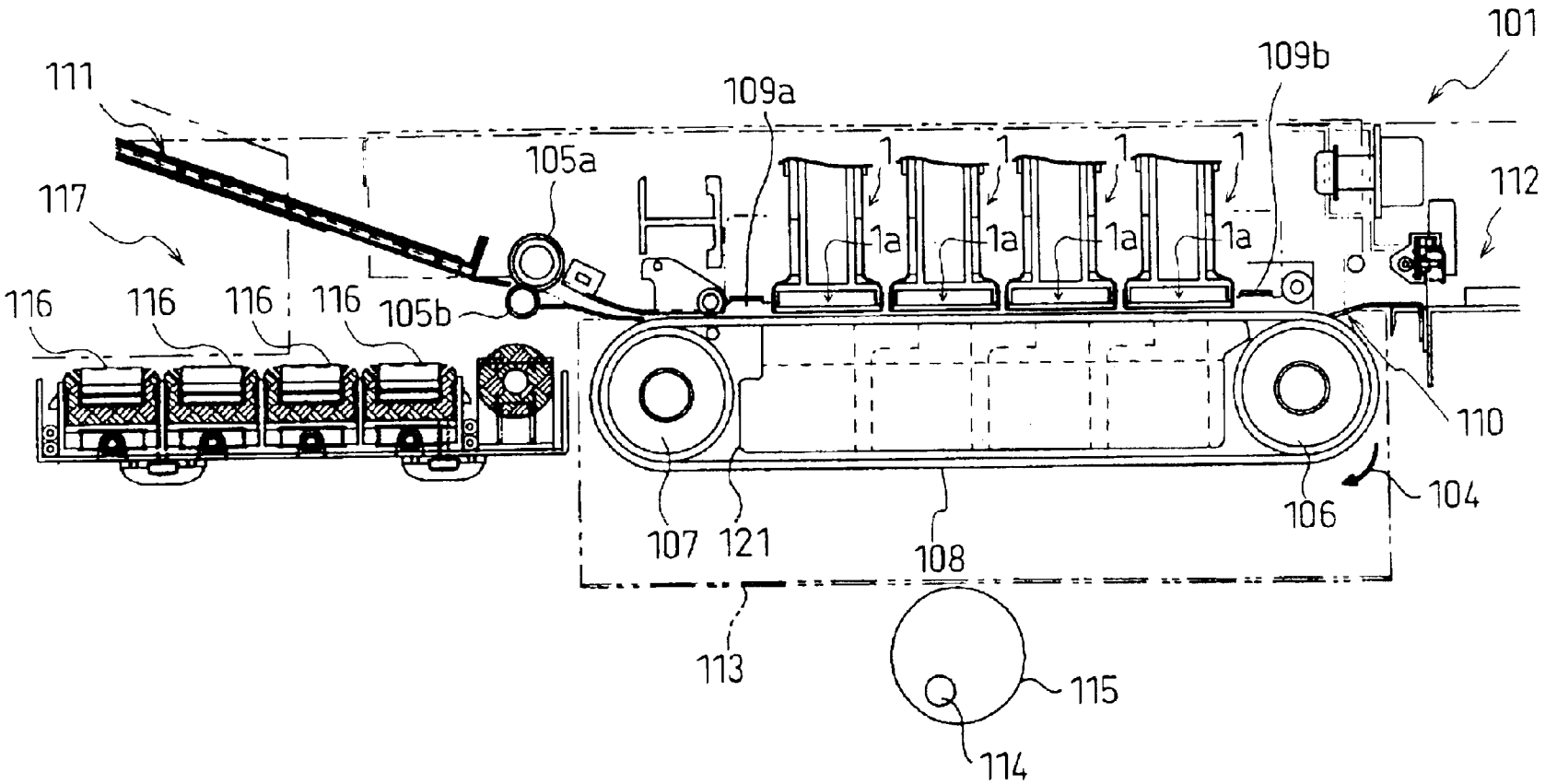
FIG. 1 is a general view of an ink-jet printer including ink-jet heads according to a first exemplary embodiment of the invention.

With reference to FIGS. 1 to 10, an ink-jet head will be described as a reference for understanding ink-jet heads according to various exemplary embodiments of the invention. FIG. 1 is a general view of an ink-jet printer having ink-jet heads according to a first exemplary embodiment of the invention. The ink-jet printer 101 shown in FIG. 1 is a color ink-jet printer having four ink-jet heads 1. In this printer 101, an image recording medium feed unit 111 and an image recording medium discharge unit 112 are disposed in left and right portions of FIG. 1, respectively.

In the printer 101, an image recording medium transfer path is provided extending from the image recording medium feed unit 111 to the image recording medium discharge unit 112. A pair of feed rollers 105*a* and 105*b* is disposed immediately downstream of the image recording medium feed unit 111 for pinching and advancing an image record medium sheet, such as a paper. In various exemplary embodiments, the image recording medium includes, for example, a sheet of paper, card stock, photo paper, a transparency, or the like.

The image recording medium is transferred by the pair of feed rollers 105*a* and 105*b* from the left to the right in FIG. 1. In the middle of the image recording medium transfer path, two belt rollers 106 and 107 and an endless transfer belt 108 are disposed. The transfer belt 108 is wound on the belt rollers 106 and 107 to extend between them. The outer face, i.e., the transfer face, of the transfer belt 108 has been treated with silicone or like material. Thus, an image recording medium fed through the pair of feed rollers 105*a* and 105*b* can be held on the transfer face of the transfer belt 108 by the adhesion of the silicone treated face. In this state, the image recording medium is transferred downstream (rightward) by driving one belt roller 106 to rotate clockwise in FIG. 1 (the direction indicated by an arrow 104).

Pressing members 109*a* and 109*b* are disposed at positions for feeding an image recording medium onto the belt roller 107 and taking out the image recording medium from the belt roller 106, respectively. Either of the pressing members 109*a* and 109*b* can be for pressing the image recording medium onto the transfer face of the transfer belt 108 so as to prevent the image recording medium from separating from the transfer face of the transfer belt 108. Thus, the image recording medium securely adheres to the transfer face.

A peeling device 110 is provided immediately downstream of the transfer belt 108 along the image recording medium transfer path. The peeling device 110 peels off the image recording medium, which has adhered to the transfer face of the transfer belt 108, from the transfer face to transfer the image recording medium toward the rightward image recording medium discharge unit 112.

Each of the four ink-jet heads 1 has, at its lower end, a head main body 1*a*. Each head main body 1*a* has a rectangular section. The head main bodies 1*a* are arranged close to each other with the longitudinal axis of each head main body 1*a* being perpendicular to the image recording medium transfer direction (perpendicular to FIG. 1). That is, this printer 101 is a line type printer. The bottom of each of the four head main bodies la faces the image recording medium transfer path. In the bottom of each head main body 1*a*, a number of nozzles are provided, each having a small-diameter ink ejection port. The four head main bodies 1*a* eject ink of magenta, yellow, cyan, and black, respectively. However, various other embodiments of the invention are not limited by the above described colors or order.

The head main bodies 1*a* are disposed such that a narrow clearance must be formed between the lower face of each head main body 1*a* and the transfer face of the transfer belt 108. The image recording medium transfer path is formed within the narrow clearance. In this construction, while an image recording medium that is being transferred by the transfer belt 108 passes immediately below the four head main bodies 1*a* in order, the inks are ejected through the corresponding nozzles toward the upper face, i.e., the print face, of the image recording medium to form a desired color image on the image recording medium.

The ink-jet printer 101 is provided with a maintenance unit 117 for automatically carrying out maintenance of the ink-jet heads 1. The maintenance unit 117 includes four caps 116 for covering the lower faces of the four head main bodies 1*a*, and a purge system (not shown).

During ink-jet printer 101 operation, the maintenance unit 117 is at a position immediately below the image recording medium feed unit 117 (withdrawal position). When a predetermined condition is satisfied after finishing the printing operation (for example, when a state in which no printing operation is performed continues for a predetermined time period or when the printer 101 is powered off), the maintenance unit 117 moves to a position (cap position) immediately below the four head main bodies 1*a*. At this cap position, the maintenance unit 117 covers the lower faces of the head main bodies 1*a* with the respective caps 116 to prevent ink in the nozzles from becoming dry.

The belt rollers 106 and 107 and the transfer belt 108 are supported by a chassis 113. The chassis 113 is put on a cylindrical member 115 disposed under the chassis 113. The cylindrical member 115 is rotatable around a shaft 114 provided at an off center position of the cylindrical member 115. Thus, by rotating the shaft 114, the level of the uppermost portion of the cylindrical member 115 can be changed to move up or down the chassis 113 accordingly. When the maintenance unit 117 is moved from the withdrawal position to the cap position, the cylindrical member 115 must have been rotated at a predetermined angle in advance so as to move down the transfer belt 108 and the belt rollers 106 and 107 by an applicable distance from the position illustrated in FIG. 1. A space for the movement of the maintenance unit 117 is thereby ensured.

In the region surrounded by the transfer belt 108, a nearly rectangular global change guide 121 (having its width substantially equal to that of the transfer belt 108) is disposed at an opposite position to the ink-jet heads 1. The guide 121 is in contact with the lower face of the upper part of the transfer belt 108 to support the upper part of the transfer belt 108 from the inside.

Figure 2:
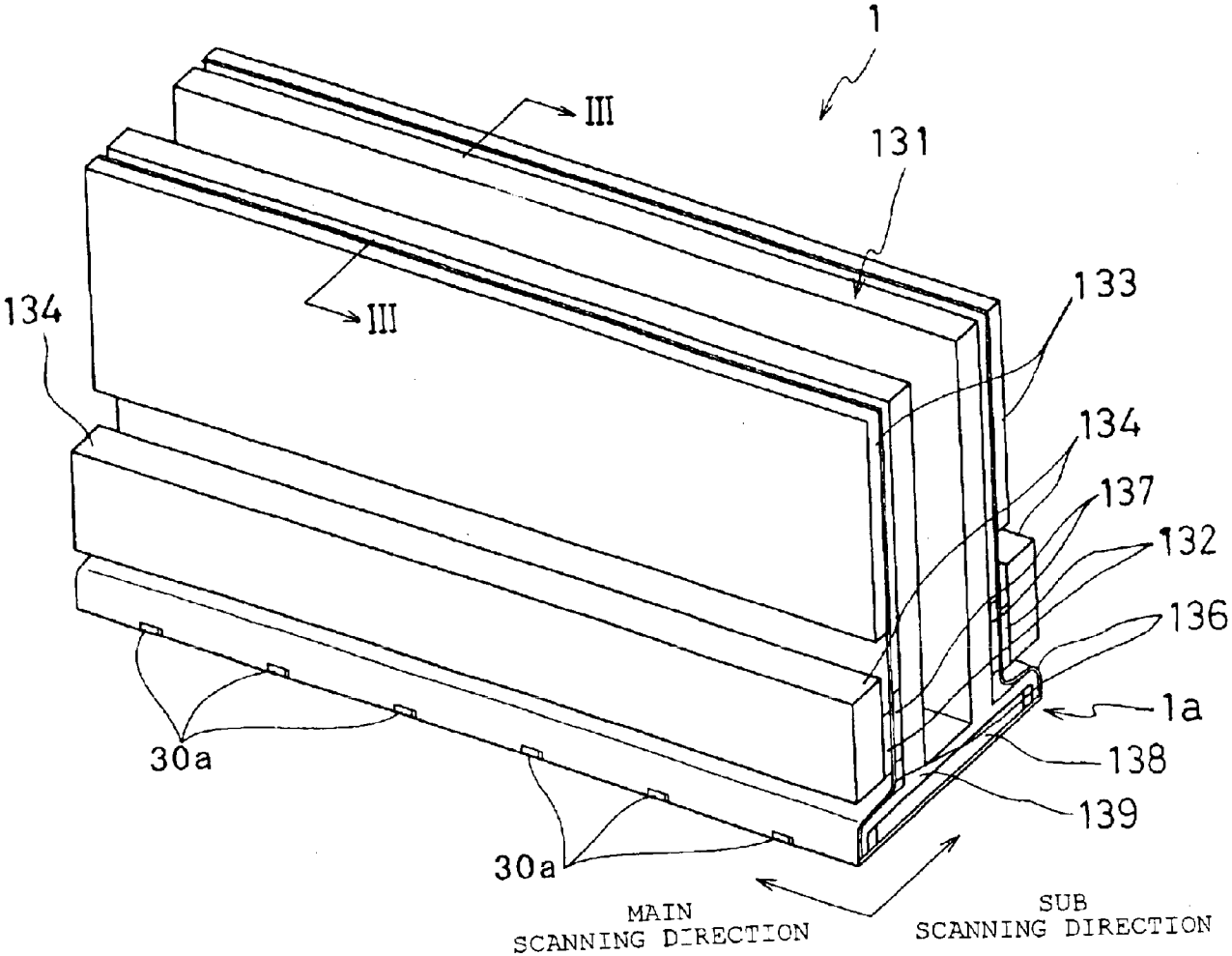
FIG. 2 is a perspective view of an ink-jet head according to a first embodiment of the invention.
Figure 3:
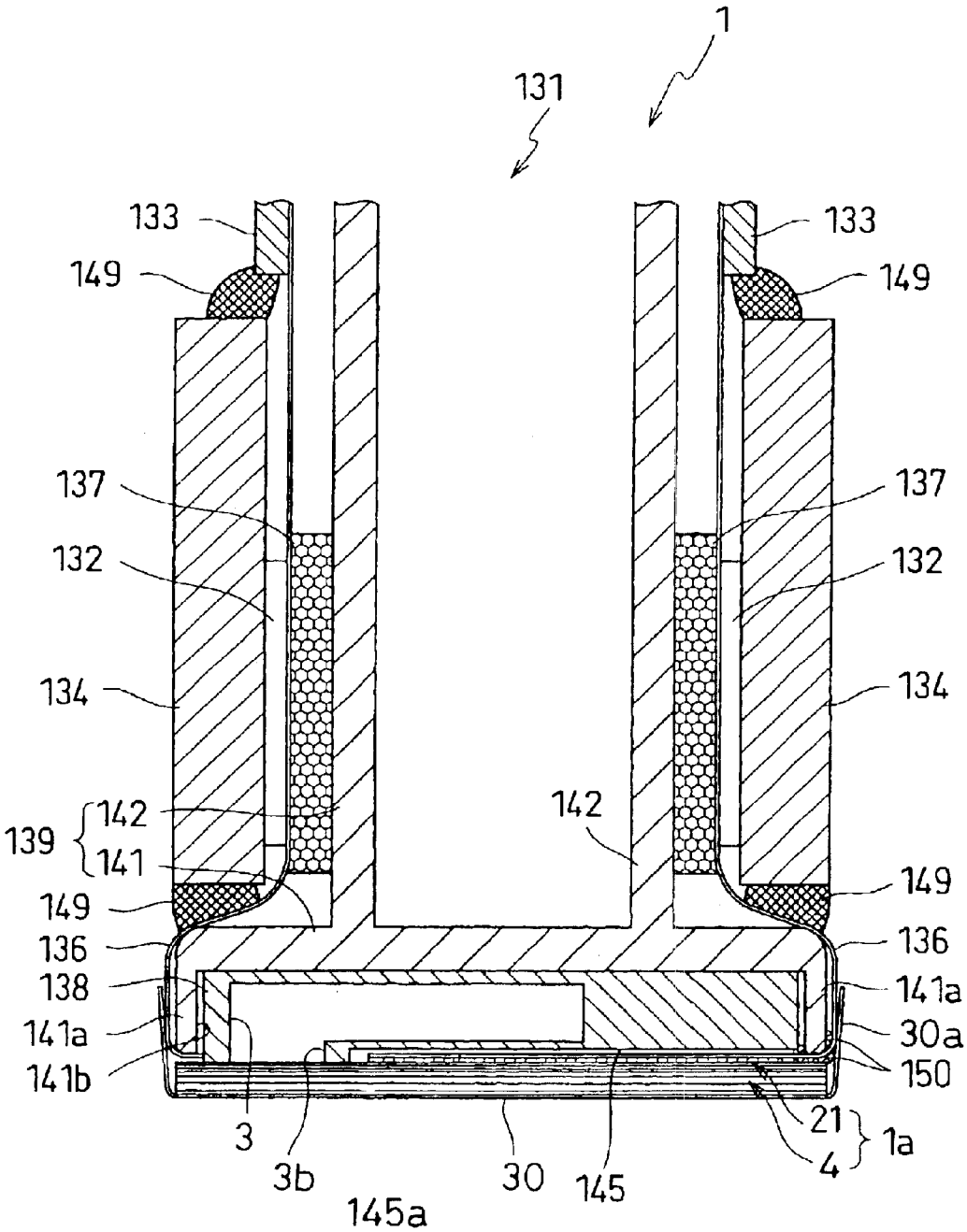
FIG. 3 is a sectional view taken along line III—III in FIG. 2.

With reference to FIGS. 2 and 3, the construction of each ink-jet head 1 according to this embodiment will be described in more detail. The ink-jet head 1 according to this embodiment includes a head main body 1*a* having a rectangular shape in a plan view and extending in a main scanning direction, and a base portion 131 for supporting the head main body 1*a*. The base portion 131 further supports driver ICs 132 for supplying driving signals to individual electrodes 35*a* and 35*b* (shown in FIG. 6 and FIG. 10), and substrates 133.

Referring to FIG. 2, the base portion 131 includes a base block 138 partially bonded to the upper face of the head main body 1*a* to support the head main body 1*a*, and a holder 139 bonded to the upper face of the base block 138 to support the base block 138. The base block 138 is a nearly rectangular member having substantially the same length of the head main body 1*a*. The base block 138 is made of metal material such as stainless steel and functions as a light structure for reinforcing the holder 139. The holder 139 includes a holder main body 141 disposed near the head main body 1*a*, and a pair of holder support portions 142 each extending on the opposite side of the holder main body 141 to the head main body 1*a*. Each holder support portion 142 is configured as a flat member. The holder support portions 142 extend along the longitudinal direction of the holder main body 141 and are disposed in parallel with each other at a predetermined interval.

Skirt portions 141*a* in a pair, protruding downward, are provided in both end portions of the holder main body 141*a* in a direction perpendicular to the main scanning direction. Each skirt portion 141*a* is formed through the length of the holder main body 141. As a result, in the lower portion of the holder main body 141, a nearly rectangular groove 141*b* is defined by the pair of skirt portions 141*a*. The base block 138 is received in the groove 141*b*. The upper surface of the base block 138 is bonded to the bottom of the groove 141*b* of the holder main body 141 with an adhesive. The thickness of the base block 138 is slightly larger than the depth of the groove 141*b* of the holder main body 141. As a result, the lower end of the base block 138 protrudes downward beyond the skirt portions 141*a*.

Within the base block 138, as a passage for ink to be supplied to the head main body 1*a*, an ink reservoir 3 is formed as a nearly rectangular space or hollow region extending along the longitudinal direction of the base block 138. Openings 3*b* (see FIG. 4) are formed in the lower face 145 of the base block 138, each communicating with the ink reservoir 3. The ink reservoir 3 is connected with a not-illustrated main ink tank or ink supply source through a supply tube (not shown) within the printer main body. Thus, the ink reservoir 3 is appropriately supplied with ink from the main ink tank.

In the lower face 145 of the base block 138, the surrounding of each opening 3*b* protrudes downward from the surrounding portion. The base block 138 is in contact with a passage unit 4 (see FIG. 3) of the head main body 1*a* at the only vicinity portion 145*a* of each opening 3*b* of the lower face 145. Thus, the region of the lower face 145 of the base block 138 other than the vicinity portion 145*a* of each opening 3*b* is distant from the head main body 1*a*. Actuator units 21 are disposed within the distance.

To the outer side face of each holder support portion 142 of the holder 139, a driver IC 132 is attached with an elastic member 137 such as a sponge being interposed between them. A heat sink 134 is disposed in close contact with the outer side face of the driver IC 132. The heat sink 134 is made of a nearly rectangular member for efficiently radiating heat generated in the driver IC 132. A flexible printed circuit (FPC) 136, which acts as a power supply member, is connected to the driver IC 132. The FPC 136 connected with the driver IC 132 is bonded to, and electrically connected with, the corresponding substrate 133 and the head main body 1*a* by soldering. The substrate 133 is disposed outside the FPC 136 above the driver IC 132 and the heat sink 134. The upper face of the heat sink 134 is bonded to the substrate 133 with a seal member 149. The lower face of the heat sink 134 is also bonded to the FPC 136 with a seal member 149.

A seal member 150 is disposed between the lower face of each skirt portion 141*a* of the holder main body 141 and the upper face of the passage unit 4, to sandwich the FPC 136. The FPC 136 is fixed to the passage unit 4 and the holder main body 141 by the seal member 150. Therefore, even if the head main body 1*a* is elongated, the head main body 1*a* can be prevented from bending, the interconnecting portion between each actuator unit and the FPC 136 can be prevented from being stressed, and the FPC 136 can be securely held in place.

Referring to FIG. 2, near each lower corner of the ink-jet head 1 along the main scanning direction, six protruding portions 30*a* are disposed at regular intervals along the corresponding side wall of the ink-jet head 1. These protruding portions 30*a* are provided at both ends in the sub scanning direction of a nozzle plate 30 in the lowermost layer of the head main body 1*a* (see FIGS. 7A and 7B). The nozzle plate 30 is bent by about 90 degrees along the boundary line between each protruding portion 30*a* and the other portion. The protruding portions 30*a* are provided at positions corresponding to the vicinities of both ends of various image recording mediums to be used for printing. Each bent portion of the nozzle plate 30 has a shape not right-angled but rounded. This configuration makes it difficult for an image recording medium to jam, which typically occurs in known devices because the leading edge of the image recording medium, which has been transferred to approach the head 1, is stopped by the side face of the head 1.

Figure 4:
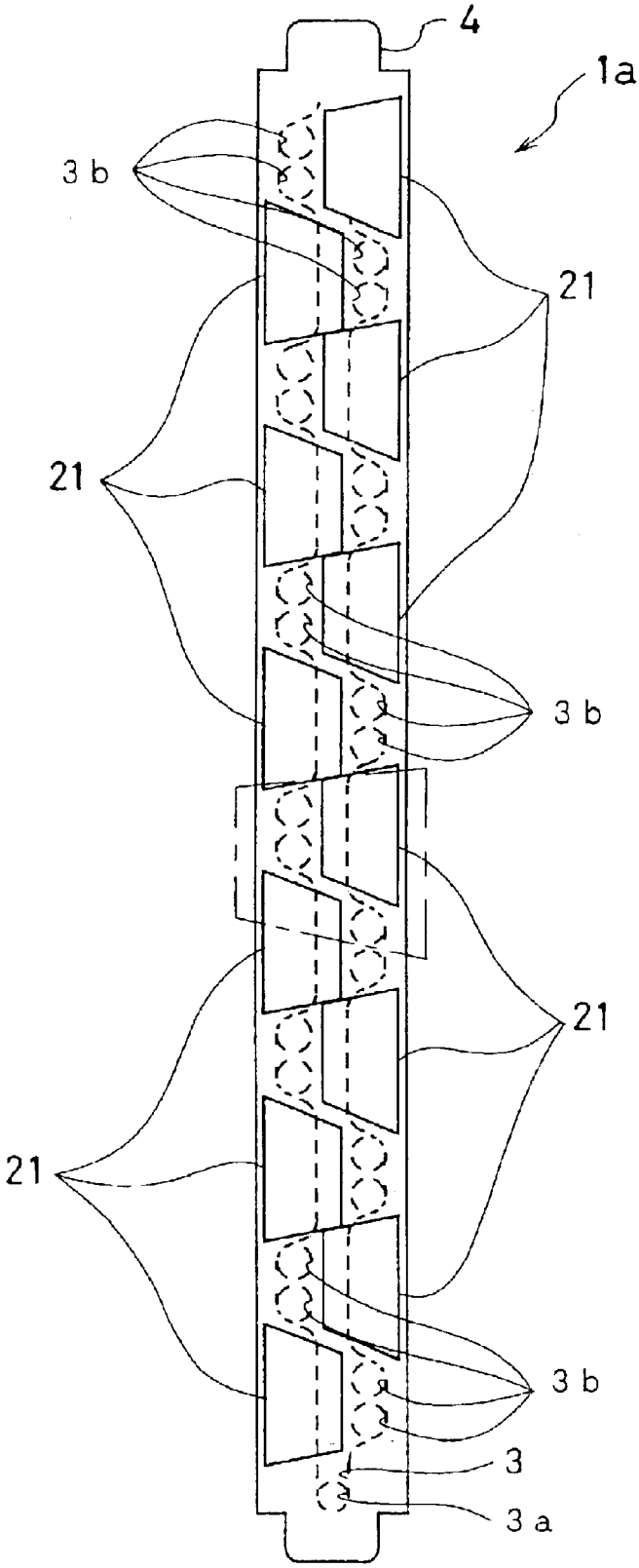
FIG. 4 is a plan view of a head main body included in the ink-jet head of FIG. 2.

FIG. 4 is a schematic plan view of the head main body 1*a*. In FIG. 4, an ink reservoir 3 formed in the base block 138 is conceptually illustrated with a broken line. Referring to FIG. 4, the head main body 1*a* has a rectangular shape in the plan view extending in the main scanning direction. The head main body 1*a* includes a passage unit 4 in which a large number of pressure chambers 10 and a large number of ink ejection ports 8 at the front ends of nozzles (see FIGS. 5, 6, and 7), are formed as described later. Trapezoidal actuator units 21 arranged in two lines in a crisscross manner are bonded onto the upper face of the passage unit 4. Each actuator unit 21 is disposed such that its parallel opposed sides (upper and lower sides) extend along the longitudinal direction of the passage unit 4. The oblique sides of each neighboring actuator units 21 overlap each other in the lateral direction of the passage unit 4.

The lower face of the passage unit 4 corresponding to the bonded region of each actuator unit 4 is made into an ink ejection region. In the surface of each ink ejection region, a large number of ink ejection ports 8 are arranged in a matrix, as described later. In the base block 138 disposed above the passage unit 4, an ink reservoir 3 is formed along the longitudinal direction of the base block 138. The ink reservoir 3 communicates with an ink tank (not shown) through an opening 3*a* provided at one end of the ink reservoir 3, so that the ink reservoir 3 is always filled up with ink. In the ink reservoir 3, pairs of openings 3*b* are provided in regions where no actuator unit 21 is present, so as to be arranged in a crisscross manner along the longitudinal direction of the ink reservoir 3.

Figure 5:
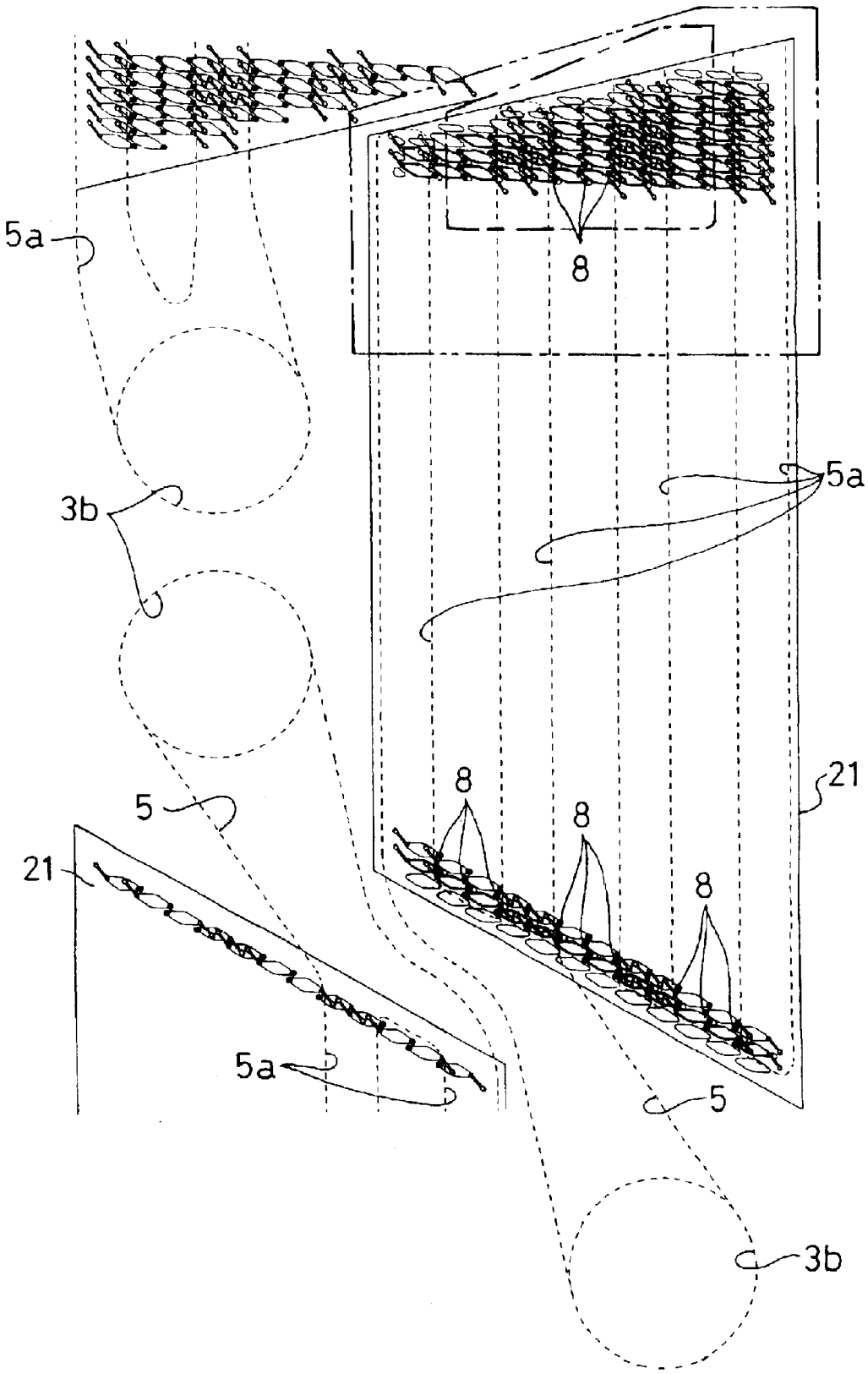
FIG. 5 is an enlarged view of the region enclosed with an alternate long and short dash line in FIG. 4.

FIG. 5 is an enlarged view of the region enclosed with an alternate long and short dash line in FIG. 4. Referring to FIGS. 4 and 5, the ink reservoir 3 communicates through each opening 3*b* with a manifold channel 5 disposed under the opening 3*b*. Each opening 3*b* is provided with a filter (not shown) for catching dust and dirt contained in ink. The front end portion of each manifold channel 5 branches into two sub-manifold channels 5*a*. Below each single actuator unit 21, two sub-manifold channels 5*a* extend from each of the two openings 3*b* on both sides of the actuator unit 21 in the longitudinal direction of the ink-jet head 1. That is, below the single actuator unit 21, four sub-manifold channels 5*a* in total extend along the longitudinal direction of the ink-jet head 1. Each sub-manifold channel 5*a* is filled up with ink supplied from the ink reservoir 3.

Figure 6:
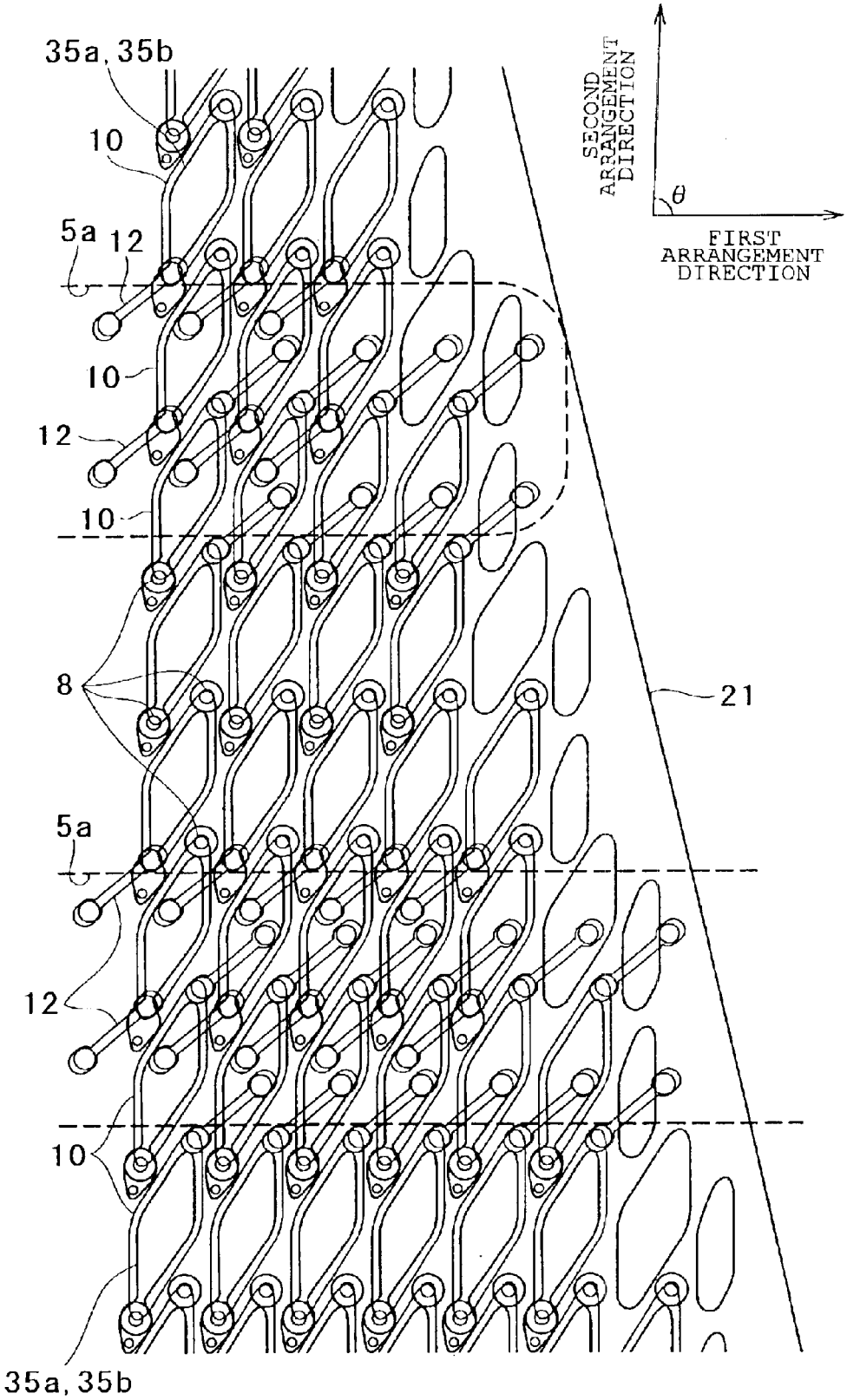
FIG. 6 is an enlarged view of the region enclosed with an alternate long and short dash line in FIG. 5.

FIG. 6 is an enlarged view of the region enclosed with an alternate long and short dash line in FIG. 5. Referring to FIGS. 5 and 6, on the upper face of each actuator unit 21, individual electrodes 35*a*, each having a nearly rhombic shape in a plan view, are regularly arranged in a matrix. In addition, individual electrodes 35*b* having the same shape as the individual electrodes 35*a* are disposed in the actuator unit 21 to vertically overlap the respective individual electrodes 35*a*. A large number of ink ejection ports 8 are regularly arranged in a matrix in the surface of the ink ejection region corresponding to the actuator unit 21 of the passage unit 4. In the passage unit 4, pressure chambers (cavities) 10, each having a nearly rhombic shape in a plan view but somewhat larger than that of the individual electrodes 35*a* and 35*b*, are regularly arranged in a matrix. In the passage unit 4, apertures 12 are also regularly arranged in a matrix. These pressure chambers 10 and apertures 12 communicate with the corresponding ink ejection ports 8. The pressure chambers 10 are provided at positions corresponding to the respective individual electrodes 35*a* and 35*b*. In a plan view, the large part of the individual electrode 35*a* and 35*b* is included in a region of the corresponding pressure chamber 10. In FIGS. 5 and 6, for ease of understanding, the pressure chambers 10, the apertures 12, etc., are illustrated with solid lines, although they should be illustrated with broken lines because they are within the actuator unit 21 or the passage unit 4.

Figure 7:
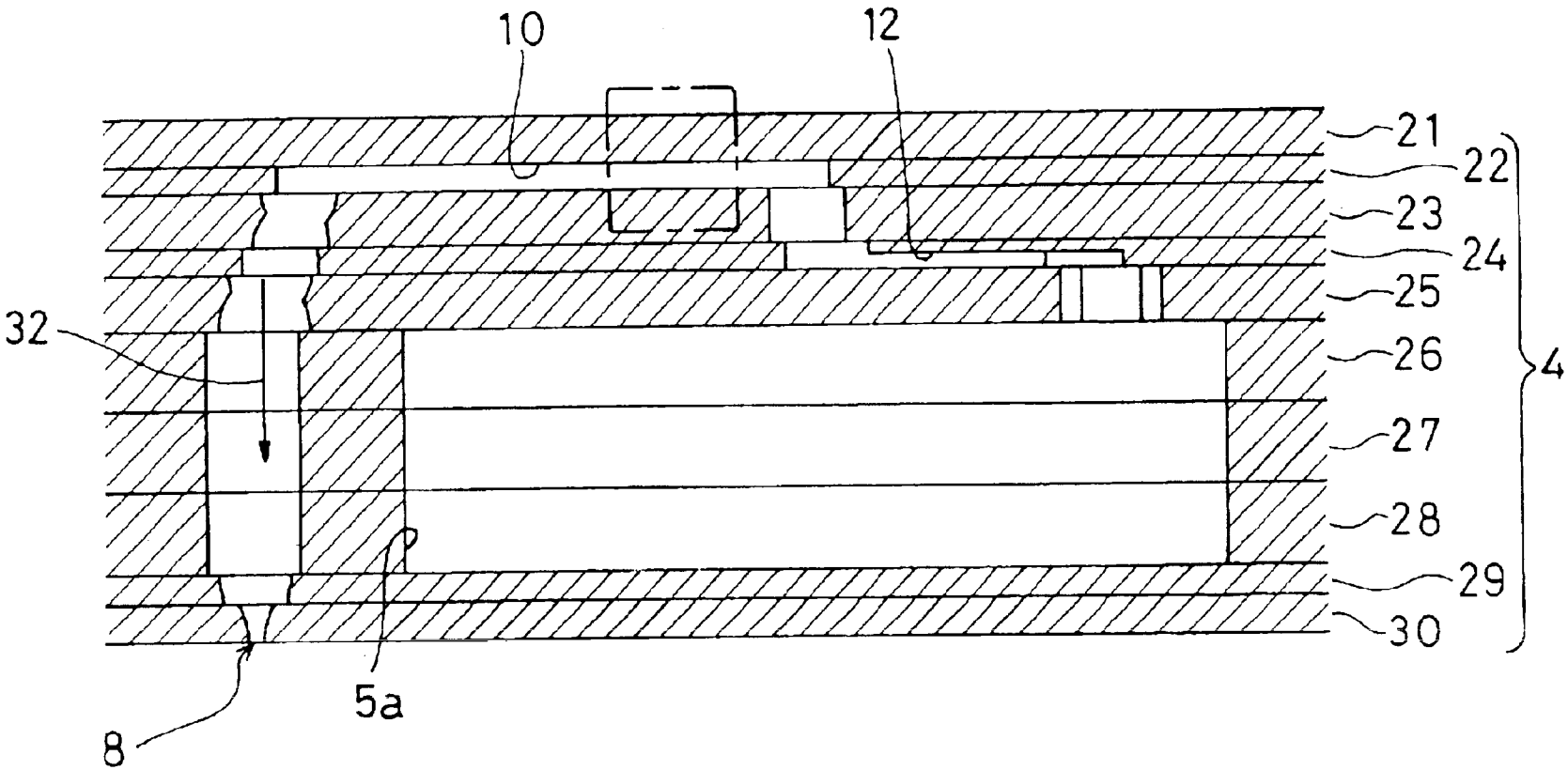
FIG. 7 is a partial sectional view of the head main body of FIG. 4.

FIG. 7 is a partial sectional view of the head main body 1*a* of FIG. 4 along the longitudinal direction of a pressure chamber. As shown in FIG. 7, each ink ejection port 8 is formed at the front end of a tapered nozzle. Each ink ejection port 8 communicates with a sub-manifold channel 5*a* through a pressure chamber 10 (length: 900 μm, width: 350 μm) and an aperture 12. Thus, within the ink-jet head 1, ink passages 32, each extending from an ink tank to an ink ejection port 8 through an ink reservoir 3, a manifold channel 5, a sub-manifold channel 5*a*, an aperture 12, and a pressure chamber 10 are formed.

Referring to FIG. 7, the pressure chamber 10 and the aperture 12 are provided at different levels. Therefore, in the portion of the passage unit 4 corresponding to the ink ejection region under an actuator unit 21, an aperture 12 communicating with one pressure chamber 10 can be disposed within the same portion in plan view as a pressure chamber 10 neighboring the pressure chamber 10 communicating with the aperture 12. As a result, because the pressure chambers 10 can be arranged close to each other at a high density, high resolution image printing can be achieved with an ink-jet head 1 having a relatively small work area.

In the plane of FIGS. 5 and 6, pressure chambers 10 are arranged within an ink ejection region in two directions, i.e., a direction along the longitudinal direction of the ink-jet head 1 (first arrangement direction) and a direction somewhat inclining from the lateral direction of the ink-jet head 1 (second arrangement direction). The first and second arrangement directions form an angle theta θ somewhat smaller than the right angle. The ink ejection ports 8 are arranged at 50 dpi in the first arrangement direction. On the other hand, the pressure chambers 10 are arranged in the second arrangement direction such that the ink ejection region corresponding to one actuator unit 21 include twelve pressure chambers 10. Therefore, within the whole width of the ink-jet head 1, in a region of the interval between two ink ejection ports 8 neighboring each other in the first arrangement direction, there are twelve ink ejection ports 8. At both ends of each ink ejection region in the first arrangement direction (corresponding to an oblique side of the actuator unit 21), the above condition is satisfied by making a compensation relation to the ink ejection region corresponding to the opposite actuator unit 21 in the lateral direction of the ink-jet head 1. Therefore, in the ink-jet head 1, by ejecting ink droplets in order through a large number of ink ejection ports 8 arranged in the first and second directions with relative movement of an image recording medium along the lateral direction of the ink-jet head 1, printing at 600 dpi in the main scanning direction can be performed.

Figure 8:
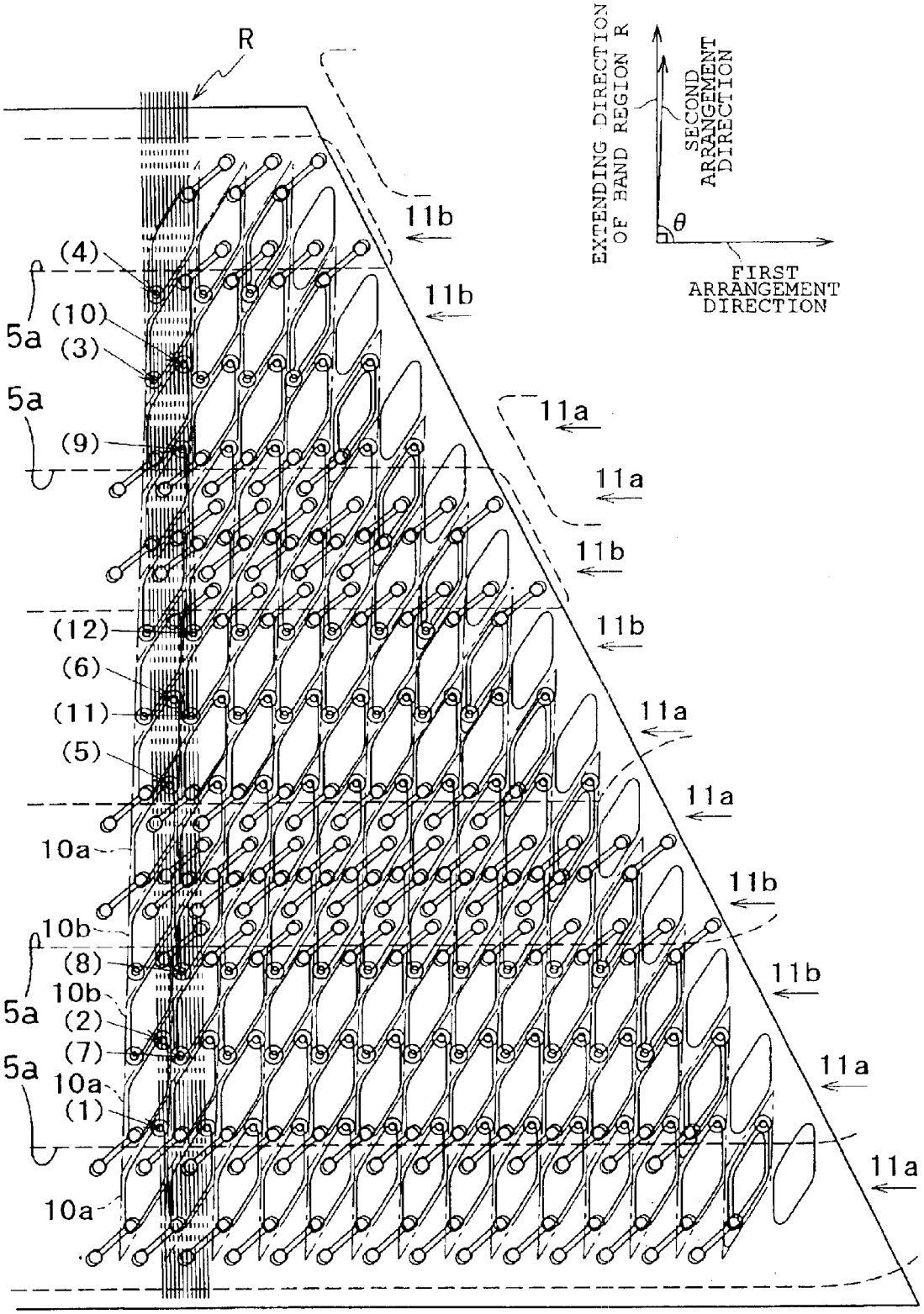
FIG. 8 is an enlarged view of the region enclosed with an alternate long and two short dashes line in FIG. 5.

Next, the construction of the passage unit 4 will be described in more detail with reference to FIG. 8. FIG. 8 is a schematic view showing the positional relation among each pressure chamber 10, each ink ejection port 8, and each aperture (restricted passage) 12. Referring to FIG. 8, pressure chambers 10 are arranged in lines in the first arrangement direction at predetermined intervals at 50 dpi. Twelve lines of pressure chambers 10 are arranged in the second arrangement direction. As the whole, the pressure chambers 10 are two-dimensionally arranged in the ink ejection region corresponding to one actuator unit 21.

The pressure chambers 10 are classified into two types, i.e., pressure chambers 10*a*, in each of which a nozzle is connected with the upper acute portion in FIG. 8, and pressure chambers 10*b*, in each of which a nozzle is connected with the lower acute portion. Pressure chambers 10*a* and 10*b* are arranged in the first arrangement direction to form pressure chamber lines 11*a* and 11*b*, respectively. Referring to FIG. 8, in the ink ejection region corresponding to one actuator unit 21, from the lower side of FIG. 8, there are disposed two pressure chamber lines 11*a* and two pressure chamber lines 11*b* neighboring the upper side of the pressure chamber lines 11*a*. The four pressure chamber lines of the two pressure chamber lines 11*a* and the two pressure chamber lines 11*b* constitute a set of pressure chamber lines. Such a set of pressure chamber lines is repeatedly disposed three times from the lower side in the ink ejection region corresponding to one actuator unit 21. A straight line extending through the upper acute portion of each pressure chamber in each pressure chamber lines 11*a* and 11*b* crosses the lower oblique side of each pressure chamber in the pressure chamber line neighboring the upper side of that pressure chamber line.

As described above, when viewing perpendicularly to FIG. 8, two first pressure chamber lines 11*a* and two pressure chamber lines 11*b*, in which nozzles connected with pressure chambers 10 are disposed at different positions, are arranged alternately to neighbor each other. Consequently, as the whole, the pressure chambers 10 are arranged regularly. On the other hand, nozzles are arranged in a concentrated manner in a central region of each set of pressure chamber lines constituted by the above four pressure chamber lines. Therefore, in case that each four pressure chamber lines constitute a set of pressure chamber lines and such a set of pressure chamber lines is repeatedly disposed three times from the lower side as described above, there is formed a region where no nozzle exists, in the vicinity of the boundary between each neighboring sets of pressure chamber lines, i.e., on both sides of each set of pressure chamber lines constituted by four pressure chamber lines. Wide sub-manifold channels 5*a* extend there for supplying ink to the corresponding pressure chambers 10. In this ink-jet head, in the ink ejection region corresponding to one actuator unit 21, four wide sub-manifold channels 5*a* in total are arranged in the first arrangement direction, i.e., one on the lower side of FIG. 8, one between the lowermost set of pressure chamber lines and the second lowermost set of pressure chamber lines, and two on both sides of the uppermost set of pressure chamber lines.

Referring to FIG. 8, nozzles communicating with ink ejection ports 8 for ejecting ink are arranged in the first arrangement direction at regular intervals at 50 dpi to correspond to the respective pressure chambers 10 regularly arranged in the first arrangement direction. On the other hand, while twelve pressure chambers 10 are regularly arranged also in the second arrangement direction forming an angle θ with the first arrangement direction, twelve nozzles corresponding to the twelve pressure chambers 10 include ones each communicating with the upper acute portion of the corresponding pressure chamber 10 and ones each communicating with the lower acute portion of the corresponding pressure chamber 10, as a result, they are not regularly arranged in the second arrangement direction at regular intervals.

If all nozzles communicate with the same-side acute portions of the respective pressure chambers 10, the nozzles are regularly arranged also in the second arrangement direction at regular intervals. In this case, nozzles are arranged so as to shift in the first arrangement direction by a distance corresponding to 600 dpi printing resolution per pressure chamber line from the lower side to the upper side of FIG. 8. Contrastively in this ink-jet head, because four pressure chamber lines of two pressure chamber lines 11*a* and two pressure chamber lines 11*b* constitute a set of pressure chamber lines and such a set of pressure chamber lines is repeatedly disposed three times from the lower side, the shift of nozzle position in the first arrangement direction per pressure chamber line from the lower side to the upper side of FIG. 8 is not always the same.

In the ink-jet head 1, a band region R will be discussed that has a width (about 508.0 μm) corresponding to 50 dpi in the first arrangement direction and extends perpendicularly to the first arrangement direction. In this band region R, any of twelve pressure chamber lines includes only one nozzle. That is, when such a band region R is defined at an optional position in the ink ejection region corresponding to one actuator unit 21, twelve nozzles are always distributed in the band region R. The positions of points respectively obtained by projecting the twelve nozzles onto a straight line extending in the first arrangement direction are distant from each other by a distance corresponding to a 600 dpi printing resolution.

When the twelve nozzles included in one band region R are denoted by (1) to (12) in order from one whose projected image onto a straight line extending in the first arrangement direction is the leftmost, the twelve nozzles are arranged in the order of (1), (7), (2), (8), (5), (11), (6), (12), (9), (3), (10), and (4) from the lower side.

In the thus-constructed ink-jet head 1, by properly driving active layers in the actuator unit 21, a character, an figure, or the like, having a resolution of 600 dpi can be formed. That is, by selectively driving active layers corresponding to the twelve pressure chamber lines in order in accordance with the transfer of a print medium, a specific character or figure can be printed on the image recording medium.

By way of example, a case will be described wherein a straight line extending in the first arrangement direction is printed at a resolution of 600 dpi. First, a case will be briefly described wherein nozzles communicate with the same-side acute portions of pressure chambers 10. In this case, in accordance with transfer of an image recording medium, ink ejection starts from a nozzle in the lowermost pressure chamber line in FIG. 8. Ink ejection is then shifted upward with selecting a nozzle belonging to the upper neighboring pressure chamber line in order. Ink dots are thereby formed in order in the first arrangement direction with neighboring each other at 600 dpi. Finally, all the ink dots form a straight line extending in the first arrangement direction at a resolution of 600 dpi.

On the other hand, in this ink-jet head, ink ejection starts from a nozzle in the lowermost pressure chamber line 11*a* in FIG. 8, and ink ejection is then shifted upward with selecting a nozzle communicating with the upper neighboring pressure chamber line in order in accordance with transfer of a print medium. In this embodiment, however, because the positional shift of nozzles in the first arrangement direction per pressure chamber line from the lower side to the upper side is not always the same, ink dots formed in order in the first arrangement direction in accordance with the transfer of the print medium are not arranged at regular intervals at 600 dpi.

More specifically, as shown in FIG. 8, in accordance with the transfer of the print medium, ink is first ejected through a nozzle (1) communicating with the lowermost pressure chamber line 11*a* in FIG. 8 to form a dot row on the print medium at intervals corresponding to 50 dpi (about 508.0 μm). Next, as the print medium is transferred and the straight line formation position has reached the position of a nozzle (7) communicating with the second lowermost pressure chamber line 11*a*, ink is ejected through the nozzle (7). The second ink dot is thereby formed at a position shifted from the first formed dot position in the first arrangement direction by a distance of six times the interval corresponding to 600 dpi (about 42.3 μm) (about 42.3 μm×6=about 254.0 μm).

Next, as the print medium is further transferred and the straight line formation position has reached the position of a nozzle (2) communicating with the third lowermost pressure chamber line 11*b*, ink is ejected through the nozzle (2). The third ink dot is thereby formed at a position shifted from the first formed dot position in the first arrangement direction by a distance of the interval corresponding to 600 dpi (about 42.3 μm). As the print medium is further transferred and the straight line formation position has reached the position of a nozzle (8) communicating with the fourth lowermost pressure chamber line 11*b*, ink is ejected through the nozzle (8). The fourth ink dot is thereby formed at a position shifted from the first formed dot position in the first arrangement direction by a distance of seven times the interval corresponding to 600 dpi (about 42.3 μm) (about 42.3 μm×7=about 296.3 μm). As the print medium is further transferred and the straight line formation position has reached the position of a nozzle (5) communicating with the fifth lowermost pressure chamber line 11*a*, ink is ejected through the nozzle (5). The fifth ink dot is thereby formed at a position shifted from the first formed dot position in the first arrangement direction by a distance of four times the interval corresponding to 600 dpi (about 42.3 μm) (about 42.3 μm×4=about 169.3 μm).

After this, in the same manner, ink dots are formed with selecting nozzles communicating with pressure chambers 10 in order from the lower side to the upper side in FIG. 8. In this case, when the number of a nozzle in FIG. 8 is N, an ink dot is formed at a position shifted from the first formed dot position in the first arrangement direction by a distance corresponding to (magnification n=N−1)×(interval corresponding to 600 dpi). When the twelve nozzles have been finally selected, the gap between the ink dots to be formed by the nozzles (1) in the lowermost pressure chamber lines 11*a* in FIG. 8 at an interval corresponding to 50 dpi (about 508.0 μm) is filled up with eleven dots formed at intervals corresponding to 600 dpi (about 42.3 μm). Therefore, as the whole, a straight line extending in the first arrangement direction can be drawn at a resolution of 600 dpi.

Figure 9:
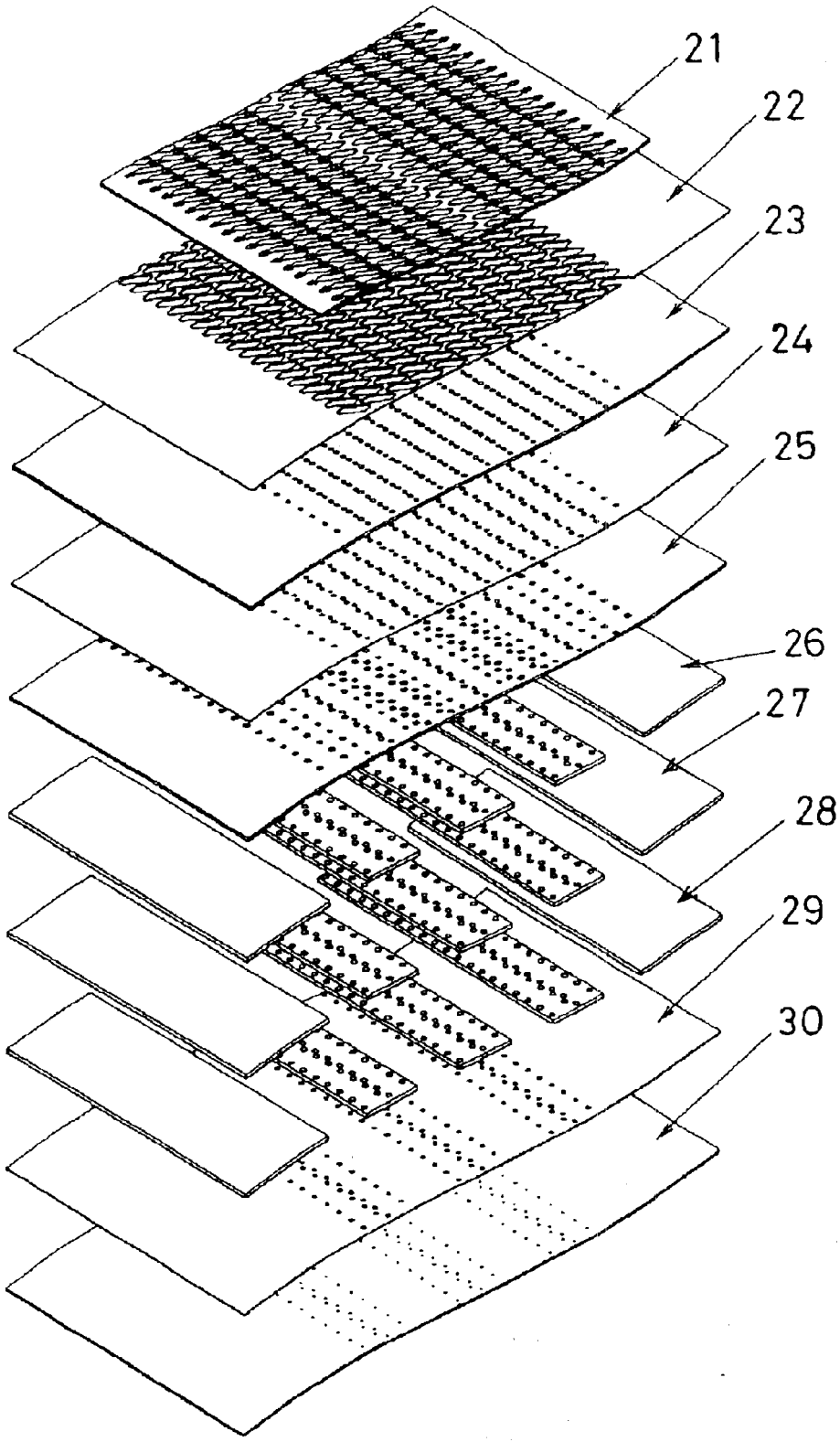
FIG. 9 is a partial exploded view of the head main body of FIG. 4.
Figure 10:
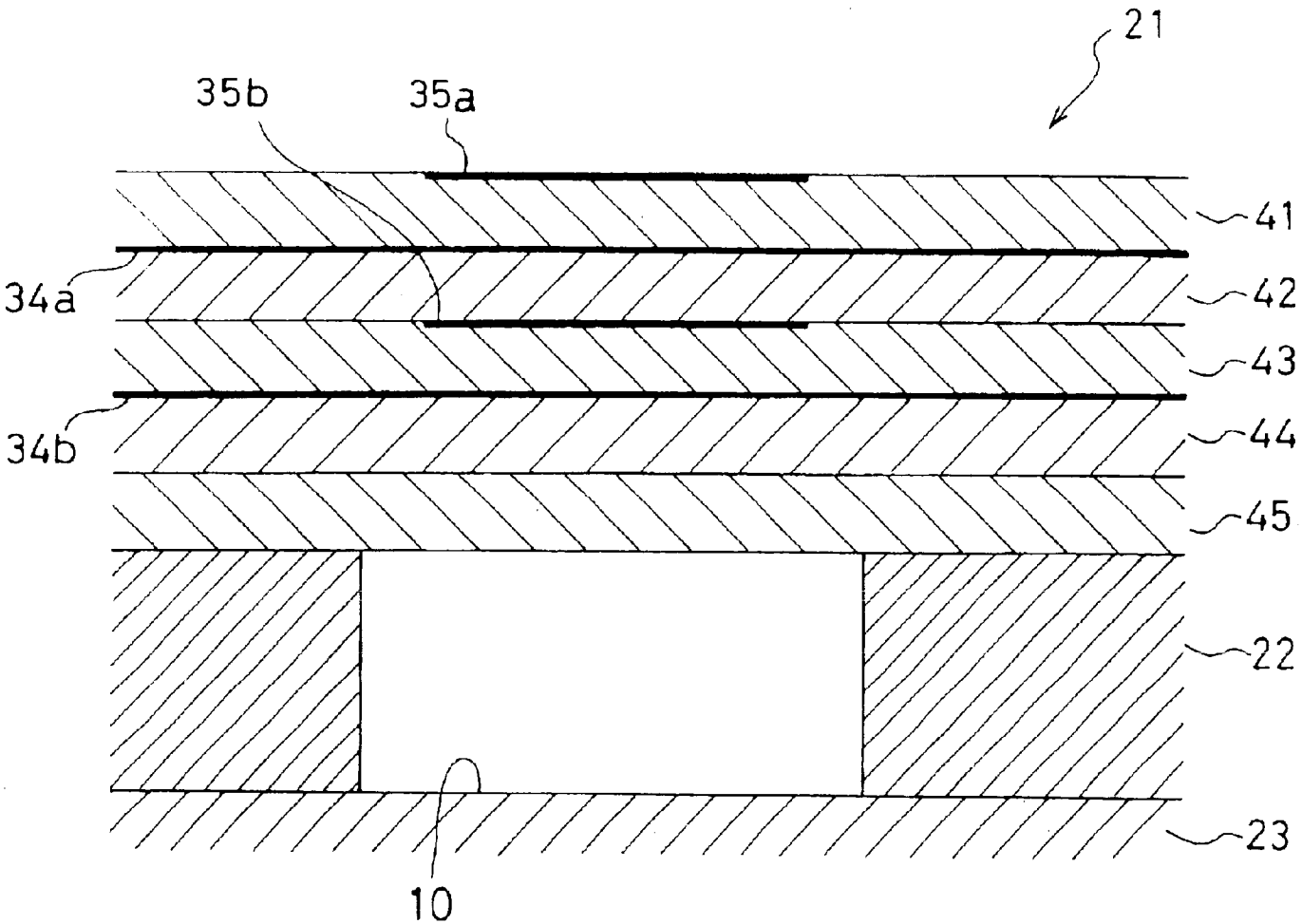
FIG. 10 is an enlarged sectional view when laterally viewing the region enclosed with an alternate long and short dash line in FIG. 7.

Next, the sectional construction of the ink-jet head 1 will be described. FIG. 9 is a partial exploded view of the head main body 1*a* of FIG. 4. FIG. 10 is an enlarged sectional view when laterally viewing the region enclosed with an alternate long and short dash line in FIG. 7. Referring to FIGS. 7 and 9, a principal portion on the bottom side of the ink-jet head 1 has a layered structure laminated with ten sheet materials in total, i.e., from the top, an actuator unit 21, a cavity plate 22, a base plate 23, an aperture plate 24, a supply plate 25, manifold plates 26, 27, and 28, a cover plate 29, and a nozzle plate 30. Of them, nine plates other than the actuator unit 21 constitute a passage unit 4.

As described later in detail, the actuator unit 21 is laminated with five piezoelectric sheets 41 to 45 (see FIG. 10) and is provided with electrodes so that only the uppermost layer and the second layer neighboring the uppermost layer include portions to be active when an electric field is applied (hereinafter, simply referred to as "layer including active layers (active portions)") and the remaining three layers are inactive. The cavity plate 22 is made of metal, in which a large number of substantially rhombic openings are formed corresponding to the respective pressure chambers 10. The base plate 23 is made of metal, in which a communication hole between each pressure chamber 10 of the cavity plate 22 and the corresponding aperture 12, and a communication hole between the pressure chamber 10 and the corresponding ink ejection port 8 are formed. The aperture plate 24 is made of metal, in which, in addition to apertures 12, communication holes are formed for connecting each pressure chamber 10 of the cavity plate 22 with the corresponding ink ejection port 8. The supply plate 25 is made of metal, in which communication holes between each aperture 12 and the corresponding sub-manifold channel 5*a* and communication holes for connecting each pressure chamber 10 of the cavity plate 22 with the corresponding ink ejection port 8 are formed. Each of the manifold plates 26, 27, and 28 is made of metal, which defines an upper portion of each sub-manifold channel 5*a* and in which communication holes are formed for connecting each pressure chamber 10 of the cavity plate 22 with the corresponding ink ejection port 8. The cover plate 29 is made of metal, in which communication holes are formed for connecting each pressure chamber 10 of the cavity plate 22 with the corresponding ink ejection port 8. The nozzle plate 30 is made of metal, in which tapered ink ejection ports 8 each functioning as a nozzle are formed for the respective pressure chambers 10 of the cavity plate 22.

Sheets 21 to 30 are positioned in layers with each other to form such an ink passage 32 as illustrated in FIG. 6. The ink passage 32 first extends upward from the sub-manifold channel 5*a*, then extends horizontally in the aperture 12, then further extends upward, then again extends horizontally in the pressure chamber 10, then extends obliquely downward in a certain length away from the aperture 12, and then extends vertically downward toward the ink ejection port 8.

Referring to FIG. 10, the actuator unit 21 includes five piezoelectric sheets 41, 42, 43, 44, and 45 having the same thickness of about 15 $\mu$m. These piezoelectric sheets 41 to 45 are made into a continuous layered flat plate (continuous flat layers) that is disposed so as to extend over many pressure chambers 10 formed within one ink ejection region in the ink-jet head 1. Because the piezoelectric sheets 41 to 45 are disposed so as to extend over many pressure chambers 10 as continuous flat layers, the individual electrodes 35*a* and 35*b* can also be arranged at a high density by using, e.g., a screen printing technique. Therefore, the pressure chambers 10 formed at positions corresponding to the individual electrodes 35*a* and 35*b* can also be arranged at a high density. This makes it possible to print a high-resolution image. In this embodiment, each of the piezoelectric sheets 41 to 45 is made of a lead zirconate titanate (PZT)-base ceramic material having ferroelectricity.

Between the uppermost piezoelectric sheet 41 and the piezoelectric sheet 42 neighboring downward the piezoelectric sheet 41, an about 2 micron-thick common electrode 34*a* is interposed formed on the whole of the lower and upper faces of the piezoelectric sheets. Also, between the piezoelectric sheet 43 neighboring downward the piezoelectric sheet 42 and the piezoelectric sheet 44 neighboring downward the piezoelectric sheet 43, an about 2 $\mu$m-thick common electrode 34*b* is interposed formed like the common electrode 34*a*. On the upper face of the piezoelectric sheet 41, an about 1 $\mu$m-thick individual electrode 35*a* is formed to correspond to each pressure chamber 10 (see FIG. 6). The individual electrode 35*a* has a similar shape (length: 850 $\mu$m, width: 250 $\mu$m) to that of the pressure chamber 10 in a plan view, so that a projection image of the individual electrode 35*a* projected along the thickness direction of the individual electrode 35*a* is included in the corresponding pressure chamber 10. Further, between the piezoelectric sheets 42 and 43, an about 2 micron-thick individual electrode 35*b* is interposed formed like the individual electrode 35*a*. No electrode is provided between the piezoelectric sheet 44 neighboring downward the piezoelectric sheet 43 and the piezoelectric sheet 45 neighboring downward the piezoelectric sheet 44, and on the lower face of the piezoelectric sheet 45. Each of the electrodes 34*a*, 34*b*, 35*a*, and 35*b* is made of, e.g., a silver-palladium (Ag—Pd)-base metallic material.

The common electrodes 34*a* and 34*b* are grounded in a region (not shown). Thus, the common electrodes 34*a* and 34*b* are kept at the ground potential at a region corresponding to any pressure chamber 10. The individual electrodes 35*a* and 35*b* in each pair corresponding to a pressure chamber 10 are in contact with leads (not shown) wired within the FPC 136 independently of another pair of individual electrodes so that the potential of each pair of individual electrodes can be controlled independently of that of another pair. The individual electrodes 35*a* and 35*b* are connected to the driver IC 132 through the leads. In this case, the individual electrodes 35*a* and 35*b* in each pair vertically arranged may be connected to the driver IC 132 through the same lead. In a modification, many pairs of common electrodes 34*a* and 34*b* each having a shape larger than that of a pressure chamber 10 so that the projection image of each common electrode projected along the thickness direction of the common electrode may include the pressure chamber, may be provided for each pressure chamber 10. In another modification, many pairs of common electrodes 34*a* and 34*b* each having a shape somewhat smaller than that of a pressure chamber 10 so that the projection image of each common electrode projected along the thickness direction of the common electrode may be included in the pressure chamber, may be provided for each pressure chamber 10. Thus, the common electrode 34*a* or 34*b* may not always be a single conductive sheet formed on the whole of the face of a piezoelectric sheet. In the above modifications, however, all the common electrodes must be electrically connected with one another so that the portion corresponding to any pressure chamber 10 may be at the same potential.

In the ink-jet head 1, the piezoelectric sheets 41 to 45 are polarized in their thickness direction. That is, the actuator unit 21 has a so-called unimorph structure in which the upper (i.e., distant from the pressure chamber 10) three piezoelectric sheets 41 to 43 are layers wherein active layers are present, and the lower (i.e., near the pressure chamber 10) two piezoelectric sheets 44 and 45 are made into inactive layers. Therefore, when the individual electrodes 35*a* and 35*b* in a pair are set at a positive or negative predetermined potential, if the polarization is in the same direction as the electric field for example, the electric field-applied portion in the piezoelectric sheets 41 to 43 sandwiched by the common and individual electrodes works as an active layer (pressure generation portion) and contracts perpendicularly to the polarization by the transversal piezoelectric effect. On the other hand, because the piezoelectric sheets 44 and 45 are not influenced by an electric field, they do not contract in themselves. Thus, a difference in strain perpendicular to the polarization is produced between the upper piezoelectric sheets 41 to 43 and the lower piezoelectric sheets 44 and 45. As a result, the whole of the piezoelectric sheets 41 to 45 is ready to deform into a convex shape toward the inactive side (unimorph deformation). At this time, as illustrated in FIG. 10, the lowermost face of the piezoelectric sheets 41 to 45 is fixed to the upper face of the partition (the cavity plate) 22 partitioning pressure chambers, as a result, the piezoelectric sheets 41 to 45 deform into a convex shape toward the pressure chamber side. Therefore, the volume of the pressure chamber 10 is decreased to raise the pressure of ink. The ink is thereby ejected through the ink ejection port 8. After this, when the individual electrodes 35*a* and 35*b* are returned to the same potential as that of the common electrodes 34*a* and 34*b*, the piezoelectric sheets 41 to 45 return to the original shape and the pressure chamber 10 also returns to its original volume. Thus, the pressure chamber 10 draws ink through the manifold channel 5.

In another driving method, all the individual electrodes 35*a* and 35*b* are set in advance at a different potential from that of the common electrodes 34*a* and 34*b*. When an ejecting request is issued, the corresponding pair of individual electrodes 35*a* and 35*b* is once set at the same potential as that of the common electrodes 34*a* and 34*b*. After this, at a predetermined timing, the pair of individual electrodes 35*a* and 35*b* is again set at a potential different from that of the common electrodes 34*a* and 34*b*. In this case, at the timing when the pair of individual electrodes 35*a* and 35*b* is set at the same potential as that of the common electrodes 34*a* and 34*b*, the piezoelectric sheets 41 to 45 return to their original shapes. The corresponding pressure chamber 10 is thereby increased in volume from its initial state (the state that the potentials of both electrodes differ from each other), to draw ink from the manifold channel 5 into the pressure chamber 10. After this, at the timing when the pair of individual electrodes 35*a* and 35*b* is again set at the different potential from that of the common electrodes 34*a* and 34*b*, the piezoelectric sheets 41 to 45 deform into a convex shape toward the pressure chamber 10. The volume of the pressure chamber 10 is thereby decreased and the pressure of ink in the pressure chamber 10 increases to eject the ink.

On the other hand, in case where the polarization occurs in the reverse direction to the electric field applied to the piezoelectric sheets 41 to 43, the active layers in the piezoelectric sheets 41 and 42 sandwiched by the individual electrodes 35*a* and 35*b* and the common electrodes 34*a* and 34*b* are ready to elongate perpendicularly to the polarization by the transversal piezoelectric effect. As a result, the piezoelectric sheets 41 to 45 deform into a concave shape toward the pressure chamber 10. Therefore, the volume of the pressure chamber 10 is increased to draw ink from the manifold channel 5. After this, when the individual electrodes 35*a* and 35*b* return to their original potential, the piezoelectric sheets 41 to 45 also return to their original flat shape. The pressure chamber 10 thereby returns to its original volume to eject the ink through the ink ejection port 8.

Next, a manufacturing method of the ink-jet head 1 will be described.

To manufacture the ink-jet head 1, the passage unit 4 and each of the actuator units 21 are separately manufactured and then both are bonded to each other. To manufacture the passage unit 4, each plate 22 to 30 forming the passage unit 4 is subjected to etching using a patterned photoresist as a mask, to form openings illustrated in FIGS. 7 and 9 in the respective plates 22 to 30. Next, the nine plates 22 to 30 are placed in layers with adhesives being interposed so as to form therein ink passages 32. The nine plates 22 to 30 are thereby bonded to each other to form a passage unit 4.

To manufacture each actuator unit 21, a conductive paste to be individual electrodes 35*b* is first printed in a pattern on a ceramic green sheet to be a piezoelectric sheet 43. In parallel with this, conductive pastes to be common electrodes 34*a* and 34*b* are printed in a pattern on ceramic green sheets to be piezoelectric sheets 42 and 44. After this, five green sheets to be piezoelectric sheets 41 to 45 are positioned in layers with a jig. The layered structure obtained is then baked at a predetermined temperature. After this, individual electrodes 35*a* are formed on the piezoelectric sheet 41 of the baked layered structure. For example, the individual electrodes 35*a* may be formed in the manner that a conductive film is plated on the whole of one surface of the piezoelectric sheet 41 and then unnecessary portions of the conductive film are removed by laser patterning. Alternatively, the individual electrodes 35*a* may be formed by depositing a conductive film on the piezoelectric sheet 41 by PVD (Physical Vapor Deposition) using a mask having openings at portions corresponding to the respective individual electrodes 35*a*. To this process, the manufacture of the actuator unit 21 is completed.

Next, the actuator unit 21 manufactured as described above is bonded to the passage unit 4 with an adhesive so that the piezoelectric sheet 45 may be in contact with the cavity plate 22. At this time, both are bonded to each other based of positioning marks formed on the surface of the cavity plate 22 of the passage unit 4 and the surface of the piezoelectric sheet 41, respectively.

After this, through-holes used for connecting vertically arranged corresponding individual electrodes 35*a* and 35*b* with each other are formed. The through-holes are then filled up with a conductive material. After this, an FPC 136, used for supplying electric signals to the individual electrodes 35*a* and 35*b* and the common electrodes 34*a* and 34*b*, is bonded onto and electrically connected with bonding positions corresponding to the respective electrodes on the actuator unit 21 by soldering. Further, through a predetermined process, the manufacture of the ink-jet head 1 is completed.

As described above, unlike the other electrodes, individual electrodes 35*a* to be the piezoelectric sheets 41 to 45 are not baked together with the ceramic materials. The reason for this is because the individual electrodes 35*a* are exposed, they are apt to evaporate at a high temperature upon baking. As a result, it is difficult to control their thickness in comparison with the other electrodes 34*a*, 34*b*, and 35*b* being covered with ceramic materials. However, even the thickness of the other electrodes 34*a*, 34*b*, and 35*b* may somewhat decrease upon baking. Therefore, it is difficult to form them into a small thickness if keeping the continuity after baking is taken into consideration. Contrastively, because the individual electrodes 35*a* are formed by the above-described technique after baking, they can be formed into a smaller thickness than the other electrodes 34*a*, 34*b*, and 35*b*. Thus, in the ink-jet head 1, by forming the individual electrodes 35*a* in the uppermost layer to have smaller thickness than the thickness of the other electrodes 34*a*, 34*b*, and 35*b*, the deformation of the piezoelectric sheets 41 to 43 including active layers is difficult to be restricted by the individual electrodes 35*a*. Therefore, the electrical efficiency and the area efficiency of the actuator unit 21 are improved.

In the ink-jet head 1, because the piezoelectric sheets 41 to 43 having active layers and the piezoelectric sheets 44 and 45 as the inactive layers are made of the same material, the material need not be changed in the manufacturing process. Thus, they can be manufactured through a relatively simple process, which may reduce the manufacturing cost. Furthermore, because each of the piezoelectric sheets 41 to 43 including active layers and the piezoelectric sheets 44 and 45 as the inactive layers has substantially the same thickness, a further reduction of cost can be achieved by simplifying the manufacturing process. This is because the thickness control can be more easily performed when the ceramic materials to be the piezoelectric sheets are applied to be put in layers.

Furthermore, in the ink-jet head 1, separate actuator units 21 corresponding to the respective ink ejection regions are bonded onto the passage unit 4, and are arranged along the longitudinal direction of the passage unit 4. Therefore, each of the actuator units 21, which may be uneven in dimensional accuracy and in positional accuracy of the individual electrodes 35*a*, 35*b* because they are formed by sintering or the like, can be positioned to the passage unit 4 independently from another actuator unit 21. Thus, even in case of a long head, the increase in shift of each actuator unit 21 from the accurate position on the passage unit 4 is controlled, and both can accurately be positioned to each other. Therefore, even for individual electrodes 35*a*, 35*b* that are relatively apart from a mark, the individual electrodes 35*a* and 35*b* can not be shifted considerably from the predetermined position to the corresponding pressure chamber 10. Thus results in good ink ejection performance and an improved manufacture yield of the ink-jet heads 1.

In contrast to the above, if a long-shaped actuator unit 4 is made like the passage unit 4, the more the individual electrodes 35*a* and 35*b* are apart from the mark, the larger the shift of the individual electrodes 35*a* and 35*b* is from the predetermined position on the corresponding pressure chamber 10 in a plan view when the actuator unit 21 is laid over the passage unit 4. This causes, the ink ejection performance of a pressure chamber 10 to deteriorate, which also decreases the ink ejection performance of the ink-jet head 1.

In addition, in the ink-jet head 1 constructed as described above, by sandwiching the piezoelectric sheets 41 to 43 by the common electrodes 34*a* and 34*b* and the individual electrodes 35*a* and 35*b*, the volume of each pressure chamber 10 can easily be changed by the piezoelectric effect. Further, because each of the piezoelectric sheets 41 to 43 having active layers is in a shape of a continuous flat layer, this can be easily manufactured.

Furthermore, the ink-jet head 1 has the actuator units 21 each having a unimorph structure in which the piezoelectric sheets 44 and 45 near each pressure chamber 10 are inactive and the piezoelectric sheet 41 to 43 distant from each pressure chamber 10 include active layers. Therefore, the change in volume of each pressure chamber 10 can be increased by the transversal piezoelectric effect. As a result, in contrast to an ink-jet head in which a layer including active layers is provided on the pressure chamber 10 side and a inactive layer is provided on the opposite side, the voltage to be applied to the individual electrodes 35*a* and 35*b* and/or high integration of the pressure chambers 10 can be lowered. By lowering the voltage to be applied, the size of the driver for driving the individual electrodes 35*a* and 35*b* can be reduced, thus reducing costs. In addition, each pressure chamber 10 can be reduced. Furthermore, even when the pressure chambers 10 are highly packed, a sufficient amount of ink can be ejected. Thus, leads to a decrease in the size of the head 1 and a highly dense arrangement of printing dots.

Further, in the ink-jet head 1, each actuator unit 21 has a substantially trapezoidal shape. The actuator units 21 are arranged in two lines in a crisscross manner so that the parallel opposed sides of each actuator unit 21 extend along the longitudinal direction of the passage unit 4, and the oblique sides of each neighboring actuator units 21 overlap each other in the lateral direction of the passage unit 4. Because the oblique sides of each neighboring actuator units 21 overlap each other, when the ink-jet head 1 moves along the lateral direction of the ink-jet head 1 relatively to a print medium, the pressure chambers 10 along the lateral direction of the passage unit 4 can compensate each other. As a result, high-resolution printing, can be achieved by using a small-size ink-jet head 1 with a very narrow width.

Furthermore, because many pressure chambers 10 neighboring each other are arranged in a matrix in the passage unit 4, the pressure chambers 10 can be disposed within a relatively small size at a high density.

In the above-described ink-jet head 1, trapezoidal actuator units are arranged in two lines in a crisscross manner. However, each actuator unit may not be trapezoidal. Further, actuator units may be arranged in only one line along the longitudinal direction of the passage unit. Actuator units may be arranged in three or more lines in a crisscross manner.

Figure 11:
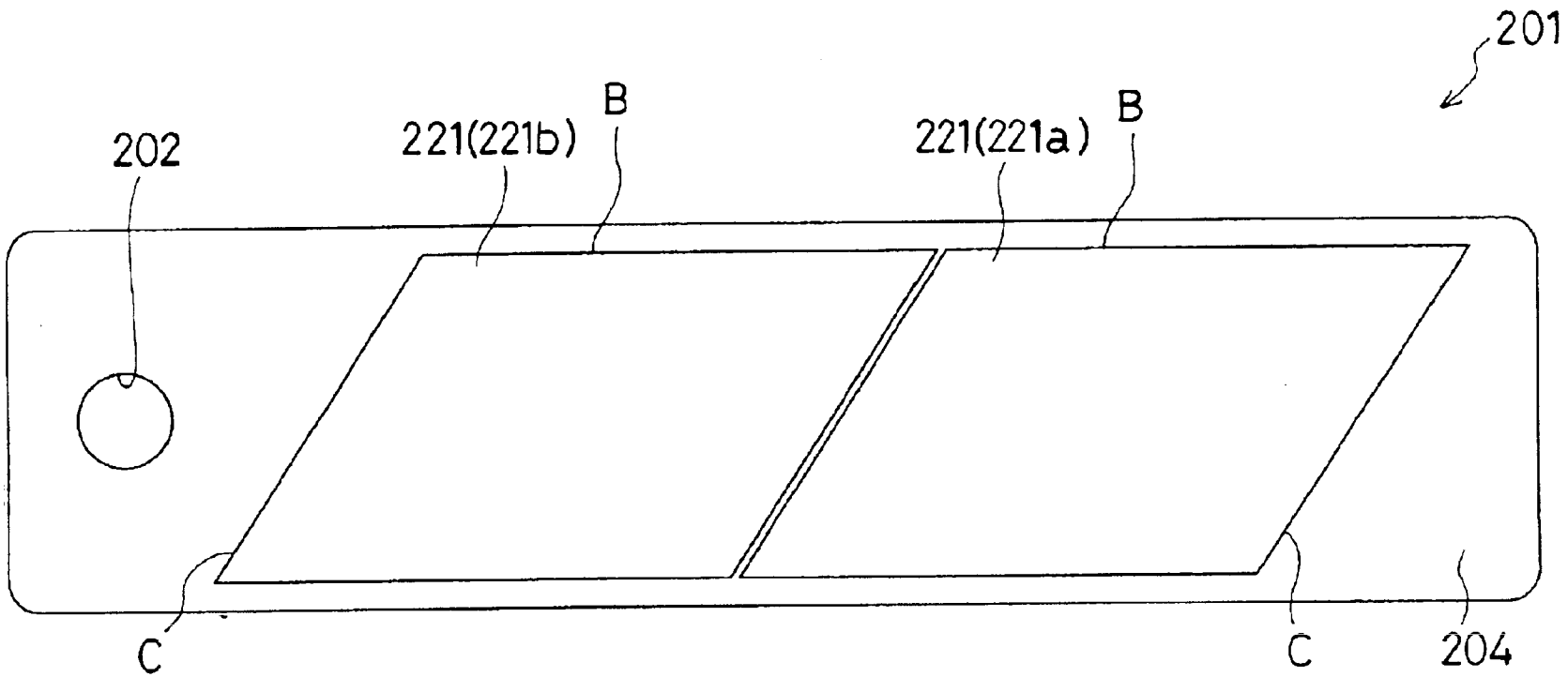
FIG. 11 is a plan view of a head main body included in an ink-jet head according to a second exemplary embodiment of the invention.

FIG. 11 shows is a plan view of a head main body of an ink-jet head according to second exemplary embodiment of the invention. In the ink-jet head and ink-jet printer according to this second exemplary embodiment, because the parts other than the head main body are similar to those of the above-described first embodiment, the detailed description thereof will be omitted.

Referring to FIG. 11, a head main body 201 of an ink-jet head according to this embodiment has a rectangular shape in a plan view extending in a main scanning direction. The head main body 201 includes a passage unit 204 in which a large number of pressure chambers 210 and a large number of ink ejection ports 208 are formed, as will be described later. Onto the upper face of the passage unit 204, two parallelogrammic actuator units 221 (In FIG. 11, the right and left ones are denoted by reference numerals 221*a* and 221*b*, respectively) are bonded so as to neighbor each other. Each actuator unit 221 is disposed so that its one side B extends along the longitudinal direction of the head main body 201. The neighboring actuator units 221 are disposed so as to be aligned with each other along the width (shorter length) direction of the head main body 201 with their oblique sides C being close to each other. An ink supply port 202 is open in the upper face of the passage unit 204. The ink supply port 202 is connected with an ink supply source through a passage (not shown).

Figure 12:
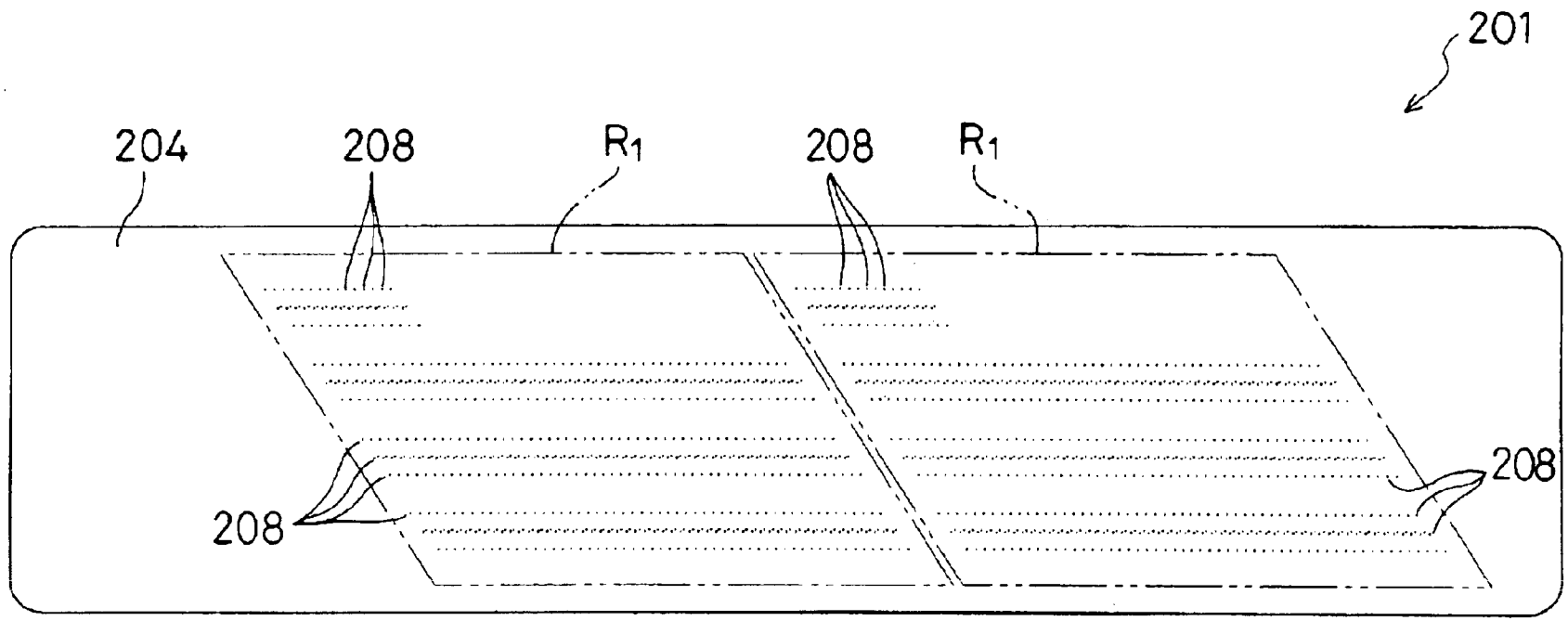
FIG. 12 is a bottom view of the head main body of FIG. 11.

As shown in FIG. 12, which representing the head main body 201 viewed from the printing face side, two ink ejection regions R1 of parallelogrammic shape are provided in the lower face of the passage unit 204 to correspond to the respective regions where the actuator units 221 are disposed. A large number of small-diameter ink ejection ports 208 are arranged in the surface of each ink ejection region R1.

This exemplary embodiment shows a case of monochrome printing. Thus, the ink supply port 202 is supplied with a single color ink (e.g., black). To perform multicolor printing, head main bodies 201 corresponding in number to colors (for example, in case of four colors of yellow, cyan, magenta, and black, four head main bodies 201) are aligned along the lateral direction of the passage unit. The head main bodies 201 are supplied with color inks different from one another to print.

Figure 13:
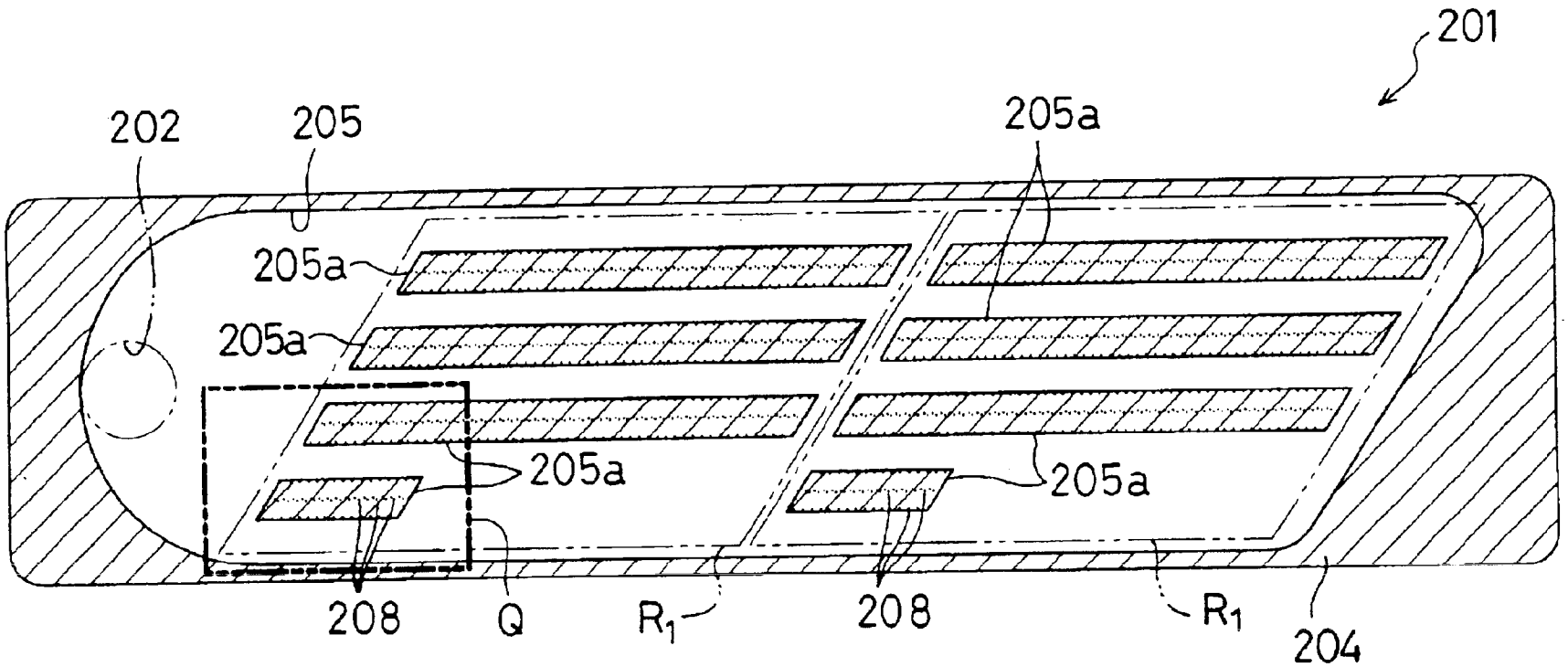
FIG. 13 is a cross-sectional view of the head main body of FIG. 11.

FIG. 13 is a sectional view illustrating the internal construction of the passage unit 204. Referring to FIG. 13, a manifold channel 205 is formed in the passage unit 204. The manifold channel 205 communicates with an ink supply source through the ink supply port 202, as a result, the manifold channel 205 is always filled up with ink. The ink supply port 202 is preferably provided with a filter for catching dust and dirt contained in ink.

The manifold channel 205 is formed in the most part of passage unit 204 to extend over the two ink ejection regions R1. In part of the manifold channel 205 corresponding to each ink ejection region R1, a large number of slender parallelogrammic island portions 205*a* are formed to be arranged at regular intervals. The length of each island portion 205*a* is along the longitudinal direction of the passage unit 204. In this construction, ink supplied through the ink supply port 202 passes between each neighboring island portions 205*a* in the manifold channel 205, and then it is distributed to pressure chambers 210 formed in the passage unit 204 in each ink ejection region R1.

Figure 15:
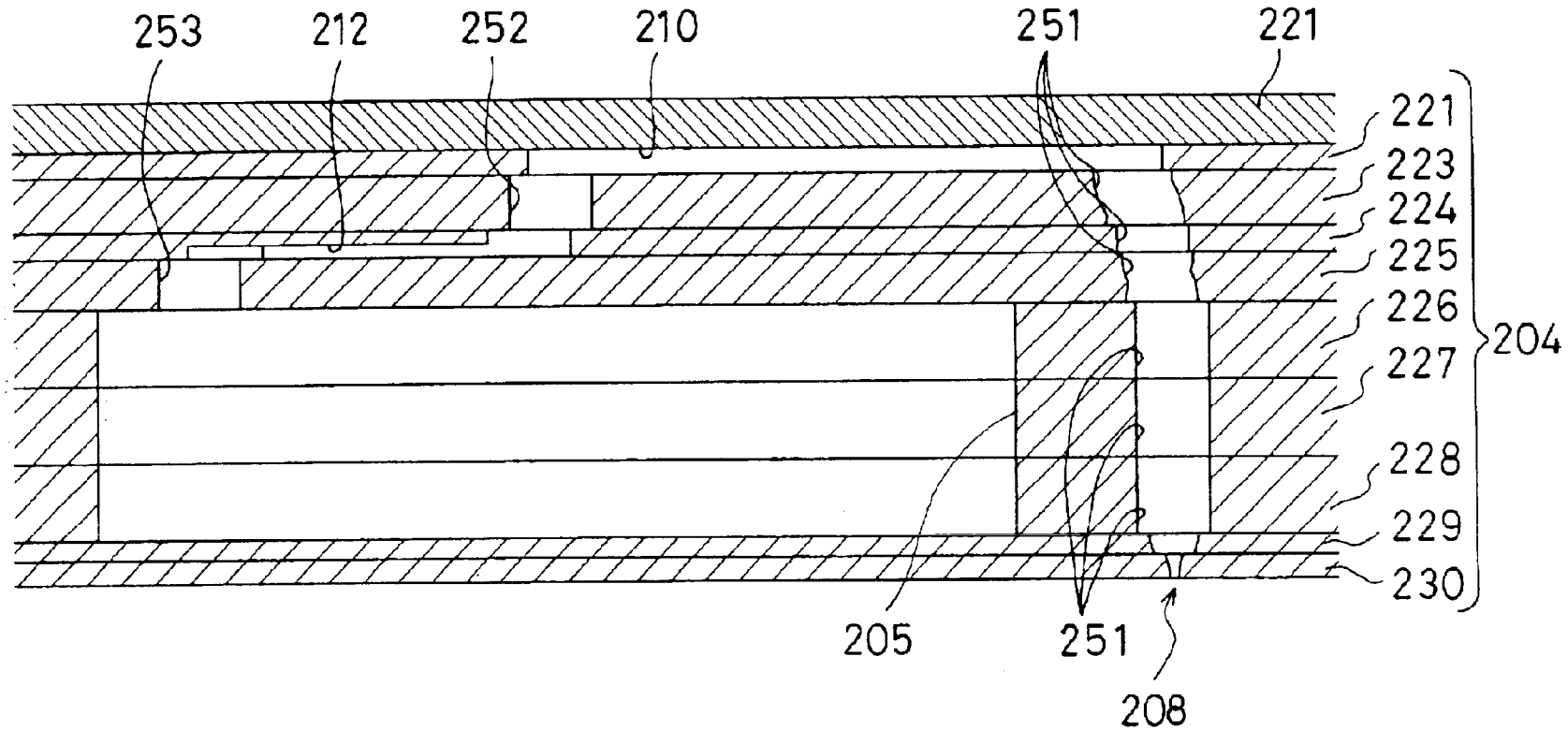
FIG. 15 is a partial sectional view of the head main body of FIG. 11.

Referring to FIG. 15, each ink ejection port 208 is made into a tapered nozzle. The ink ejection port 208 communicates with a manifold channel 205 through a pressure chamber 210 having a substantially parallelogrammic shape in a plan view and an aperture 212. In this construction, ink is supplied from the manifold channel 205 to the pressure chamber 210 through the aperture 212. By driving an actuator unit 221, energy is applied to the ink in the pressure chamber 210 to eject the ink through the ink ejection port 208.

Figure 14:
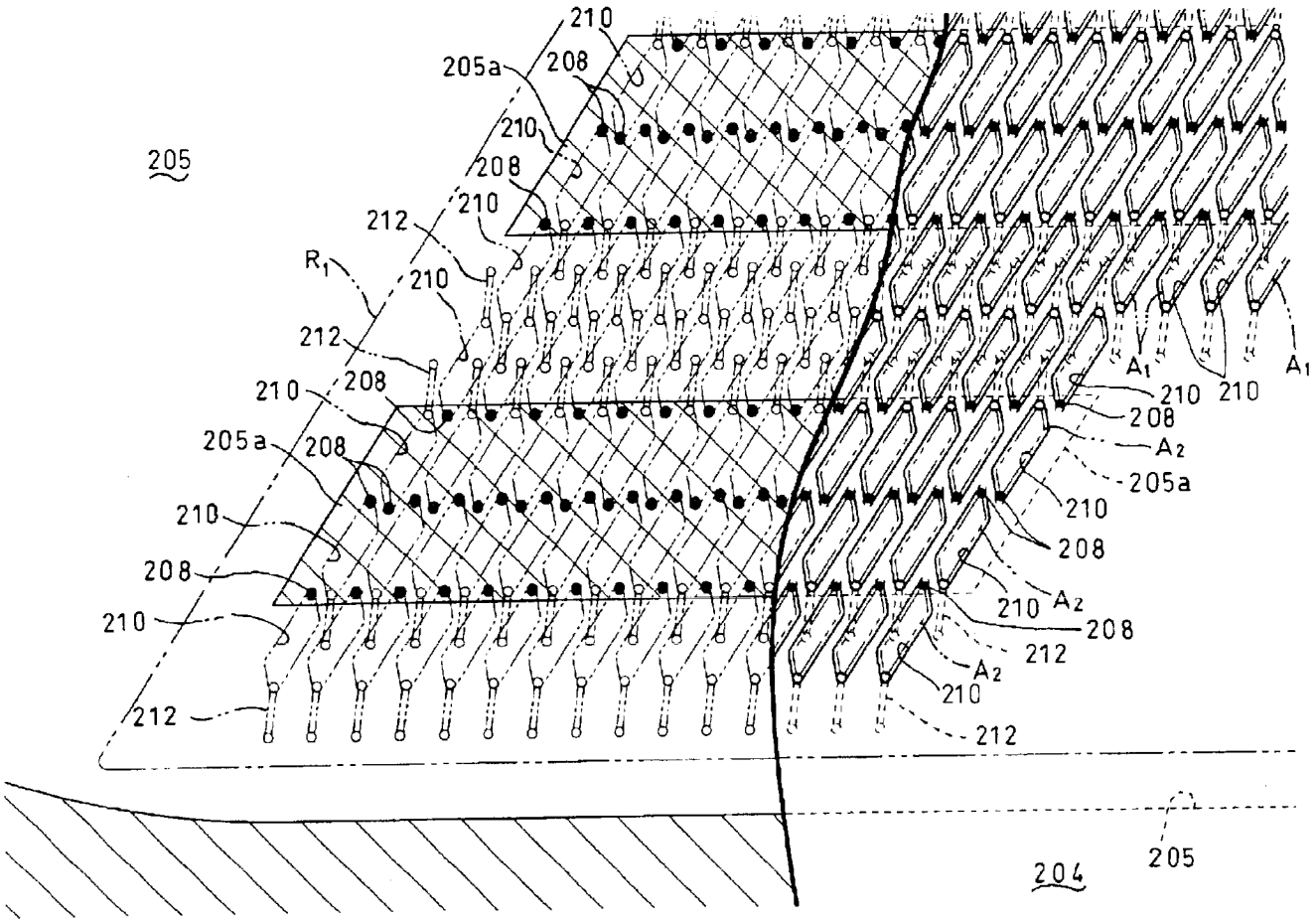
FIG. 14 is an enlarged view of the region Q enclosed with an alternate long and short dash line in FIG. 13.

FIG. 14 illustrates a detailed construction of the region denoted by reference Q in FIG. 13. As shown in FIG. 14, in a region of the upper face of the passage unit 204 corresponding to an ink ejection region R1, a large number of pressure chambers 210 are arranged in a matrix adjacent to or neighboring each other. Because the pressure chambers 210 are formed at a different level than that of the apertures 212 (as illustrated in FIG. 15), an arrangement such as that illustrated in FIG. 14 is possible in which each aperture 212 connected with a pressure chamber 210 overlaps another pressure chamber 210. As a result, a dense arrangement of the pressure chambers 210 can be closely or densely arranged, which reduces the size of the head main body 201 and increases the resolution of the formed image.

FIG. 15 illustrates a specific construction of a passage from a manifold channel 205 to an ink ejection port 208. Referring to FIG. 15, the passage unit 204 is laminated with nine sheet materials in total, i.e., a cavity plate 222, a base plate 223, an aperture plate 224, a supply plate 225, manifold plates 226, 227, and 228, a cover plate 229, and a nozzle plate 230. The above-described actuator units 221 are bonded to the upper face of the passage unit 204 to form a head main body 201. The detailed construction of each actuator unit 221 will be described later.

A parallelogrammic opening is formed in the cavity plate 222 to form a pressure chamber 210 as described above. A tapered ink ejection port 208 is formed in the nozzle plate 230 using a press. Communication holes 251 are formed through each of the plates 223 to 229 between the plates 222 and 230. The pressure chamber 210 communicates with the ink ejection port 208 through the communication holes 251. An aperture 212 is formed as an elongated hole in the aperture plate 224. One end of the aperture 212 is connected with an end portion of the pressure chamber 210 (opposite to the end portion connecting with the ink ejection port 208) through a communication hole 252 formed in the base plate 223. The aperture 212 is used to properly control the amount of ink to be supplied to the pressure chamber 210 and to prevent too much or too little ink from being ejected or released through the ink ejection port 208. A communication hole 253 is formed in the supply plate 225. The communication hole 253 connects the other end of the aperture 212 with the manifold channel 205.

Each of the nine plates 222 to 230 forming the passage unit 204 is made of metal. The pressure chamber 210, the aperture 212, and the communication holes 251, 252, and 253 are formed by selectively etching each metallic plate using a mask pattern. The nine plates 222 to 230 are arranged in layers and bonded to each other so that the passage as illustrated in FIG. 15 is formed therein.

Figure 16:
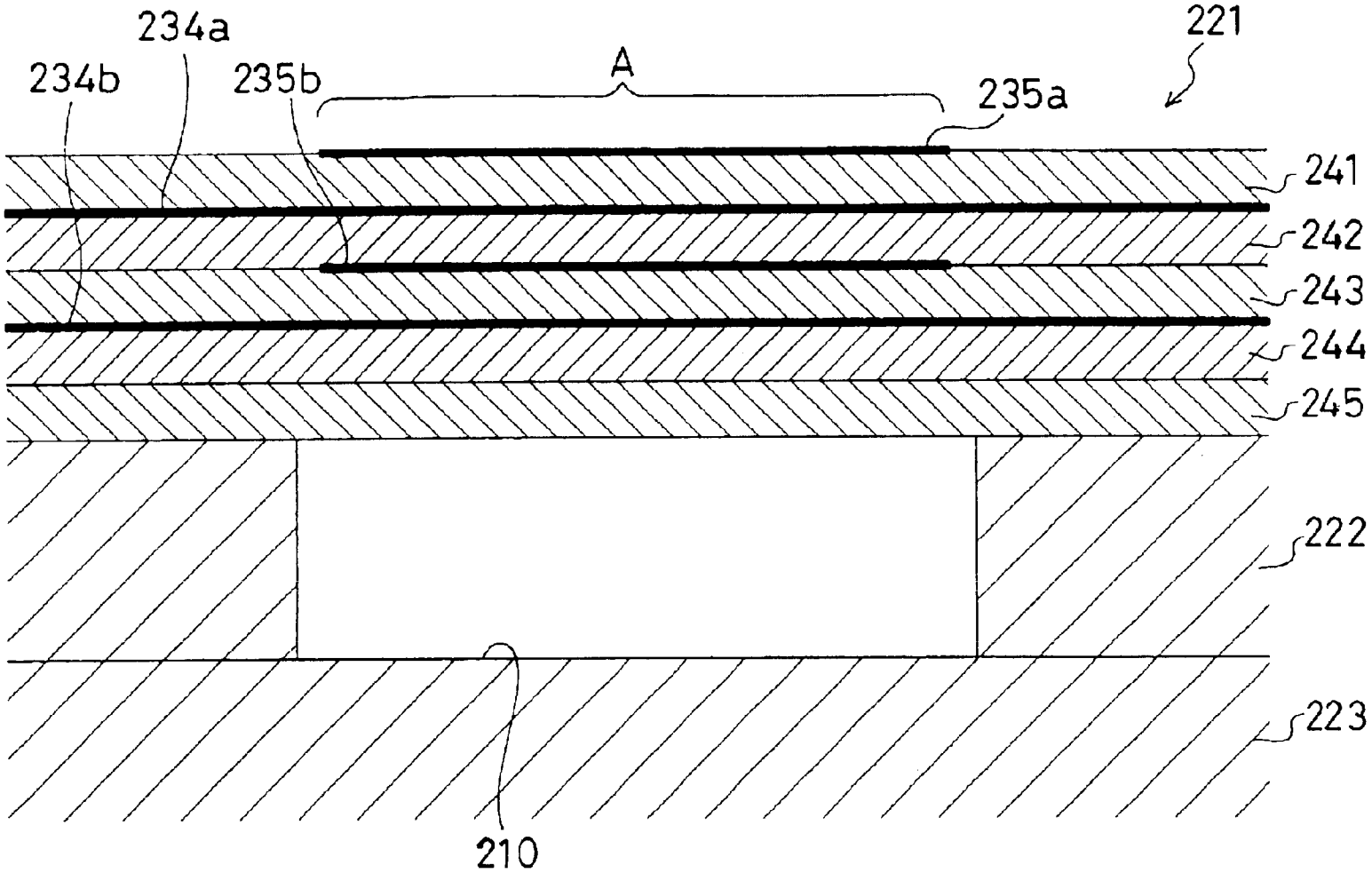
FIG. 16 is an enlarged sectional view illustrating the detailed construction of an actuator unit in the head main body of FIG. 11.

Referring to FIG. 16, each actuator unit 221 includes five piezoelectric sheets 241 to 245 having the same thickness of about 15 microns ($\mu$m). The piezoelectric sheets 241 to 245 are made into continuous flat layers. One actuator unit 221 is disposed to extend over many pressure chambers 210 formed in one ink ejection region R1 of the head main body 201. This can lead to a highly dense arrangement of individual electrodes 235*a* and 235*b* in the actuator unit 221. Each of the piezoelectric sheets 241 to 245 is made of a lead zirconate titanate (PZT)-base ceramic material having ferroelectricity.

Between the first and second piezoelectric sheets 241 and 242 from the top, an about 2 $\mu$m-thick common electrode 234*a* is interposed formed on substantially the entire of the lower and upper faces of the piezoelectric sheets. Between the third and fourth piezoelectric sheets 243 and 244, an approximately 2 $\mu$m-thick common electrode 234*b* is also interposed. On the upper face of the first piezoelectric sheet 241, an about 1 $\mu$m-thick individual electrode 235*a* is formed to correspond to each pressure chamber 210. As illustrated in FIG. 13, the individual electrode 235*a* has a similar shape to that of the pressure chamber 210 in a plan view, although the individual electrode 235*a* is slightly smaller than the pressure chamber 210. The individual electrode 235*a* is disposed such that the center of the individual electrode 235*a* coincides with the center of the corresponding pressure chamber 210. Further, between the second and third piezoelectric sheets 242 and 243, an about 2 $\mu$m-thick individual electrode 235*b* is arranged and formed like the individual electrode 235*a*. The portion where the individual electrodes 235*a* and 235*b* are disposed corresponds to a pressure generation portion A for applying pressure to ink in the pressure chamber 210. No electrode is provided between the fourth and fifth piezoelectric sheets 244 and 245, and on the lower face of the fifth piezoelectric sheet 245. Each of the electrodes 234*a*, 234*b*, 235*a*, and 235*b* is made of, e.g., an Ag—Pd-base metallic material.

The common electrodes 234*a* and 234*b* are grounded in a region (not shown). Thus, the common electrodes 234*a* and 234*b* are kept at the ground potential at a region corresponding to any pressure chamber 210. In order that the individual electrodes 235*a* and 235*b* in each pair corresponding to a pressure chamber 210 can be controlled in potential independently of another pair, they are connected with a suitable driver IC through a lead provided separately for each pair of individual electrodes 235*a* and 235*b*.

In the head main body 201, the piezoelectric sheets 241 to 245 are to be polarized in their thickness. That is, the actuator unit 221 has a so-called unimorph structure in which the upper (i.e., distant from the pressure chamber 210) three piezoelectric sheets 241 to 243 are layers including active layers, and the lower (i.e., near the pressure chamber 210) two piezoelectric sheets 244 and 245 are made into inactive layers.

In this structure, when the individual electrodes 235*a* and 235*b* in a pair are set at a positive or negative predetermined potential, if the polarization is in the same direction as the electric field for example, the portion (an active layer, i.e., a pressure generation portion) in the piezoelectric sheets 241 to 243 sandwiched by the common and individual electrodes contracts perpendicularly to the polarization. On the other hand, because the inactive piezoelectric sheets 244 and 245 are affected by an electric field, they do not contract in themselves. Thus, a difference in strain is produced along the polarization between the upper piezoelectric sheets 241 to 243 and the lower piezoelectric sheets 444 and 245. As a result, the piezoelectric sheets 241 to 245 are ready to deform into a convex shape toward the inactive side (unimorph deformation). At this time, because the lower face of the lowermost piezoelectric sheet 245 is fixed to the upper face of the partition dividing pressure chambers 210, the pressure generation portion A of the piezoelectric sheets 241 to 245 deforms into a convex shape toward the pressure chamber 210 side to decrease the volume of the pressure chamber 210. As a result, the pressure of ink is raised and ink is ejected through the ink ejection port 208. After this, when a driving voltage is no longer applied to the individual electrodes 235*a* and 235*b*, the piezoelectric sheets 241 to 245 return to the original shape and the pressure chamber 210 also returns to its original volume. Thus, the pressure chamber 210 draws ink therein through the manifold channel 205.

Figure 17:
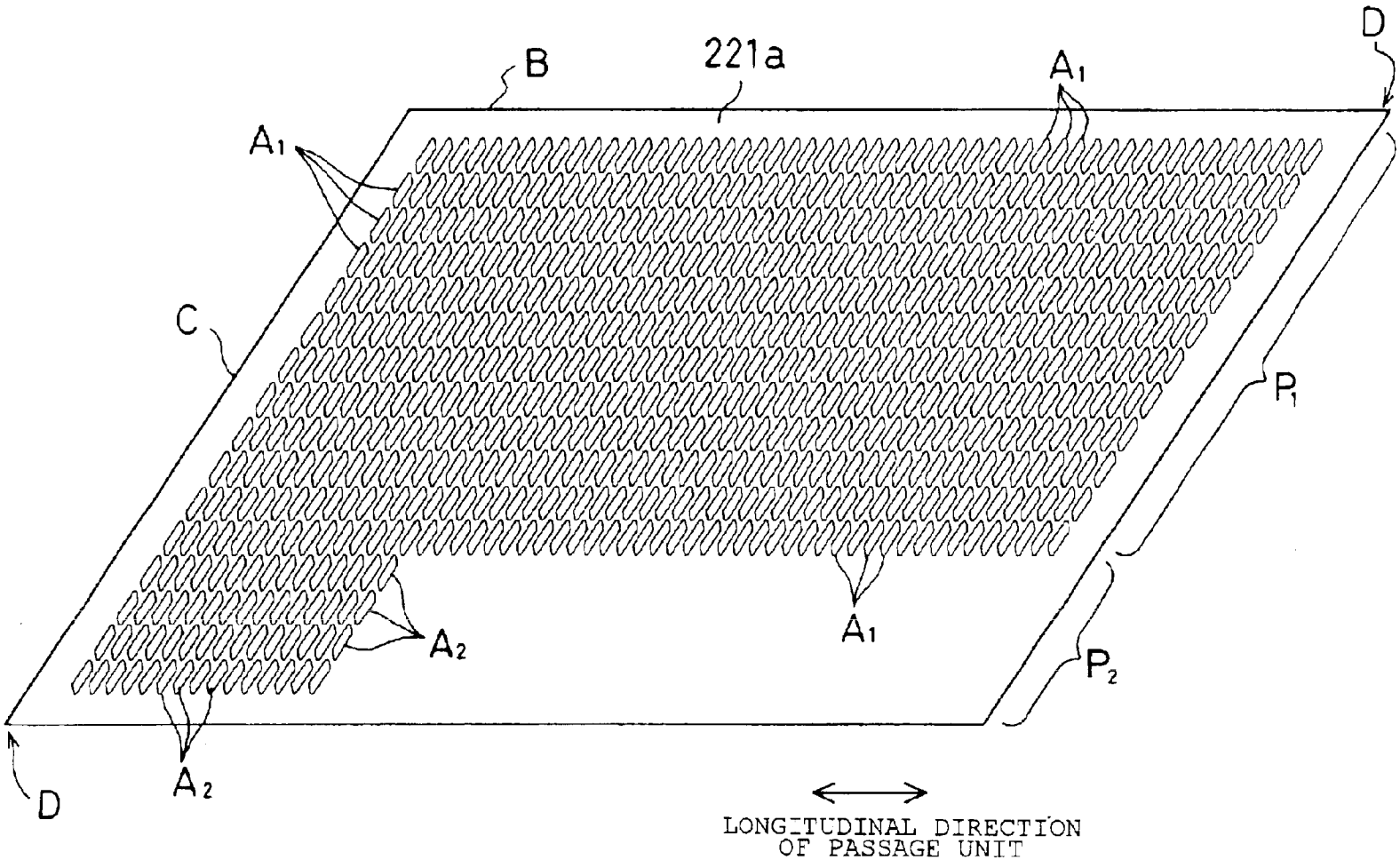
FIG. 17 is an enlarged plan view of an actuator unit in the head main body of FIG. 11.
Figure 18:
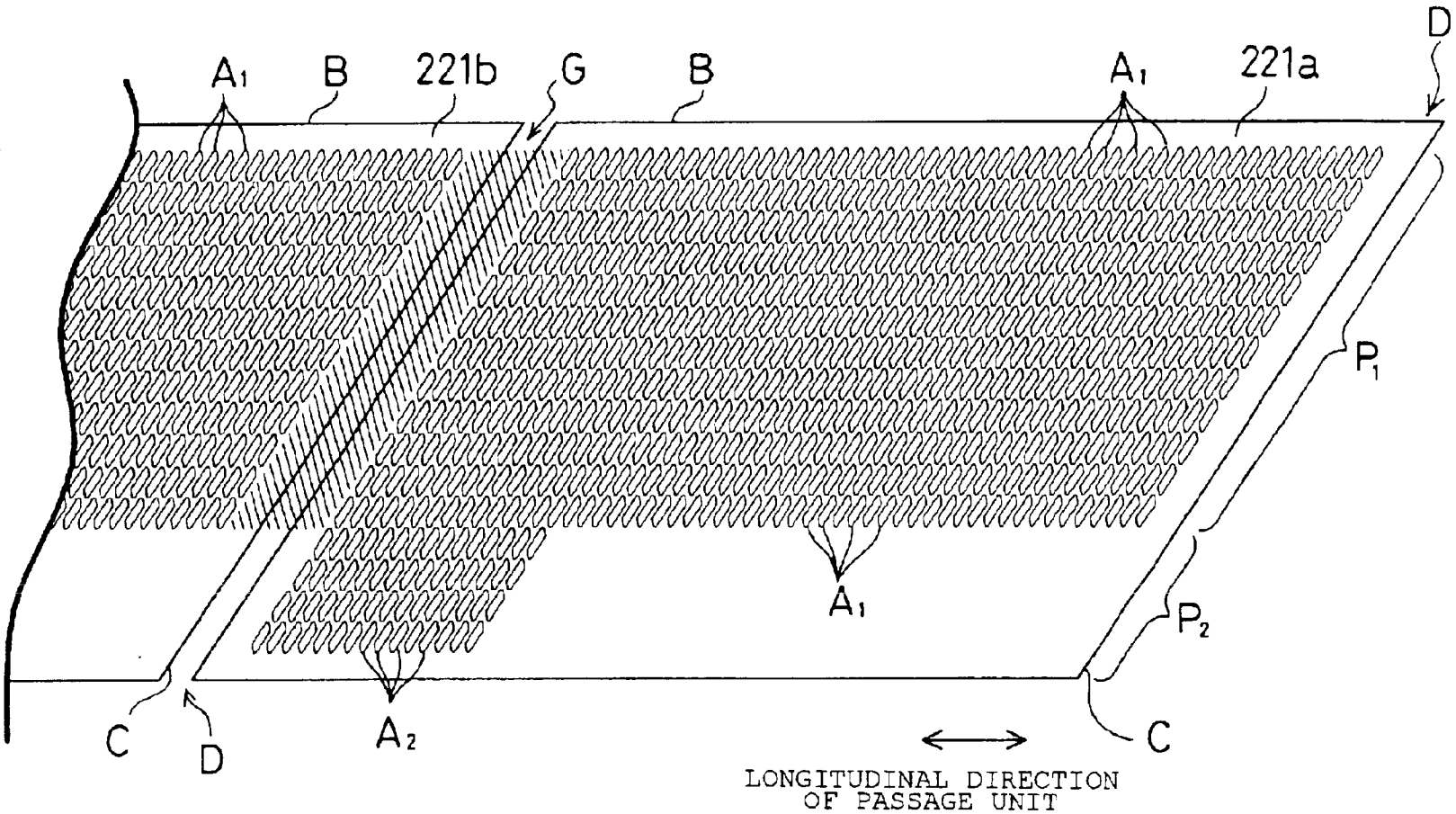
FIG. 18 is an enlarged plan view showing a seam portion between two actuator units of FIG. 17.

Next, the shape of the two actuator units 221*a* and 221*b* and the arrangement of individual electrodes 235*a* and 235*b*, i.e., the pressure generation portions A, will be described. FIG. 17 illustrates the shape of an actuator unit 221*a* and the arrangement of pressure generation portions. FIG. 18 shows the relation between a seam portion between the actuator units 221*a* and 221*b* and pressure generation portions in an additional region.

The head main body 201 includes two actuator units 221*a* and 221*b* as described above. The two actuator units 221*a* and 221*b* have a similar shape and arrangement for pressure generation portions A.

As illustrated in FIGS. 11 and 17, the actuator unit 221*a* has a parallelogrammic shape is disposed so that its side B extends in parallel with the longitudinal direction of the passage unit 204 and its other side C inclines to the longitudinal direction of the passage unit 204. As illustrated in FIG. 17, in the actuator unit 221*a*, two regions P1 and P2 are provided which are separated in the lateral direction of the passage unit 204 by a straight line along the longitudinal direction of the passage unit 204. That is, the regions P1 and P2 neighbor each other in the lateral direction of the passage unit 204.

In region P1, a large number of pressure generation portions A1 are arranged to neighbor each other in a matrix along the longitudinal direction of the passage unit 204 and along the other side C of the parallelogram.

In region P2, pressure generation portions A2 are arranged to neighbor each other in a matrix only in the vicinity of a corner D of the parallelogram near to the actuator unit 221*b*.

As shown in FIG. 18, when the two actuator units 221*a* and 221*b* are arranged in line along the longitudinal direction of the passage unit 204, the pressure generation portions A2 of the additional region P2 provided in the actuator unit 221*a* are in a place corresponding to a region (shown as hatched region G in FIG. 18) where no pressure generation portion A can be disposed in the basic region P1 because it is in the seam between the actuator units 221*a* and 221*b*. That is, the pressure generation portions A2 of the additional region P2 are disposed to correspond to a gap portion G between the pressure generation portions A1 of the region P1 provided in the actuator unit 221*a* and the pressure generation portions A1 of the region P1 provided in the neighboring actuator unit 221*b*. Thus, although no separate actuator unit is provided for ejecting ink through the gap portion G, the head main body 201 print through the longitudinal direction of the passage unit without any breaks.

In other words, because no pressure generation portion can be disposed in the region (region G) near the seam portion between the actuator units 221*a* and 221*b*, no pressure chamber 210 and no ink ejection port 208 also can be disposed in that region. Therefore, if the pressure generation portions A2 were not disposed in the additional region P2 provided in the actuator unit 221*a*, printing in the portion corresponding to the gap portion G cannot be done. As a result, a portion where ink ejection cannot occur is produced in the seam portion between the actuator units 221*a* and 221*b*. However, because the pressure generation portions A2 are disposed in the additional region P2 provided in the actuator unit 221*a* in a portion overlapping that region G in the lateral direction of the passage unit, there is no portion where ink ejection cannot occur. As a result, an image without any breaks can be formed on an image recording medium.

As described above, in this embodiment, the actuator unit 221 includes lines in each of which a large number of pressure generation portions A1 and A2 are arranged along the longitudinal direction of the passage unit 204. Regarding the lengths of these lines along the longitudinal direction of the passage unit 204, each line in the basic region P1 is longer than each line in the additional region P2. Further, as for the number of lines along the lateral direction of the passage unit 204, the number of lines in the additional region P2 is the same as the number of lines that might exist in the length of the corresponding region G along the lateral direction of the passage unit 204. Therefore, if an imaginary straight line is drawn to extend along the lateral direction of the passage unit 204, the number of lines that the imaginary straight line crosses in the region where the neighboring actuator units 221*a* and 221*b* overlap each other is the same as the number of lines that the imaginary straight line crosses in the region where the neighboring actuator units 221*a* and 221*b* do not overlap each other.

The above-described feature can be achieved by arranging two actuator units 221*a* and 221*b* having the same construction. Thus, the arrangement of parts can be simplified and the cost and the number of process steps necessary for designing or manufacturing the actuator units 221*a* and 221*b* can be reduced.

Figure 19:
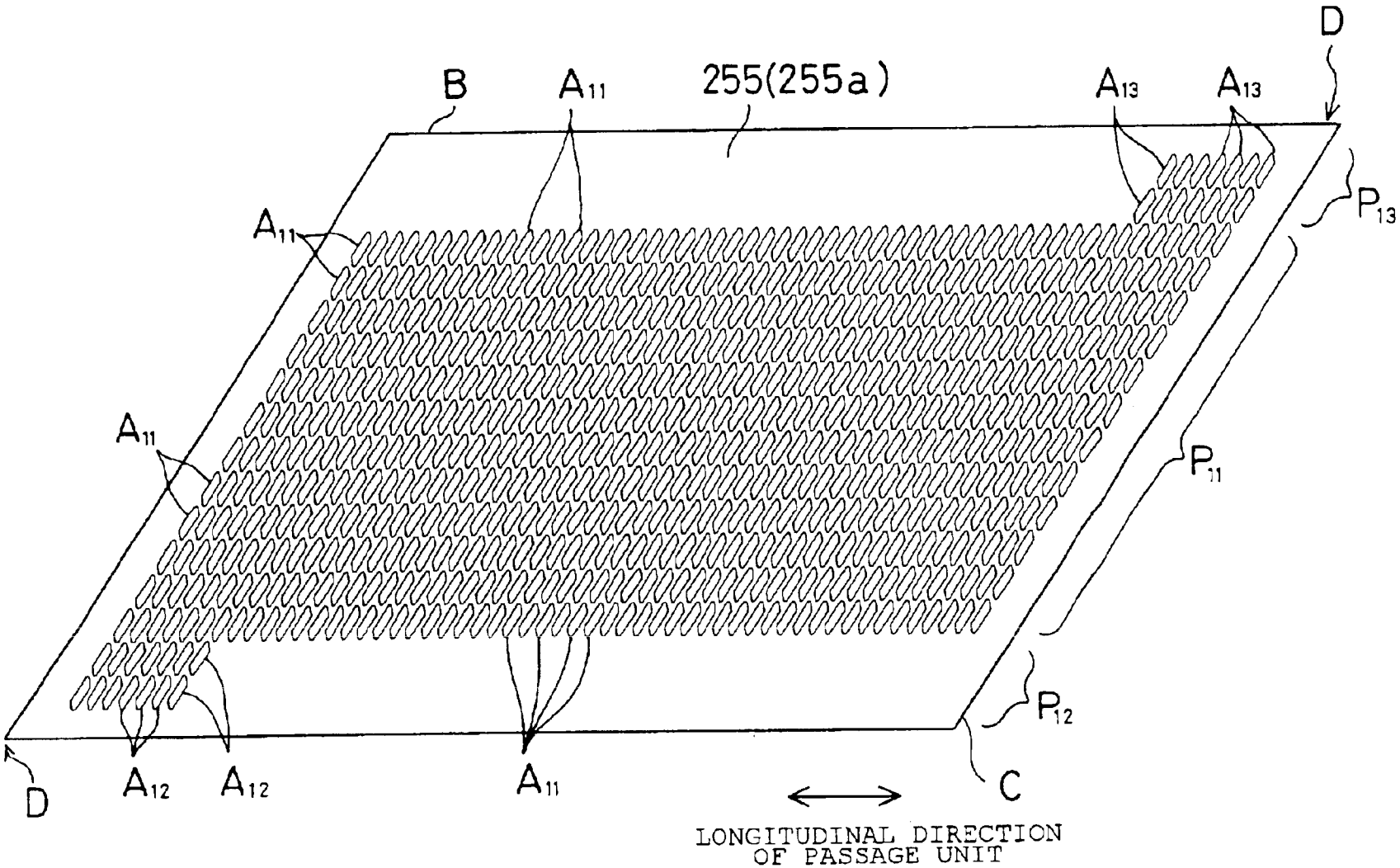
FIG. 19 is an enlarged plan view of an actuator unit according to a modification of a second exemplary embodiment of the invention.
Figure 20:
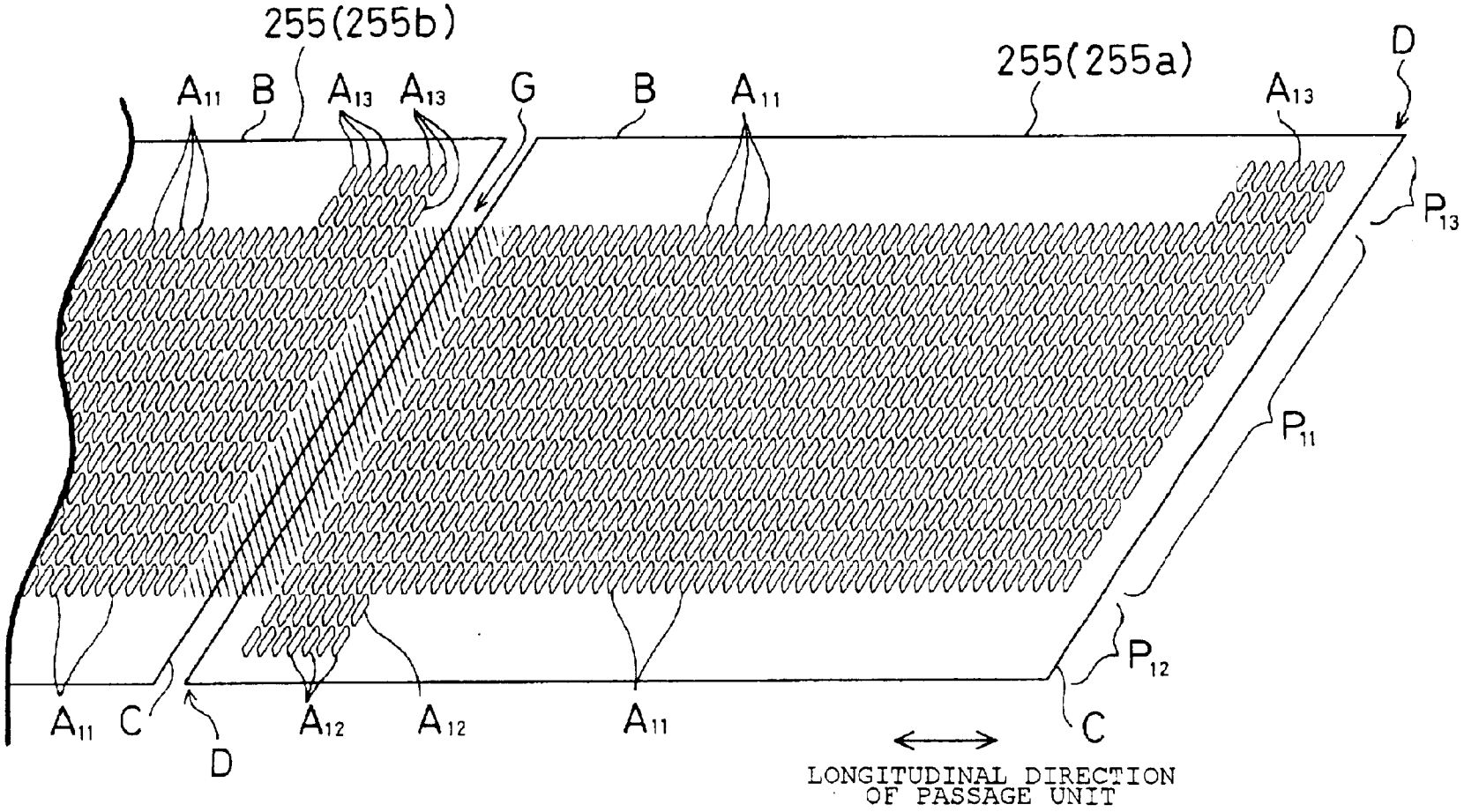
FIG. 20 is an enlarged plan view showing a seam portion between two actuator units of FIG. 19.

Various exemplary arrangement of pressure generation portions A in the actuator unit 221 are described below. As shown in FIG. 19, an exemplary arrangement of pressure generation portions in an actuator unit 255 is provided. FIG. 20 shows the relation between a seam portion between actuator units and pressure generation portions in an additional region in the arrangement of FIG. 19.

The actuator unit 255*a* of FIG. 19 is divided into three regions P11, P12, and P13 in the lateral direction of the passage unit. The middle region P11 in the lateral direction of the passage unit is used as a basic region and the remaining regions P12 and P13 are used as additional regions.

In the basic region P11, similar to the arrangement of FIG. 17, a large number of pressure generation portions A11 are arranged neighboring each other in a matrix along the longitudinal direction of the passage unit and along the other side C of the parallelogram. In an additional region P12, pressure generation portions A12 are arranged nieighboring each other in a matrix in the vicinity of an acute corner D of the parallelogram near to the actuator unit 255*b*. In the other additional region P13, pressure generation portions A13 are arranged neighboring each other in a matrix in the vicinity of an acute corner D of the parallelogram far from the actuator unit 255*b*.

Therefore, as illustrated in FIG. 20, the pressure generation portions A12 of the additional region P12 of the actuator unit 255*a* and the pressure generation portions A13 of the additional region P13 of the actuator unit 255*b* are disposed in a gap portion G between the pressure generation portions A11 of the basic region P11 provided in the actuator unit 255*a* and the pressure generation portions A11 of the basic region P11 provided in the neighboring actuator unit 255*b*. Thus, the head main body 201 can be provided such that ink can be ejected with any breaks through the longitudinal direction of the passage unit.

Further, this embodiment can have the same advantages as those of the above-described first embodiment. More specifically, because the two actuator units 255*a* and 255*b* are arranged along the longitudinal direction of the passage unit 204, even in case of a long passage unit 204, high accuracy can be obtained in positioning of the actuator units 255*a* and 255*b* to the passage unit 204. Therefore, good ink ejection performance can be obtained and the manufacture yield of ink-jet heads 201 can be remarkably improved. In addition, by sandwiching the piezoelectric sheets 241 to 243 between the common electrodes 234*a* and 234*b* and the individual electrodes 235*a* and 235*b*, the volume of each pressure chamber 210 can easily be changed by the piezoelectric effect. Further, the piezoelectric sheets 241 to 243 having active layers are continuous flat layers that can be easily be manufactured. Further, because an actuator unit 221 of a unimorph structure is provided in which the piezoelectric sheets 244 and 245 near to each pressure chamber 210 are inactive and the piezoelectric sheets 241 to 243 far from each pressure chamber 210 are layers including active layers, the change in volume of each pressure chamber 210 can be increased by the transversal piezoelectric effect. This leads to a lower voltage that needs to be applied to the individual electrodes 235*a* and 235*b*, as well as a high integration of the pressure chambers 210. Further, in the passage unit 204, because a large number of pressure chambers 210 neighboring each other are arranged in a matrix, the pressure chambers 210 can be disposed at a high density within a relatively small size.

In this embodiment, only two actuator units are arranged. However, three or more actuator units may be arranged. Arrangement of many actuator units can bring about a long ink-jet head. Such a long ink-jet head is advantageous because it can perform printing onto even a large-size image recording medium at a high speed.

Figure 21A:
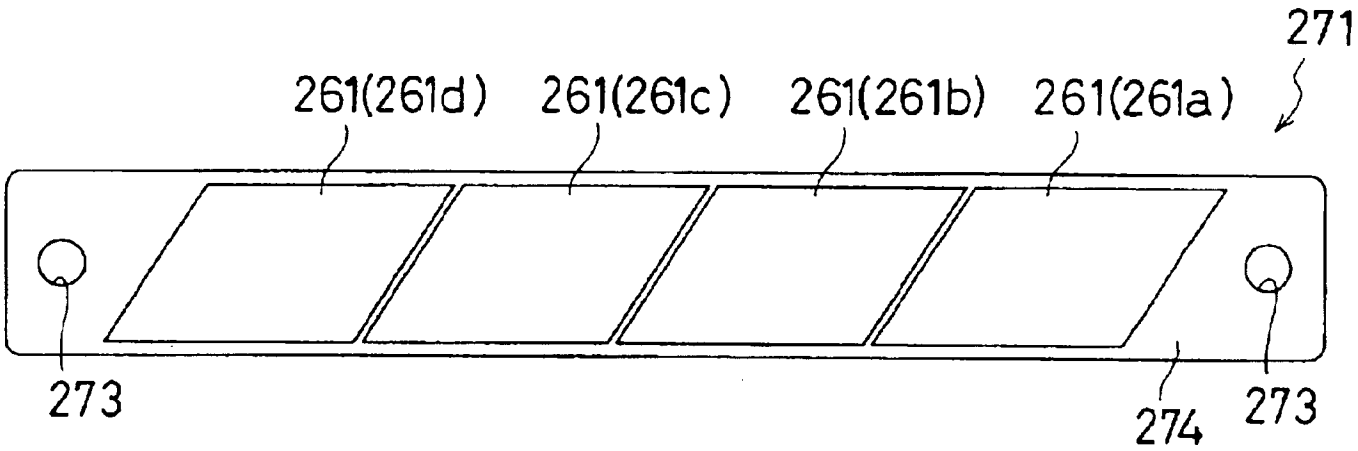
FIG. 21A is a plan view of a head main body included in an ink-jet head according to a modification of the invention, in which four actuator units are arranged.
Figure 21B:
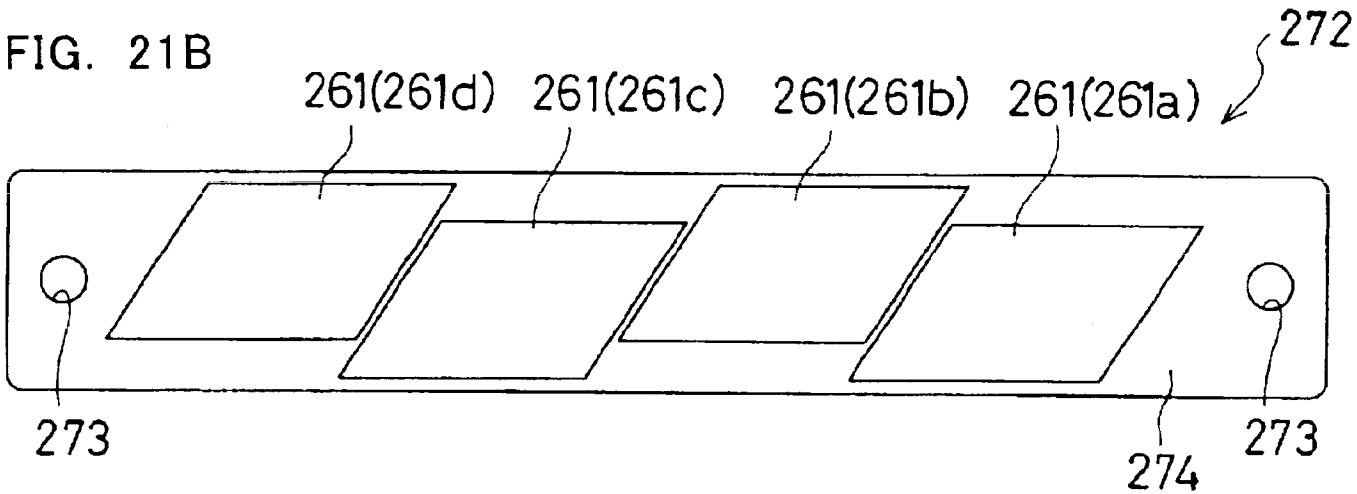
FIG. 21B is a plan view of a head main body included in an ink-jet head according to another modification of the invention, in which four actuator units are arranged.

FIGS. 21A and 21B illustrate head main bodies 271 and 272 according to modifications of the invention, in which four actuator units 261*a*, 261*b*, 261*c*, and 261*d* each constructed like an actuator unit 221 or 255, are arranged in line on and bonded to passage units 274 having ink supply ports 273 near their both ends. Such an actuator units 261*a–d*, like an actuator unit 221 or 255, can be used in common to passage units different in length, e.g., from a relatively short passage unit as illustrated in FIG. 11 to a long passage unit as illustrated in FIG. 21A. Thus, such an actuator unit has high applicability as a component, which can reduce the manufacture cost.

In the head main bodies 201 and 271 as illustrated in FIGS. 11 and 21A, actuator units are arranged on a passage unit in a straight line with being aligned in the lateral direction of the passage unit. However, as in a head main body 272 illustrated in FIG. 21B for example, actuator units 261*a*, 261*b*, 261*c*, and 261*d* may be arranged in a crisscross form. However, from the viewpoint of making an ink-jet head compact, the arrangement as illustrated in FIG. 11 or 21A is preferable in which actuator units are arranged in a straight line along the longitudinal direction of the passage unit with being regularly aligned in the lateral direction of the passage unit. Particularly in case of the arrangement of FIG. 11 or 21A, the width of the ink-jet head can be made small. Therefore, when two or more ink-jet heads are arranged along their width to be supplied with inks of different colors for multicolor printing, they can be disposed within a compact space. This is further advantageous because occurrence of a shear in color of an image can be lessened even when an image recording medium runs in an oblique state upon printing.

Figure 22:
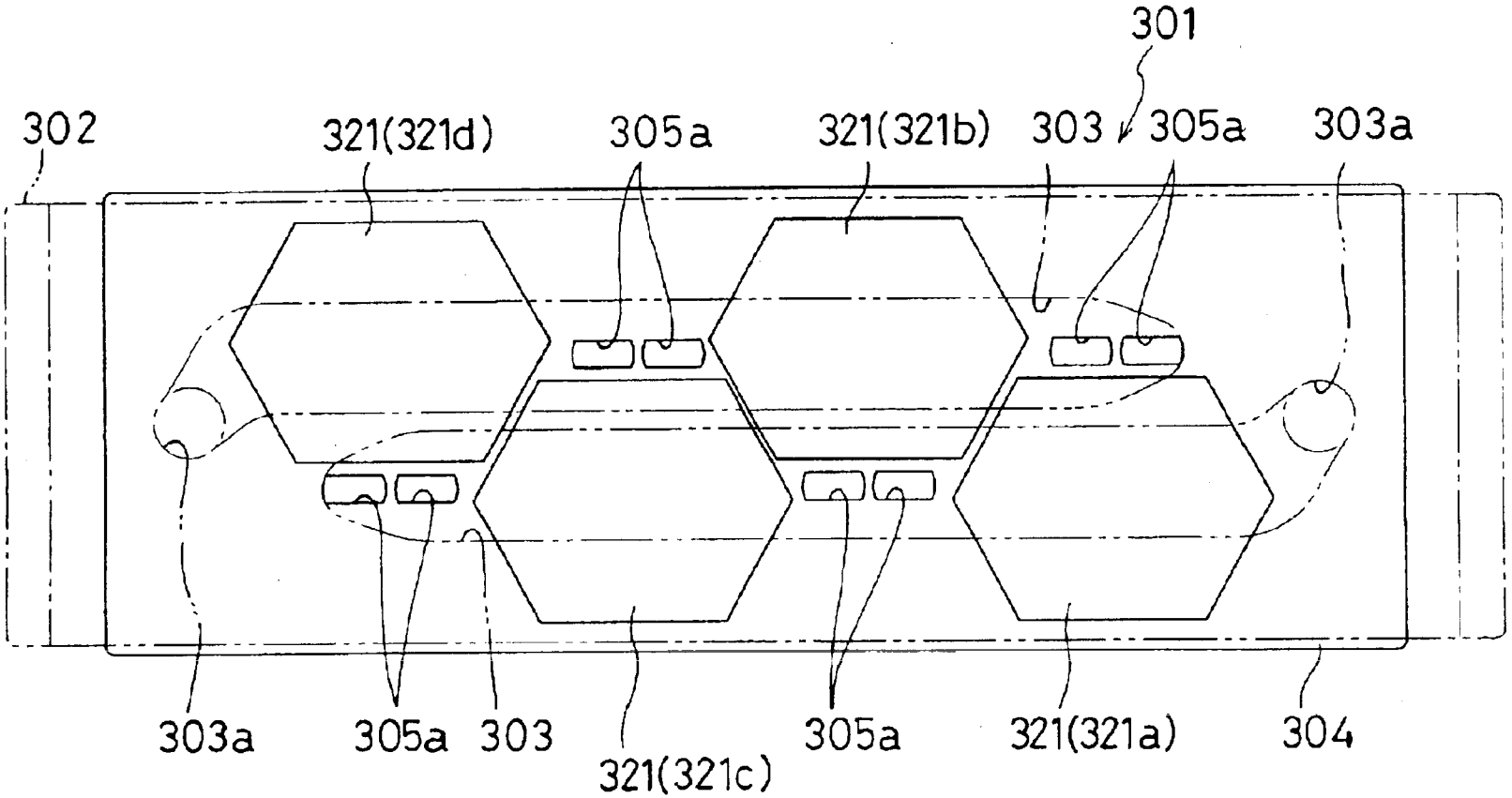
FIG. 22 is a plan view of a head main body included in an ink-jet head according to a third exemplary embodiment of the invention.

Next, a third embodiment of the invention will be described. FIG. 22 is a plan view of a head main body of an ink-jet head according to this embodiment. In the ink-jet head and ink-jet printer according to this embodiment, because the parts other than the head main body is similar to that of the above-described first embodiment, the detailed description thereof is omitted here.

Referring to FIG. 22, a head main body 301 of an ink-jet head according to this embodiment has a rectangular shape in a plan view extending in one direction. The head main body 301 includes a passage unit 304 in which a large number of pressure chambers 310 and a large number of ink ejection ports 308 are formed as will be described later. On the upper face of the passage unit 304, four regular-hexagonal actuator units 321 (In FIG. 22, they are denoted by reference numerals 321*a*, 32 1*b*, 321*c*, and 321*d*, respectively, in order from the right) are arranged in two lines in a crisscross manner and they are bonded to the upper face of the passage unit 304. Each actuator unit 321 is disposed so that its opposed parallel sides (upper and lower sides) extend along the longitudinal direction of the head main body 301. Each neighboring actuator units 321 are disposed so that their oblique sides is to be close to each other and have overlapping portions in the lateral direction of the passage unit.

Figure 23:
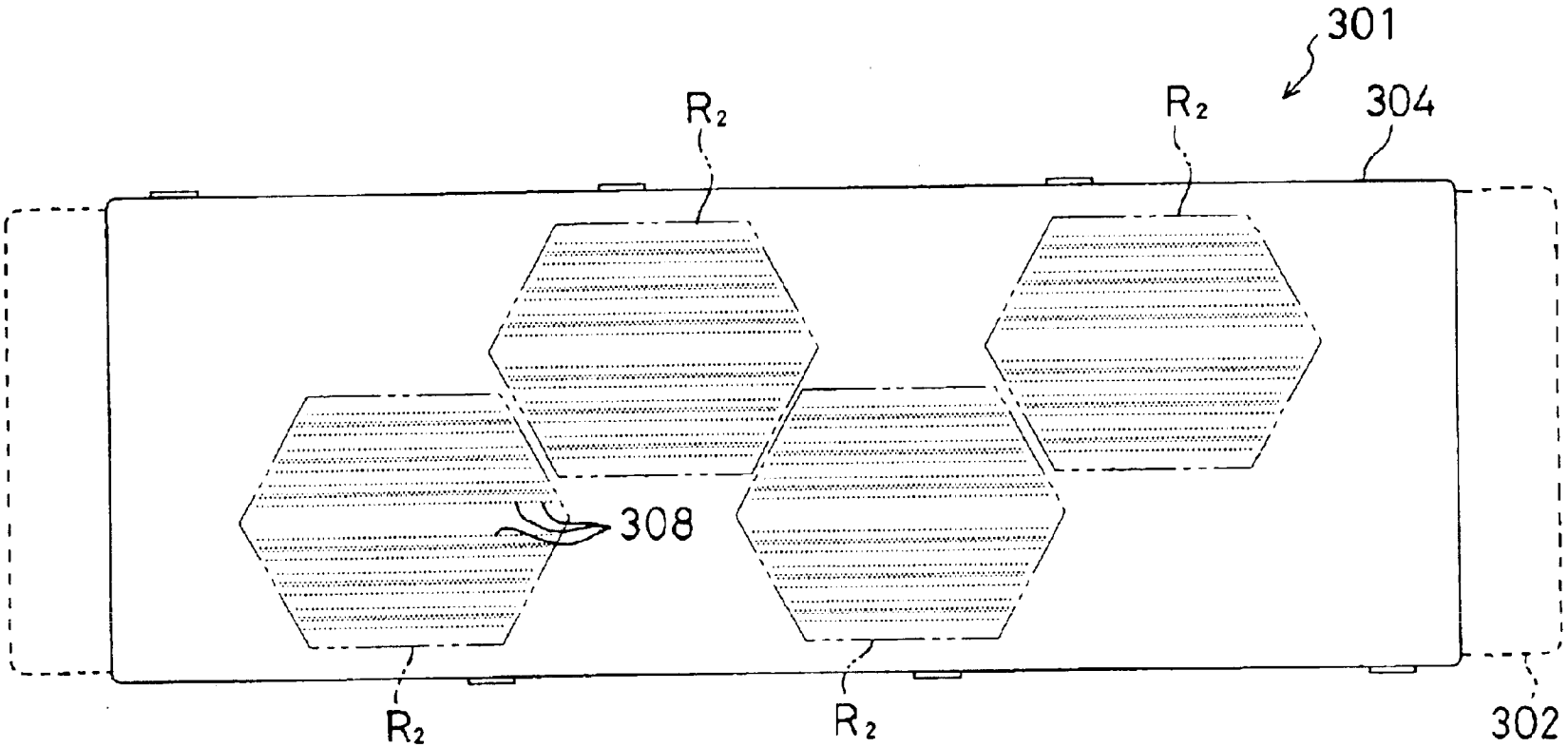
FIG. 23 is a bottom view of the head main body of FIG. 22.

Referring to FIG. 23, four hexagonal ink ejection regions R2 are provided in the lower face of the passage unit 304 to correspond to the respective regions where the actuator units 321 are disposed. A large number of small-diameter ink ejection ports 308 are arranged in the surface of each ink ejection region R2. A base block 302 is disposed on the upper face of the head main body 301. A pair of ink reservoirs 303 each having a slender shape along the longitudinal direction of the head main body 301 is provided in the base block 302. An opening 303*a* is formed in the upper face of the base block 302 at one end of each ink reservoir 303. Each opening 303*a* is connected with a ink tank (not shown). As a result, each ink reservoir 303 is always filled up with ink.

Figure 24:
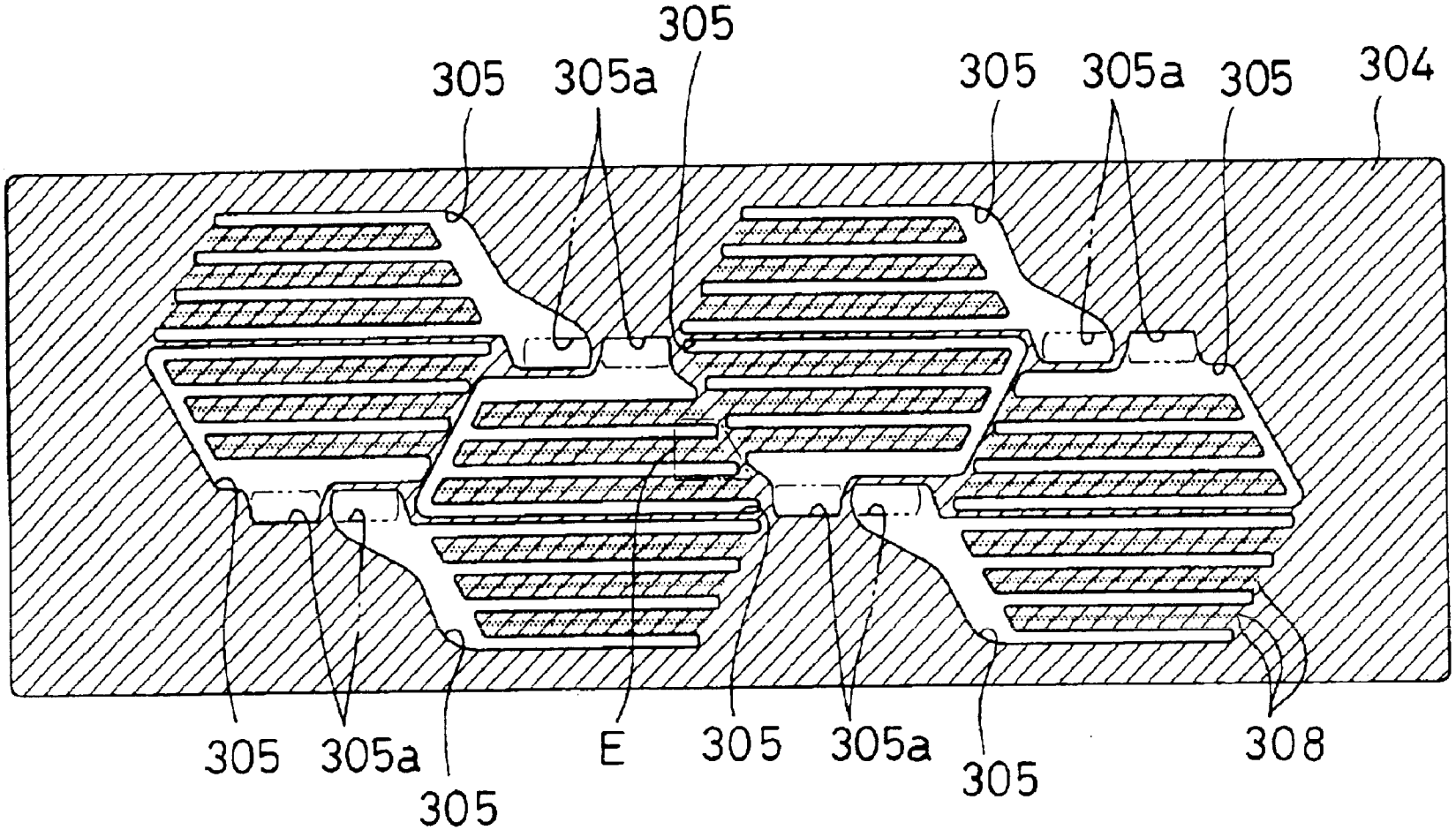
FIG. 24 is a cross-sectional view of the head main body of FIG. 22.

FIG. 24 is a sectional view illustrating the internal construction of the passage unit 304. Referring to FIG. 24, manifold channels 305 acting as ink supply sources are formed in the passage unit 304. Each manifold channel 305 communicates with an ink reservoir 303 through the corresponding opening 305*a* formed in the upper face of the passage unit 304. Each opening 305*a* is preferably provided with a filter for catching dust and dirt contained in the ink.

Each manifold channel 305 branches at its opening 305*a* to supply ink to a number of pressure chambers 310 as described later. When each hexagonal ink ejection region R2 illustrated in FIG. 23 is evenly divided vertically into two regions, one manifold channel 305 is formed so as to correspond to one of the two regions. Eight manifold channel 305 is provided and each of them is so designed in shape as to distribute and supply ink to all pressure chambers 310 included in the corresponding region.

The ink ejection port 308 in one half region in the lateral direction of the passage unit communicates with one of the ink reservoirs 303 in a pair through a manifold channel 305. The ink ejection port 308 in the other half region in the lateral direction of the ink-jet head communicates with the other ink reservoir 303. By configuring the manifold channels 305, the openings 305*a*, and the ink reservoirs 303 in such a manner, two printing modes can be realized: (1) a mode in which the ink reservoirs 303 in the pair are supplied with ink of the same color to perform monochrome high-resolution printing; and (2) a mode in which the ink reservoirs 303 in the pair are supplied with ink of different colors to perform two-color printing with the single head main body 301. This is a widely usable construction.

Figure 26:
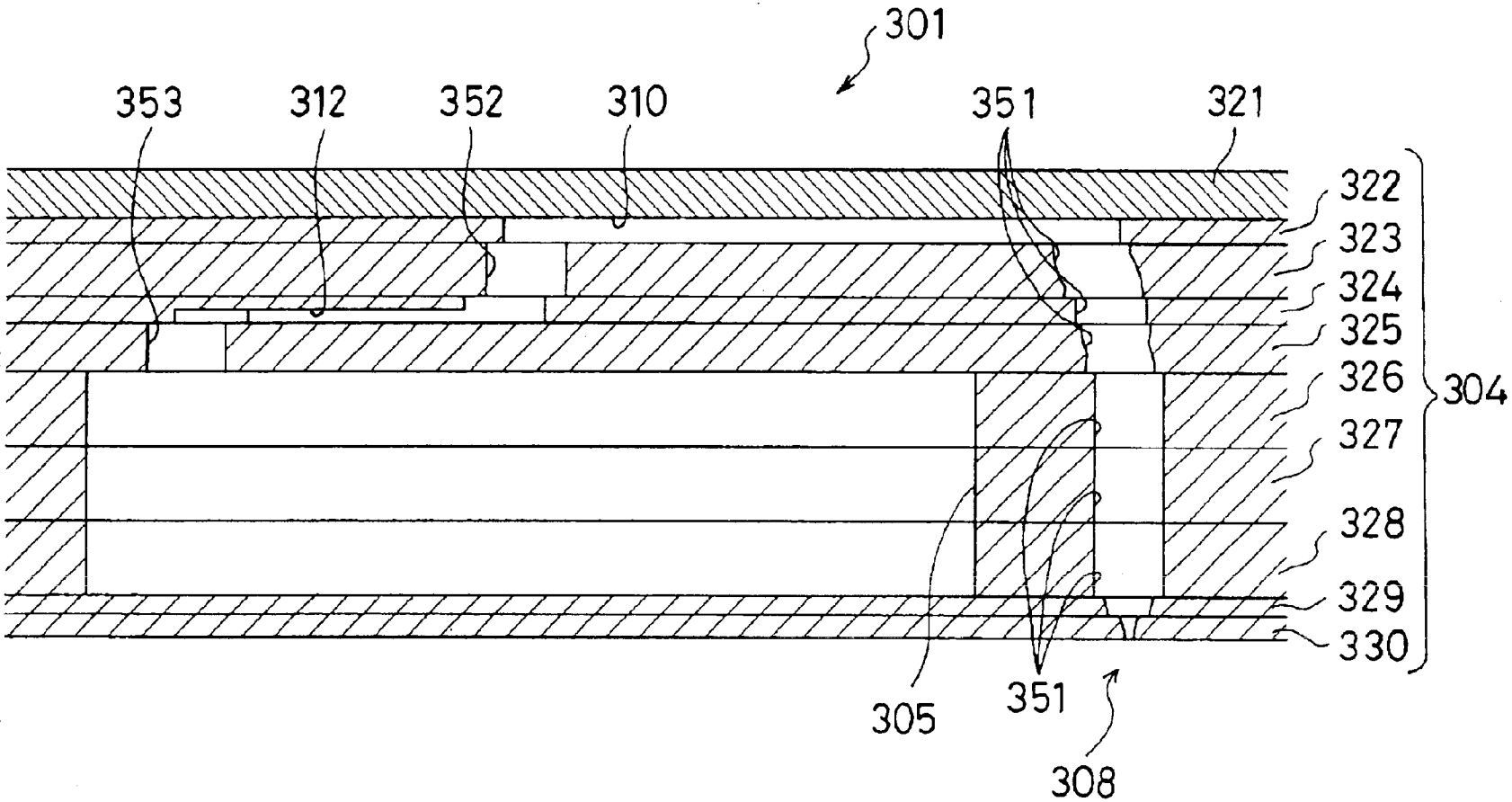
FIG. 26 is a partial sectional view of the head main body of FIG. 22.

Referring to FIG. 26, each ink ejection port 308 is made into a tapered nozzle. The ink ejection port 308 communicates with a manifold channel 305 through a pressure chamber 310 having a nearly rhombic shape in a plan view and an aperture 312. In this construction, ink is supplied to the manifold channel 305 through the ink reservoir 303 and further supplied from the manifold channel 305 to the pressure chamber 310 through the aperture 312. By driving an actuator unit 321 as will be described later, jet energy is applied to the ink in the pressure chamber 310 to eject the ink through the ink ejection port 308.

Figure 25:
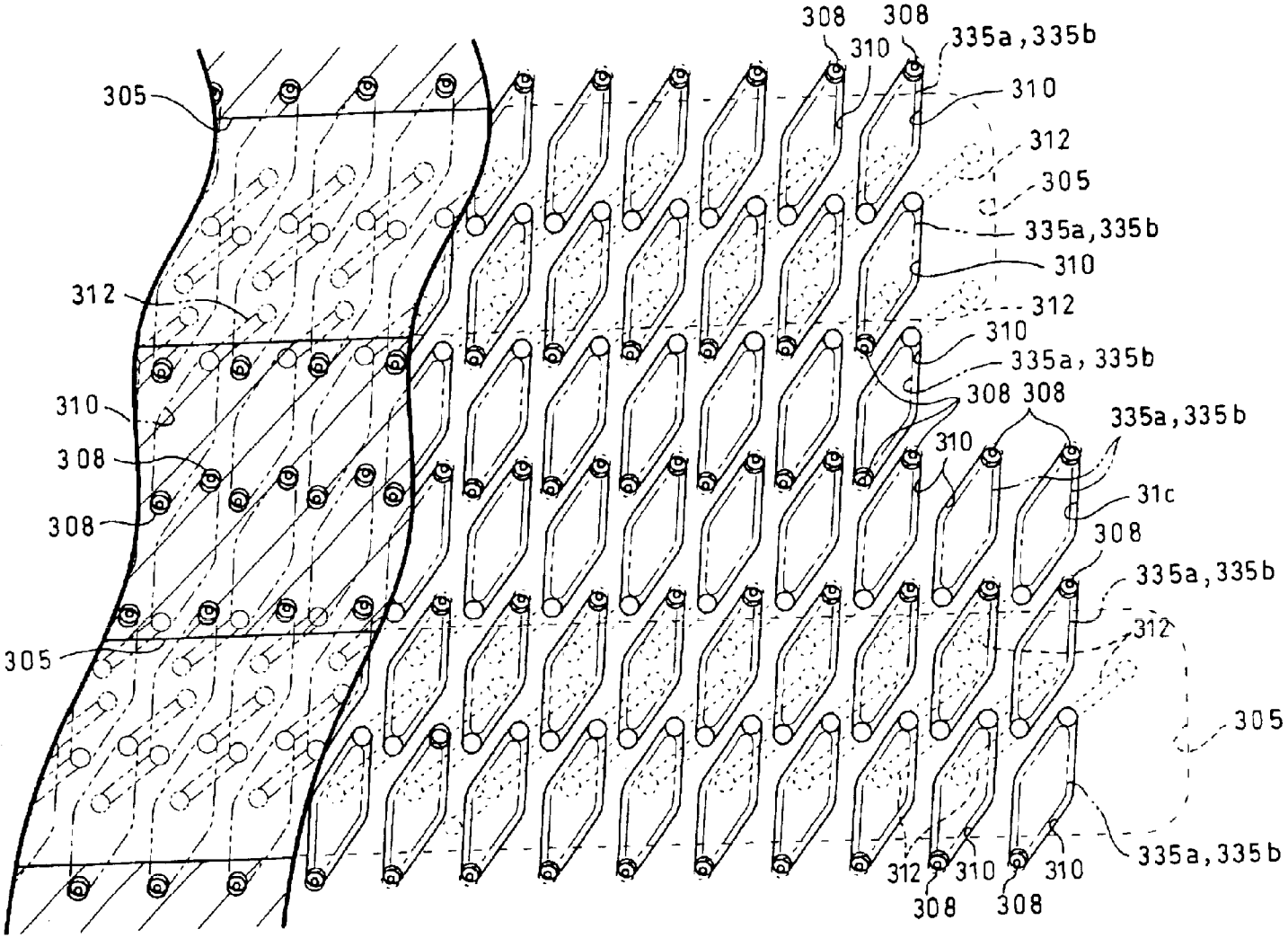
FIG. 25 is an enlarged view of the region E enclosed with an alternate long and short dash line in FIG. 24.

FIG. 25 illustrates a detailed construction of the region denoted by reference E in FIG. 24. As shown in FIG. 25, in a region of the upper face of the passage unit 304 corresponding to an ink ejection region R2, a large number of pressure chambers 310 are arranged in a matrix neighboring each other. Because the pressure chambers 310 are formed at a different level from that of the apertures 312 as illustrated in FIG. 26, an arrangement is possible in which each aperture 312 connected with a pressure chamber 310 overlaps another pressure chamber 310. As a result, a highly dense arrangement of the pressure chambers 310 can be realized, which may reduce the size of the head main body 301 and increase the resolution of a formed image.

FIG. 26 illustrates a specific construction of a passage from a manifold channel 305 to an ink ejection port 308. Referring to FIG. 26, the passage unit 304 is laminated with nine sheet materials in total, i.e., a cavity plate 322, a base plate 323, an aperture plate 324, a supply plate 325, manifold plates 326, 327, and 328, a cover plate 329, and a nozzle plate 330. The above-described actuator units 321 are bonded to the upper face of the passage unit 304 to constitute a head main body 301. The detailed construction of each actuator unit 321 will be described later.

A rhombic opening is formed in the cavity plate 322 to form a pressure chamber 310. A tapered ink ejection port 308 is formed in the nozzle plate 330 with a press. Communication holes 351 are formed through each of the plates 323 to 329 between the plates 322 and 330. The pressure chamber 310 communicates with the ink ejection port 308 through the communication holes 351. An aperture 312 as an elongated hole is formed in the aperture plate 324. One end of the aperture 312 is connected with an end portion of the pressure chamber 310 (opposite to the end portion connecting with the ink ejection port 308) through a communication hole 352 formed in the base plate 323. The aperture 312 is for properly controlling the amount of ink to be supplied to the pressure chamber 310 and preventing too much or too little ink from being ejected through the ink ejection port 308. A communication hole 353 is formed in the supply plate 325. The communication hole 353 connects the other end of the aperture 312 with the manifold channel 305.

Each of the nine plates 322 to 330 forming the passage unit 304 is made of metal. The above-described pressure chamber 310, aperture 312, and communication holes 351, 352, and 353 are formed by selectively etching each metallic plate using a mask pattern. The nine plates 322 to 330 are put in layers and bonded to each other with being positioned to each other so that the passage as illustrated in FIG. 26 is formed therein.

Figure 27:
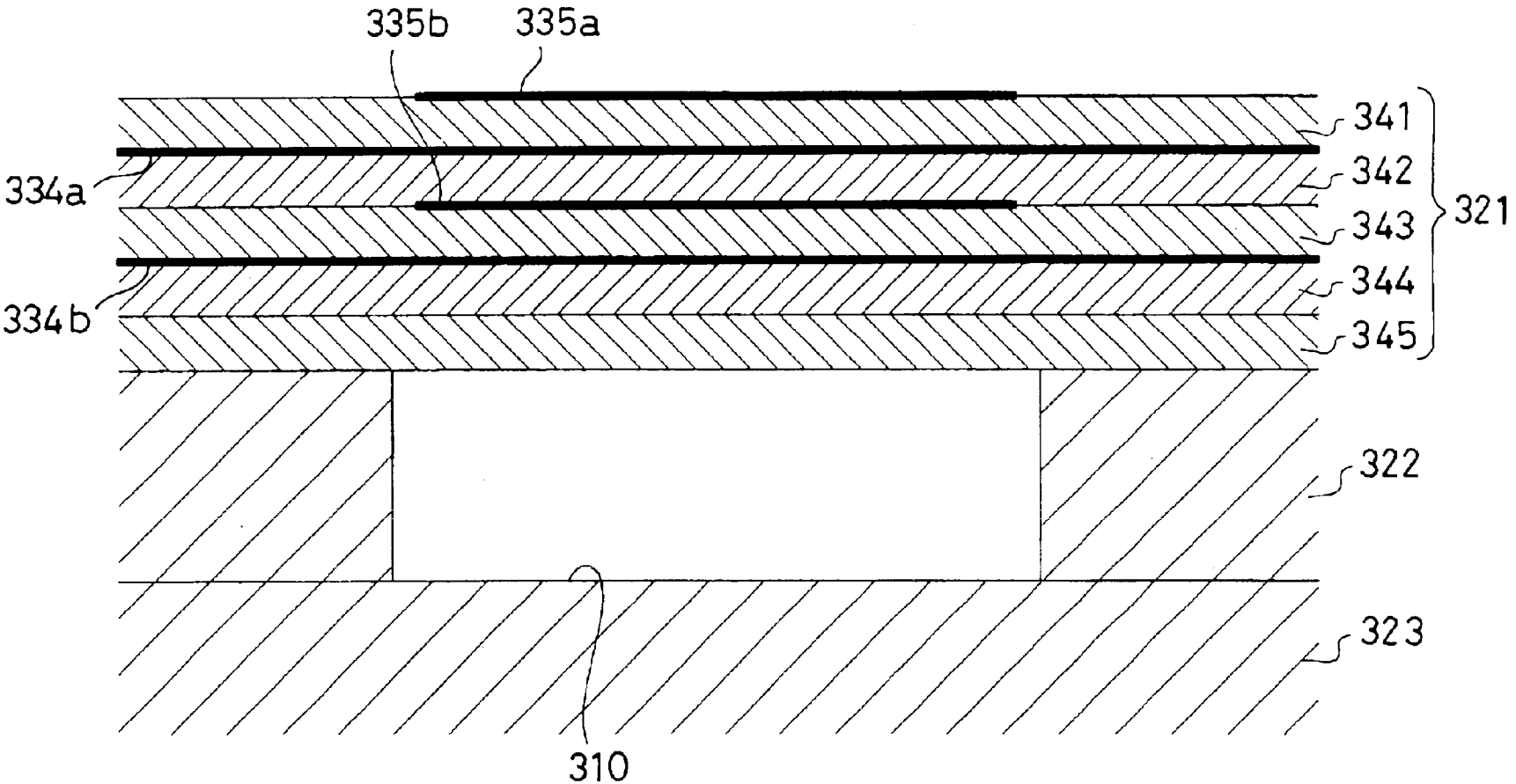
FIG. 27 is an enlarged sectional view illustrating the detailed construction of an actuator unit in the head main body of FIG. 22.

Next, the structure of each actuator unit 321 will be described. Referring to FIG. 27, the actuator unit 321 includes five piezoelectric sheets 341 to 345 having the same thickness of about 15 $\mu$m. These piezoelectric sheets 341 to 345 are made into continuous flat layers. One actuator unit 321 is disposed to extend over many pressure chambers 310 formed in one ink ejection region R2 of the head main body 301. This can realize a highly dense arrangement of individual electrodes 335*a* and 335*b*. Each of the piezoelectric sheets 341 to 345 is made of a lead zirconate titanate (PZT)-base ceramic material having ferroelectricity.

Between the first and second piezoelectric sheets 341 and 342 from the top, an about 2 $\mu$m-thick common electrode 334*a* is interposed formed on substantially the whole of the lower and upper faces of the piezoelectric sheets. Also, between the third and fourth piezoelectric sheets 343 and 344, an about 2 $\mu$m-thick common electrode 234*b* is interposed. On the upper face of the first piezoelectric sheet 341, an about 1 $\mu$m-thick individual electrode 335*a* is formed to correspond to each pressure chamber 310. As illustrated in FIG. 24, the individual electrode 335*a* has a similar shape to that of the pressure chamber 310 in a plan view though the individual electrode 335*a* is somewhat smaller than the pressure chamber 310. The individual electrode 335*a* is disposed such that the center of the individual electrode 335*a* coincides with the center of the corresponding pressure chamber 310. Further, between the second and third piezoelectric sheets 342 and 343, an about 2 $\mu$m-thick individual electrode 335*b* is interposed formed like the individual electrode 335*a*. No electrode is provided between the fourth and fifth piezoelectric sheets 344 and 345, and on the lower face of the fifth piezoelectric sheet 345. Each of the electrodes 334*a*, 334*b*, 335*a*, and 335*b* is made of, e.g., an Ag—Pd-base metallic material.

The common electrodes 334*a* and 334*b* are grounded in a region (not shown). Thus, the common electrodes 334*a* and 334*b* are kept at the ground potential at a region corresponding to any pressure chamber 310. In order that the individual electrodes 335*a* and 335*b* in each pair corresponding to a pressure chamber 310 can be controlled in potential independently of another pair, they are connected with a suitable driver IC (not shown) through a lead provided separately for each pair of individual electrodes 335*a* and 335*b*.

In the head main body 301, the piezoelectric sheets 341 to 345 are to be polarized in their thickness. That is, the actuator unit 321 has a so-called unimorph structure in which the upper (i.e., distant from the pressure chamber 310) three piezoelectric sheets 341 to 343 are layers including active layers, and the lower (i.e., near the pressure chamber 310) two piezoelectric sheets 344 and 345 are made into inactive layers.

In this structure, when the individual electrodes 335*a* and 335*b* in a pair are set at a positive or negative predetermined potential, if the polarization is in the same direction as the electric field for example, the portion (an active layer, i.e., a pressure generation portion) in the piezoelectric sheets 341 to 343 sandwiched by the common and individual electrodes contracts perpendicularly to the polarization. On the other hand, because the inactive piezoelectric sheets 344 and 345 are influenced by no electric field, they do not contract in themselves. Thus, a difference in strain perpendicular to the polarization is produced between the upper piezoelectric sheets 341 to 343 and the lower piezoelectric sheets 344 and 345. As a result, the whole of the piezoelectric sheets 341 to 345 is ready to deform into a convex shape toward the inactive side (unimorph deformation). At this time, because the lower face of the lowermost piezoelectric sheet 345 is fixed to the upper face of the partition partitioning pressure chambers 310, the piezoelectric sheets 341 to 345 deform into a convex shape toward the pressure chamber 310 side to decrease the volume of the pressure chamber 310. As a result, the pressure of ink is raised and the ink is ejected through the ink ejection port 308. After this, when application of the driving voltage to the individual electrodes 335*a* and 335*b* is stopped, the piezoelectric sheets 341 to 345 return to the original shape and the pressure chamber 310 also returns to its original volume. Thus, the pressure chamber 310 draws the ink therein through the manifold channel 305.

To manufacture each actuator unit 321, first, ceramic green sheets to be piezoelectric sheets 341 to 345 are put in layers and then baked. At this time, a metallic material to be individual electrodes 335*a* or a common electrode 334*a* or 334*b* is printed into a pattern on each ceramic green sheet at need. After this, a metallic material to be individual electrodes 335*a* is formed by plating on the whole of the upper face of the first piezoelectric sheet 341 and then unnecessary portions of the material are removed by laser patterning. Alternatively, a metallic material to be individual electrodes 335*a* is deposited using a mask having openings at portions corresponding to the respective individual electrodes 335*a*.

The actuator unit 321 thus manufactured is very brittle because it is made of ceramic. In particular, because corners of the actuator unit 321 are very easily broken, very delicate handling is required upon manufacture and assembling in order that any corner must not be brought into contact with another component.

Figure 28A:
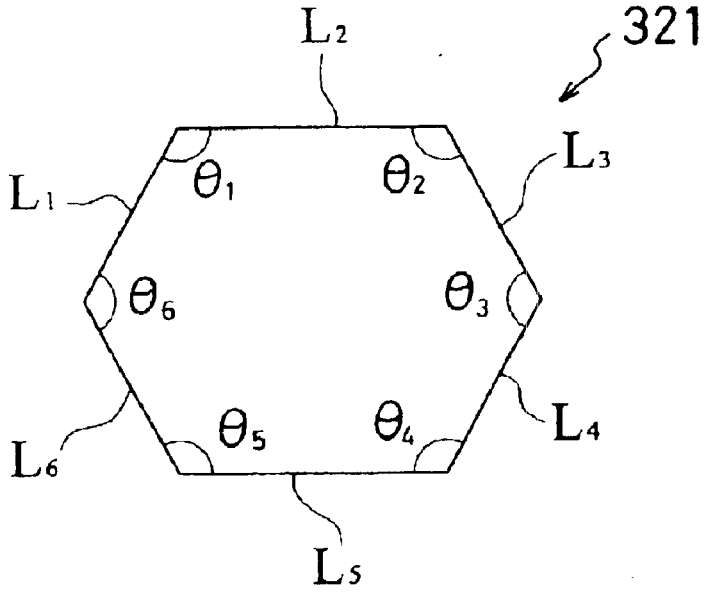
FIG. 28A is a schematic view illustrating the profile of an actuator unit included in the head main body of FIG. 22.

However, as illustrated in FIG. 28A that is a plan view of the actuator unit 321, in the ink-jet head according to this embodiment, the actuator unit 321 has a substantially regular-hexagonal profile. Any of six straight portions (sides) L1 to L6 included in this profile is connected with a neighboring straight portion L at about 120°. As a result, because any of the six corners (portions of each neighboring straight portions L crossing each other) θ1 to θ6 is not sharp, it is difficult to be broken off. Therefore, the actuator unit 321 as an expensive precise component may not easily brake in the middle of manufacture process. This may contribute to a reduction of manufacture cost.

Figure 28B:
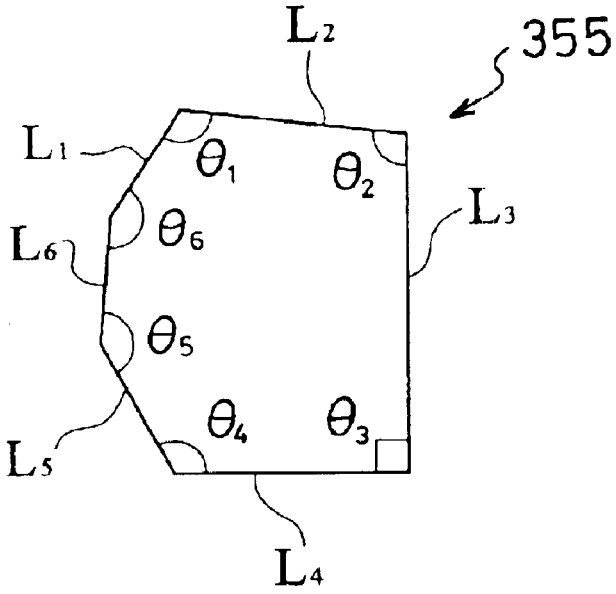
FIG. 28B is a schematic view illustrating the profile of an actuator unit as a modification.

The above effect is not obtained only when any of the corners θ1 to θ6 is formed into 120°. If a corner θn is formed into 90° or more, the corner θn is hard to be broken off. Therefore, for making any of the six corners θ1 to θ6 hard to be broken off, it suffices that any of the six straight portions L1 to L6 is connected with a neighboring straight portion L at the right angle or an obtuse angle (the minimum value of the angles θ1 to θ6 at the crossing portions is 90° or more). The hexagonal profile can freely be changed as far as the above condition is satisfied. FIG. 28B illustrates an actuator unit 355 as an example in which the above condition is satisfied.

Further, this embodiment also can bring about the same advantages as those of the above-described first embodiment. More specifically, because the four actuator units 321 are arranged along the longitudinal direction of the passage unit 304, even in case of a long passage unit 304, high accuracy can be obtained in positioning of the actuator units 321 to the passage unit 304. Therefore, good ink ejection performance can be obtained and the manufacture yield of ink-jet heads 301 can be remarkably improved. Furthermore, by sandwiching the piezoelectric sheets 341 to 343 between the common electrodes 334*a* and 334*b* and the individual electrodes 335*a* and 335*b*, the volume of each pressure chamber 310 can easily be changed by the piezoelectric effect. Furthermore, the piezoelectric sheets 341 to 343 including active layers can easily be manufactured because they are continuous flat layers. Furthermore, because an actuator unit 321 of a unimorph structure is provided in which the piezoelectric sheets 344 and 345 near to each pressure chamber 310 are inactive and the piezoelectric sheets 341 to 343 far from each pressure chamber 310 are layers including active layers, the change in volume of each pressure chamber 310 can be increased by the transversal piezoelectric effect, and lowering the voltage to be applied to the individual electrodes 335*a* and 335*b* and/or high integration of the pressure chambers 310 can be intended. Further, in the passage unit 304, because a large number of pressure chambers 310 neighboring each other are arranged in a matrix, the many pressure chambers 310 can be disposed at a high density within a relatively small size.

In the invention, the profile of each actuator unit is not limited to a hexagon. That is, the number of straight portion L may be not six but five, seven, eight, or more. Hereinafter, modifications in profile of each actuator unit will be described with reference to FIGS. 28 to 30. In the below modifications, the same components as in the above-described third embodiment are denoted by the same reference numerals as in the third embodiment, respectively.

Figure 29A:
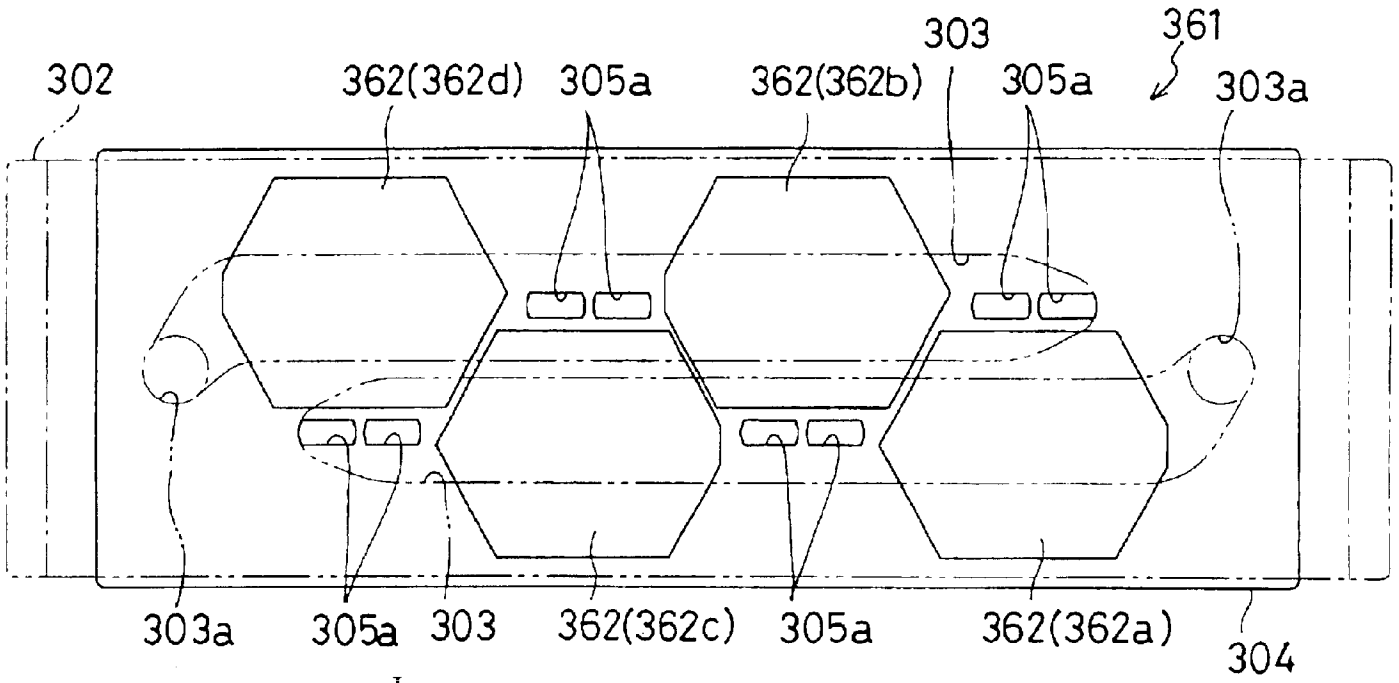
FIG. 29A is a plan view of a modification of the head main body of FIG. 22, which includes heptagonal actuator units.
Figure 29B:
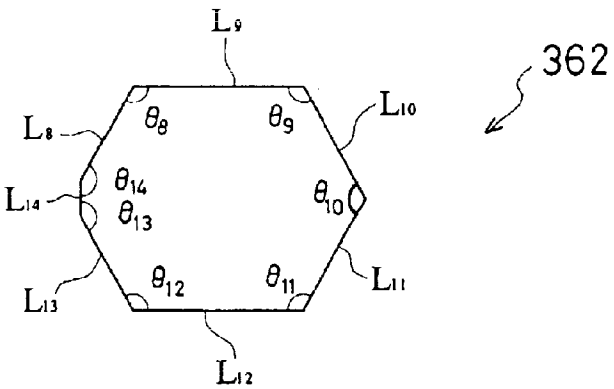
FIG. 29B is a plan view of an actuator unit included in the head main body of FIG. 29A.

FIG. 29A is a plan view of a head main body in which each actuator unit is made into a heptagonal shape. FIG. 29B is a plan view of an actuator unit included in the head main body of FIG. 29A. As apparent from FIGS. 29A and 29B, in this modification, the components of the head main body 361 other than the actuator units 362 (In FIGS. 29A, they are denoted by reference numerals 362*a*, 362*b*, 362*c*, and 362*d*, respectively, in order from the right) are constructed like those of the head main body 301 of the third embodiment.

Referring to FIG. 29B, each actuator unit 362 has its profile in which one corner of a hexagon according to the above-described embodiment has been cut off along a straight line. As a result, the number of straight portion L is seven (L8 to L14), and as for the angle of each corner, θ8 to θ12 are about 120° and θ13 and θ14 are about 150°.

Figure 30A:
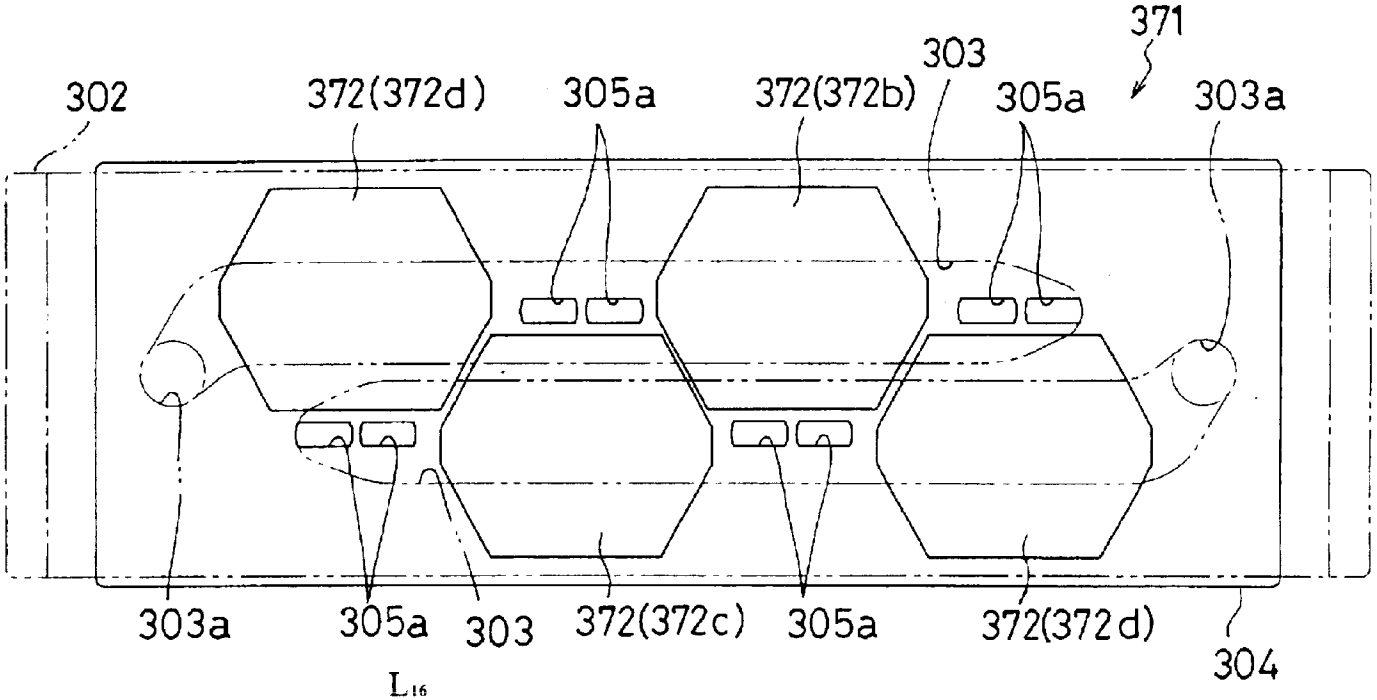
FIG. 30A is a plan view of another modification of the head main body of FIG. 22, which includes octagonal actuator units.
Figure 30B:
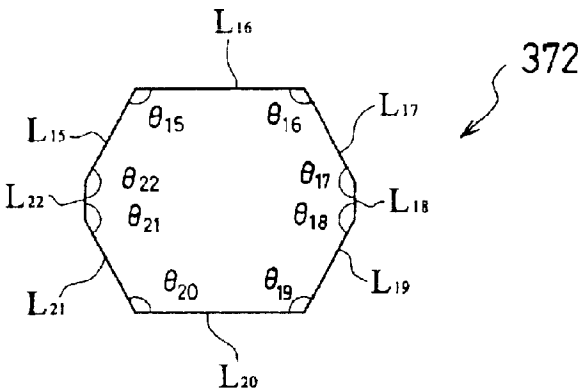
FIG. 30B is a plan view of an actuator unit included in the head main body of FIG. 30A.

FIG. 30A is a plan view of a head main body in which each actuator unit is made into an octagonal shape. FIG. 30B is a plan view of an actuator unit included in the head main body of FIG. 30A. As shown in FIGS. 30A and 30B, in this modification, the components of the head main body 371 other than the actuator units 372 (In FIGS. 30A, they are denoted by reference numerals 372*a*, 372*b*, 372*c*, and 372*d*, respectively, in order from the right) are constructed like those of the head main body 301 of the third embodiment.

Referring to FIG. 30B, each actuator unit 372 has its profile in which two corners of a hexagon according to the above-described embodiment has been cut off along straight lines. As a result, the number of straight portion L is eight (L15 to L22), and as for the angle of each corner, θ15, θ16, θ19, and θ20 are about 120° and θ17, θ18, θ21, and θ22 are about 150°. In the above-described two modifications, because the angle of each corner of each cut-off portion is 150°, which is larger than that of the above-described hexagonal actuator unit 321, the corner is harder to be broken off than that of the above-described hexagonal actuator unit 321.

Figure 31A:
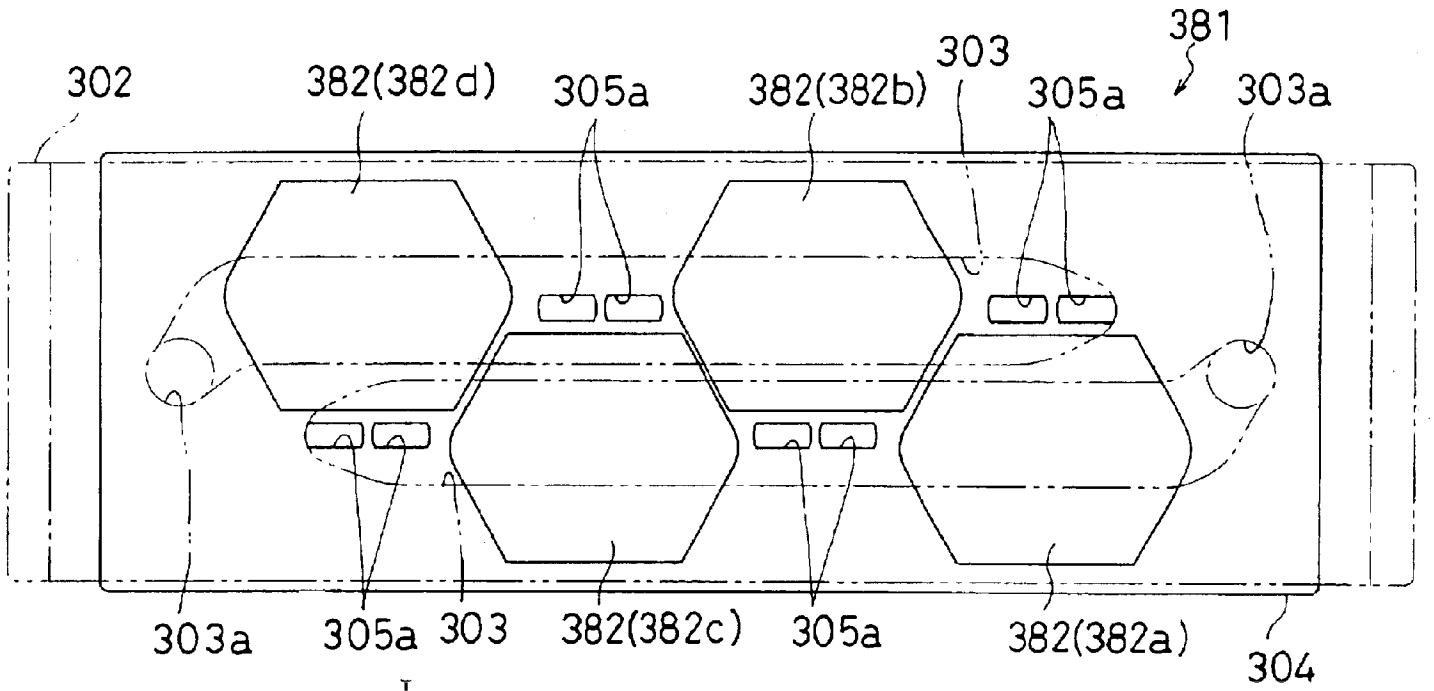
FIG. 31A is a plan view of still another modification of the head main body of FIG. 22, which includes partially rounded actuator units.
Figure 31B:
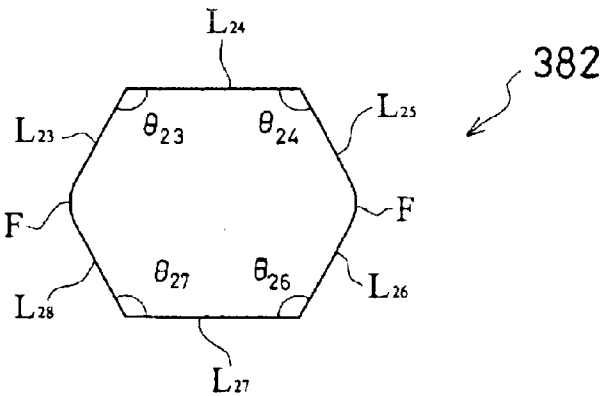
FIG. 31B is a plan view of an actuator unit included in the head main body of FIG. 31A.

FIG. 31A is a plan view of a head main body in which two interconnecting portions of neighboring straight portions L in the actuator unit of the above-described third embodiment have been made into rounded portions F. FIG. 31B is a plan view of an actuator unit included in the head main body of FIG. 31A. As shown in FIGS. 31A and 31B, in this modification, the components of the head main body 381 other than the actuator units 382 (In FIGS. 31A, they are denoted by reference numerals 382*a*, 382*b*, 382*c*, and 382*d*, respectively, in order from the right) are constructed like those of the head main body 301 of the second embodiment.

Referring to FIG. 31B, each actuator unit 382 has six straight portions L23 to L28. Two interconnecting portions of neighboring straight portions L (L23 and L28, and L25 and L26) in the actuator unit 382 are made into rounded portions F, where neighboring straight portions L are smoothly interconnected. Each rounded portion F is very hard to be broken off. Also in this case, the angle between each neighboring straight portions L, including two straight portions on both sides of each rounded portion F, (θ23 to θ27), is more than 90° (about 120°).

Next, the fourth exemplary embodiment of the invention will be described with reference to FIG. 32. In the ink-jet head and ink-jet printer according to this embodiment, because the parts other than the head main body is similar to that of the above-described first embodiment, the detailed description thereof is omitted here.

Figure 32:
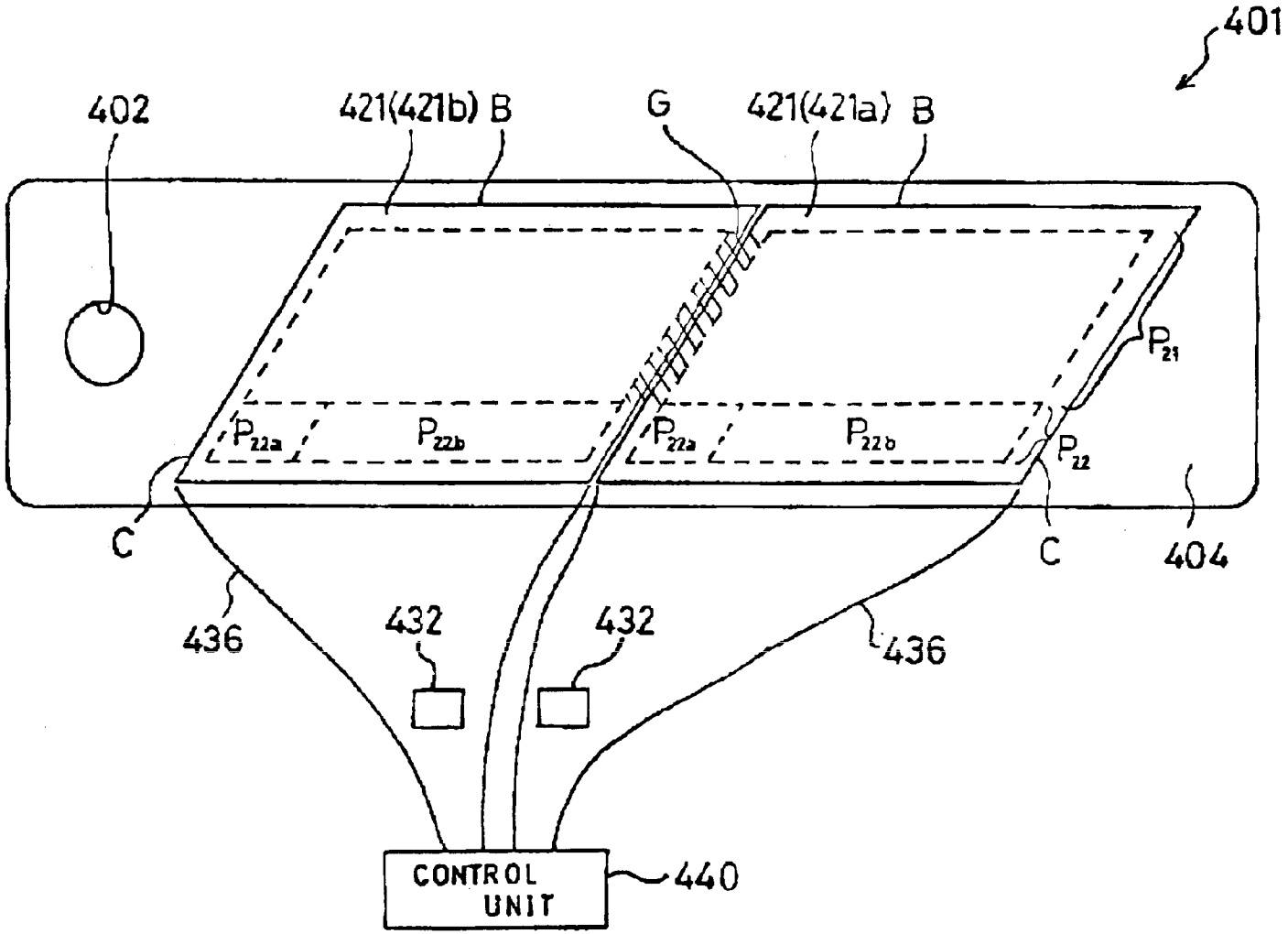
FIG. 32 is a schematic view of a principal part of an ink-jet printer according to the fourth exemplary embodiment of the invention.

A head main body 401 as illustrated in FIG. 32 includes a passage unit 404 in which a large number of pressure chambers and a large number of ink ejection ports are formed like the above-described embodiments. Onto the upper face of the passage unit 404, two parallelogrammic actuator units 421 (In FIG. 32, the right and left ones are denoted by reference numerals 421*a* and 421*b*, respectively) are bonded neighboring each other. Each actuator unit 421 is disposed so that its one side B extends along the longitudinal direction of the head main body 401. The neighboring actuator units 421 are disposed so as to be aligned with each other along the lateral direction of the head main body 401 with their oblique sides C being close to each other. Two actuator units 421 partially overlap each other along the lateral direction of the passage unit 404. An ink supply port 402 is open in the upper face of the passage unit 404. The ink supply port 402 is connected with an ink supply source through a passage (not shown).

An FPC 436 is bonded onto the upper face of each actuator unit 421, and is used for supplying electric signals to individual and common electrodes in the actuator unit 421. A driver IC 432 is bonded onto each FPC 436, and is used as a driving circuit for generating driving signals to be supplied to the individual electrodes in the corresponding actuator unit 421. Each FPC 436 is electrically connected with a control unit 440 including CPU, RAM, and ROM. The control unit 440 supplies printing data to each driver IC 432. Each driver IC 432 generates driving signals for individual electrodes on the basis of the printing data.

Two regions P21 and P22 are provided in each actuator unit 421. Of them, the basic region P21 has a substantially parallelogrammic shape having its sides in parallel with the respective sides of the corresponding actuator unit 421. The basic region P21 has its width somewhat shorter than the side B of the actuator unit 421 and its length of about ¾ the side C of the actuator unit 421. In FIG. 32, the basic region P21 is provided in an upper portion of the actuator unit 421. The additional region P22 has a substantially parallelogrammic shape having its sides in parallel with the respective sides of the corresponding actuator unit 421. The additional region P22 has the same width as the basic region P21 and is disposed on the lower side of the basic region P21. The additional region P22 is divided into two sub-regions P22*a* and P22*b* each having a substantially parallelogrammic shape having its sides in parallel with the respective sides of the actuator unit 421. The sub-region P22*a* has its width of about ⅕ the side B of the actuator unit 421 and its length of about ⅕ the side C of the actuator unit 421. In FIG. 32, the sub-region P22*a* is near the lower left acute portion of the actuator unit 421. The sub-region P22*b* has its width of about ⅗ the side B of the actuator unit 421 and its length of about ⅕ the side C of the actuator unit 421. In FIG. 32, the sub-region P22*b* is on the lower side of the basic region P21 and on the right side of the sub-region P22*a*.

In each of the basic region P21 and the sub-regions P22*a* and P22*b* of the additional region P22, a large number of pressure generation portions are arranged with neighboring each other in a matrix along the longitudinal direction of the passage unit 404 and along the side C of the parallelogram. Pressure chambers and ink passages including nozzles are formed in the passage unit 404 to correspond to the respective pressure generation portions.

When the two actuator units 421*a* and 421*b* each constructed as described above are arranged in line along the longitudinal direction of the passage unit 404 as illustrated in FIG. 32, a region (hatched region G in FIG. 32) where no pressure generation portions exist is formed near the seam portion between the actuator units 421*a* and 421*b*. When the only pressure generation portions in the basic region P11 are taken into consideration, the number of pressure generation portions along the lateral direction of the passage unit 404 in the vicinity of the seam portion is less than that in the portion other than the vicinity of the seam portion.

Hence, in this embodiment, utilizing the feature that the sub-region P22*a* of the additional region P22 provided on the lower side of the basic region P21 is provided to correspond to the region G where no pressure generation portions exist, near the seam portion, along the lateral direction of the passage unit 404, the control unit 440 controls each driver IC 432 upon printing so as to drive pressure generation portions in the basic region P21 and in the sub-region P22*a* of the additional region P22 and not to drive any pressure generation portion in the sub-region P22*b* of the additional region P22. By this, because pressure generation portions in the actuator unit 421 are arranged in a region having substantially the same shape as in the actuator unit 221 of FIG. 18, the number of pressure generation portions along the passage unit 404 near the seam portion is the same as that in the other portion. That is, because the pressure generation portions of the sub-region P22*a* of the additional region P22 are disposed so as to correspond to the gap portion between the pressure generation portions of the basic region P21 provided in one actuator unit 421*a* and the pressure generation portions of the basic region P21 provided in the neighboring actuator unit 421*b*, the head main body 401 is capable of printing without any breaks throughout the longitudinal direction of the passage unit, and without providing any other actuator unit for ejecting ink through the gap portion. Further, because the pressure generation portion formation region in each actuator unit 421 has a similar shape to that of the actuator unit 421, problems of distortion, bend, or the like, of the actuator unit 421 is difficult to arise.

As apparent from the above description, in this embodiment, ink passages may not be provided in the portion of the passage unit 404 corresponding to the sub-region P22*b* of the additional region P22.

The materials of each piezoelectric sheet and each electrode used in the above-described embodiments are not limited to the above-described ones. They can be changed to other known materials. The shapes in plan and sectional views of each pressure chamber, the arrangement of pressure chambers, the number of piezoelectric sheets including active layers, the number of inactive layers, etc., can be changed properly. Each piezoelectric sheet including active layers may differ in thickness from each inactive layer.

Furthermore, in the above-described embodiments, each actuator unit is constructed in which individual and common electrodes are provided on a piezoelectric sheet. However, such an actuator unit may not always be used bonded to the passage unit. Any other actuator unit can be used if it can change the volumes of the respective pressure chambers separately. Furthermore, in the above-described embodiments, pressure chambers are arranged in a matrix. However, the pressure chambers may be arranged in a line or lines. Further, although any inactive layer is made of a piezoelectric sheet in the above-described embodiment, the inactive layer may be made of an insulating sheet other than a piezoelectric sheet.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head, comprising:

a passage unit including a plurality of pressure chambers each having one end coupled to a nozzle and the other end to be coupled to an ink supply source, the plurality of pressure chambers being arranged along a plane so as to neighbor each other; and a plurality of actuator units attached to a surface of the passage unit for changing the volume of each of the pressure chambers, each actuator unit including a plurality of pressure generation portions respectively corresponding to pressure chambers, each of the actuator units being formed to extend over the pressure chambers, the plurality of actuator units being arranged along the longitudinal direction of the passage unit so that neighboring actuator units partially overlap each other in the lateral direction of the passage unit, each of the actuator units comprising:

a basic region where a large number of pressure generation portions are formed in a matrix; and an additional region neighboring the basic region in the lateral direction of the passage unit, where pressure generation portions are formed to correspond to a gap portion between the pressure generation portions in the basic region of the each of the actuator units and the pressure generation portions in the basic region of another actuator unit neighboring the actuator unit.

2. The ink-jet head according to claim 1, wherein each of the actuator units has a substantially tetragonal flat shape, and the additional region is provided near an acute corner of the actuator unit.

3. The ink-jet head according to claim 2, wherein each of the actuator units has a substantially parallelogrammic flat shape, the plurality of actuator units being arranged along the longitudinal direction of the passage unit neighboring each other so that one opposed sides of each of the actuator units are in parallel with the longitudinal direction of the passage unit and the other opposed sides are oblique relatively to the longitudinal direction of the passage unit, and the additional region being provided near an acute corner of the actuator unit.

4. The ink-jet head according to claim 1, wherein no pressure generation portions are provided in a region neighboring the additional region in the longitudinal direction of the passage unit and neighboring the basic region in the lateral direction of the passage unit.

5. The ink-jet head according to claim 4, wherein lines each having a large number of pressure generation portions arranged thereon are provided in each of the actuator units, and the number of lines that an imaginary straight line perpendicular to the longitudinal direction of the passage unit crosses in a region where neighboring actuator units overlap each other is the same as the number of lines that the straight line crosses in a region where neighboring actuator units do not overlap each other.

6. The ink-jet head according to claim 1, wherein two or more actuator units are arranged in a line along the longitudinal direction of the passage unit.

7. An ink-jet printer including an ink-jet head, the ink-jet head comprising:

a passage unit including a plurality of pressure chambers each having one end coupled to a nozzle and the other end to be coupled to an ink supply source; the plurality of pressure chambers being arranged along a plane to neighbor each other; and a plurality of actuator units attached to a surface of the passage unit for changing the volume of each of the pressure chambers, each of the actuator units including a plurality of pressure generation portions respectively corresponding to pressure chambers, each of the actuator units being formed to extend over the pressure chambers, the plurality of actuator units being arranged along the longitudinal direction of the passage unit so that neighboring actuator units partially overlap each other in the lateral direction of the passage unit, each of the actuator units comprising:

a basic region where a large number of pressure generation portions are formed in a matrix; and an additional region neighboring the basic region in the lateral direction of the passage unit, where pressure generation portions are formed to correspond to a gap portion between the pressure generation portions in the basic region of the each of the actuator units and the pressure generation portions in the basic region of another actuator unit neighboring the actuator unit.

8. Ink-jet printer, comprising:

an ink-jet head;

a driving circuit for driving the ink-jet head; and a control unit, the ink-jet head comprising:

a passage unit including a plurality of pressure chambers each having one end coupled to a nozzle and the other end to be coupled to an ink supply source, the plurality of pressure chambers being arranged along a plane to neighbor each other; and a plurality of actuator units fixed to a surface of the passage unit for changing the volume of each of the pressure chambers, each of the actuator units including a plurality of pressure generation portions respectively corresponding to pressure chambers, each of the actuator units being formed to extend over the pressure chambers, the plurality of actuator units being arranged along the longitudinal direction of the passage unit so that neighboring actuator units partially overlap each other in the lateral direction of the passage unit, each of the actuator units comprising:

a basic region where a large number of pressure generation portions are formed in a matrix; and an additional region neighboring the basic region in the lateral direction of the passage unit, where pressure generation portions are formed, the control unit controlling the driving circuit to drive only pressure chambers in the additional region corresponding to a gap portion between the pressure generation portions in the basic region of the each of the actuator units and the pressure generation portions in the basic region of another actuator unit neighboring the actuator unit, when driving the ink-jet head.

9. An ink-jet head, comprising:

a passage unit including a plurality of pressure chambers each communicating with a nozzle for ejecting ink, the plurality of pressure chambers being arranged along a plane to neighbor each other, a longitudinal length of the passage unit being longer than a lateral length of the passage unit; and a plurality of actuator units arranged along the longitudinal direction of the passage unit and attached to a surface of the passage unit for changing the volume of each of the pressure chambers, each of the actuator units including a plurality of pressure generation portions respectively corresponding to pressure chambers, each of the actuator units being formed to extend over the pressure chambers.

10. The ink-jet head according to claim 9, wherein each of the actuator units includes one or more active layers each made of a piezoelectric sheet sandwiched by a common electrode being kept at a constant potential and an individual electrode being at a position corresponding to each of the pressure chambers.

11. The ink-jet head according to claim 10, wherein one or more inactive layers each made of a piezoelectric sheet are disposed between the active layer or layers and the passage unit.

12. The ink-jet head according to claim 9, wherein the plurality of pressure chambers are arranged in a matrix to neighbor each other.

* * * * *